US007992858B2

(12) United States Patent
Sagawa et al.

(10) Patent No.: US 7,992,858 B2
(45) Date of Patent: Aug. 9, 2011

(54) SHEET CONVEYING APPARATUS, IMAGE SCANNING APPARATUS, AND IMAGE FORMING APPARATUS

(75) Inventors: Yasuhiro Sagawa, Kanagawa (JP); Kenji Ueda, Kanagawa (JP); Masayuki Ueda, Tokyo (JP); Hiroyuki Watase, Kanagawa (JP); Naoyuki Okamoto, Tokyo (JP); Yoshikuni Ishikawa, Tokyo (JP); Hiroshi Kajiyama, Kanagawa (JP); Tamiya Akimoto, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 586 days.

(21) Appl. No.: 11/783,815

(22) Filed: Apr. 12, 2007

(65) Prior Publication Data

US 2007/0246879 A1 Oct. 25, 2007

(30) Foreign Application Priority Data

| | | |
|---|---|---|
| Apr. 19, 2006 | (JP) | 2006-115702 |
| May 15, 2006 | (JP) | 2006-134882 |
| Jul. 14, 2006 | (JP) | 2006-194782 |
| Jul. 25, 2006 | (JP) | 2006-202170 |
| Jan. 29, 2007 | (JP) | 2007-018467 |

(51) Int. Cl.
*B65D 5/00* (2006.01)

(52) U.S. Cl. ..... 271/10.01

(58) Field of Classification Search ..... 271/10.02, 271/10.03, 12, 105, 242, 9.11, 9.13, 10.01, 271/10.12, 10.13, 10.14, 10.06, 10.07, 10.08, 271/10.09

See application file for complete search history.

(56) References Cited

U.S. PATENT DOCUMENTS

| | | | | |
|---|---|---|---|---|
| 4,518,158 A | | 5/1985 | Goi | |
| 5,499,806 A | | 3/1996 | Bourg | |
| 5,765,825 A | * | 6/1998 | Watase | 271/9.13 |
| 5,984,303 A | | 11/1999 | Oohara et al. | |
| 6,273,414 B1 | * | 8/2001 | Matsuo | 271/9.11 |

(Continued)

FOREIGN PATENT DOCUMENTS

DE 31 50825 A1 7/1982

(Continued)

OTHER PUBLICATIONS

Search Report dated Aug. 27, 2010 for corresponding European Application No. 07106028.9-2314.

(Continued)

*Primary Examiner* — José V Chen

(74) *Attorney, Agent, or Firm* — Harness, Dickey & Pierce, P.L.C.

(57) ABSTRACT

A disclosed sheet conveying apparatus includes a first conveying unit configured to convey a sheet in a first sheet conveying direction; and a second conveying unit arranged on a downstream side of the first conveying unit in the first sheet conveying direction and configured to convey the sheet conveyed by the first conveying unit in a second sheet conveying direction different from the first sheet conveying direction. At least the second conveying unit acts as a holding/conveying unit with a holding section to hold and convey the sheet and includes a moving/guiding unit arranged along an outer side of a sheet conveying path extending between the first conveying unit and the second conveying unit. The moving/guiding unit moves/guides the sheet toward the holding section of the second conveying unit, and is arranged in a discontinuous manner along a sheet width direction orthogonal to the first sheet conveying direction so as to contact at least one part of the sheet in the sheet width direction.

17 Claims, 41 Drawing Sheets

U.S. PATENT DOCUMENTS

| | | | | |
|---|---|---|---|---|
| 6,341,774 | B1 * | 1/2002 | Ueda | 271/119 |
| 6,533,263 | B2 * | 3/2003 | Tamura | 271/10.01 |
| 6,690,901 | B2 * | 2/2004 | Katsuyama et al. | 399/107 |
| 6,739,778 | B2 | 5/2004 | Fuchi et al. | |
| 6,757,515 | B2 | 6/2004 | Ueda | |
| 6,952,557 | B2 * | 10/2005 | Kobayashi | 399/394 |
| 6,955,349 | B2 | 10/2005 | Watase | |
| 6,999,713 | B2 * | 2/2006 | Kobayashi | 399/394 |
| 7,014,378 | B2 * | 3/2006 | Saito et al. | 400/582 |
| 7,016,629 | B2 * | 3/2006 | Ishii et al. | 399/258 |
| 7,044,666 | B2 * | 5/2006 | Takahashi et al. | 400/624 |
| 7,068,969 | B2 | 6/2006 | Ueda | |
| 7,163,202 | B2 * | 1/2007 | Togashi et al. | 271/121 |
| 7,181,152 | B2 * | 2/2007 | Kuma et al. | 399/110 |
| 7,195,239 | B2 * | 3/2007 | Saito et al. | 271/256 |
| 7,334,786 | B2 * | 2/2008 | Shinga | 271/9.11 |
| 7,396,009 | B2 * | 7/2008 | Elliott et al. | 271/10.03 |
| 7,548,721 | B2 * | 6/2009 | Isozaki | 399/388 |
| 2004/0265031 | A1 * | 12/2004 | Ueda | 400/636 |
| 2005/0073088 | A1 * | 4/2005 | Watase | 271/121 |
| 2005/0151313 | A1 * | 7/2005 | Shimazaki | 271/10.01 |

FOREIGN PATENT DOCUMENTS

| | | | |
|---|---|---|---|
| EP | 0 556 922 | A1 | 8/1993 |
| EP | 0 564 291 | A2 | 10/1993 |
| EP | 0 619 259 | A1 | 10/1994 |
| JP | 49-008246 | | 1/1974 |
| JP | 56-23149 | | 3/1981 |
| JP | 56-23161 | | 3/1981 |
| JP | 61-060546 | | 3/1986 |
| JP | H1-75052 | | 5/1989 |
| JP | 02-119467 | | 9/1990 |
| JP | 02-248962 | | 10/1990 |
| JP | 04-055268 | | 2/1992 |
| JP | H4-42134 | | 4/1992 |
| JP | 06-156787 | | 6/1994 |
| JP | 07-247034 | | 9/1995 |
| JP | 08-012128 | | 1/1996 |
| JP | 09-290945 | | 11/1997 |
| JP | 10-129883 | | 5/1998 |
| JP | 10-324437 | | 12/1998 |
| JP | 11-091975 | | 4/1999 |
| JP | 2000-143027 | | 5/2000 |
| JP | 2001-278522 | | 10/2001 |
| JP | 2002-226068 | | 8/2002 |
| JP | 2002-284392 | | 10/2002 |
| JP | 2004-284777 | | 10/2004 |
| JP | 2004-338923 | | 12/2004 |
| JP | 2005-001771 | | 1/2005 |
| JP | 2005-089008 | | 4/2005 |
| JP | 2008-037587 | | 2/2008 |

OTHER PUBLICATIONS

Office Action for coresponding Japanese Patent Application No. 2006-134882 dated Apr. 19, 2010.

Office Action for corresponding Japanese Patent Application No. 2006-202170 dated Aug. 3, 2010.

* cited by examiner

SHEET CONVEYING APPARATUS, IMAGE SCANNING APPARATUS, AND IMAGE FORMING APPARATUS

BACKGROUND OF THE INVENTION

1. Field of the Invention

The present invention relates to a sheet conveying apparatus; an image scanning apparatus such as a copier, a facsimile machine, a printer, a printing machine, an inkjet recording device, and a scanner provided with the sheet conveying apparatus; or an image forming apparatus such as a multifunction peripheral combining functions of at least two of the above.

2. Description of the Related Art

Conventionally, in order to reduce the overall sizes of image forming apparatuses including copiers such as a PPC (plain paper copier) and an electrophotographic copier, facsimile machines, printers such as a laser beam printer, printing machines, and inkjet recording devices, the sizes of conveying units provided therein also tend to be reduced. Specifically, the conveying unit is used for conveying a medium or a sheet-type recording medium onto which an image is formed (hereinafter, "sheet"). The sheet is conveyed from a sheet storing unit or a sheet stacking unit where sheets are stacked to a main unit of an image forming unit (hereinafter, "image forming unit main unit"). In the following, the sheet storing unit is described as a representative example of a unit for storing sheets.

Furthermore, the image forming apparatuses typically accommodate various sheet sizes and sheet types. For example, sheets of different sheet sizes and different sheet types are previously stored in plural sheet storing units. A sheet is fed from the sheet storing unit selected by a user or automatically selected by the image forming apparatus. In such a configuration, the sheet storing units occupy a large space in the image forming apparatus, and therefore, it is particularly necessary to reduce the size of the conveying unit.

One approach is to have a conveying path between the sheet storing unit and the image forming unit main unit that considerably changes its direction midway (bends) depending on the positional relationship between the two units, so as to reduce the space occupied by the conveying path. Thus, in order to change the conveying direction in a continuous and smooth manner in the conveying path, the conveying path is provided with a curvature section having a curved shape. The curvature section is made to have a relatively small curvature radius so that a regular-sized recording sheet normally used in the image forming apparatus can be conveyed.

An example of a conventional sheet conveying apparatus in an image forming apparatus is disclosed in Japanese Laid-Open Patent Application No. 2004-338923 (Patent Document 1). As shown in FIGS. 6, 7 of Patent Document 1, sheet feeding trays acting as sheet storing units are arranged beneath the image forming unit main unit. Predetermined numbers of sheets of predetermined sheet sizes and sheet types are stacked in the sheet feeding trays. In between the sheet feeding trays and the image forming unit main unit is provided a sheet conveying apparatus for extracting a sheet of paper in a substantially horizontal direction from the selected sheet feeding tray and feeding the extracted sheet in an upward direction toward the image forming unit main unit arranged above.

In the following description, reference numerals shown in the figures of Japanese Laid-Open Patent Application No. 2004-338923 are indicated in parentheses. A sheet (P) in a sheet feeding tray (1) is separated from the stack of sheets by the conventional FRR (Feed Reverse Roller) separating method, and is sent to an image forming unit main unit through a conveying path provided with a curvature section formed with an upper guide plate (8) and a lower guide plate (7). The curvature section acts as a "curve fix guiding member" including the upper guide plate (8) and the lower guide plate (7). When the sheet passes through the curvature section, the sheet is first conveyed along the lower guide plate (7). As the sheet is conveyed further on, the sheet is pressed from above by the upper guide plate (8). The sheet (P) is conveyed by an elastically deformable guide piece (6) positioned at the outlet end of the lower guide plate (7) and reaches a pair of conveying rollers (5). Hereinafter, the upper guide plate (8) and the lower guide plate (7) are referred to as the "curve fix guiding member".

However, in the sheet conveying apparatus with the above configuration, the following problem arises when conveying a special type of sheet (P) with high rigidity, such as a cardboard recording paper or an envelope. That is, when the sheet (P) bends and moves along the curvature, such a highly rigid recording paper or special paper receives a much larger resistance compared to a regular sheet such as a plain paper sheet used for copying. This is because the curvature section in the conveying path has a small radius. As a result, the highly rigid sheet (P) cannot move along the conveying path, causing a paper jam failure or a conveyance failure. Thus, the sheet feeding operation cannot be steadily performed.

Further details of the above operation are described as follows. When the leading edge of the sheet (P) in the sheet conveying direction reaches the curve fix guiding member configured with the upper guide plate (8) and the lower guide plate (7), the front half the sheet (P) including the leading edge curves (bends) in its thickness direction. Accordingly, when a highly rigid sheet (P) is conveyed, a large force resists this bending action, in such a manner that a large resistance obstructs the sheet conveyance. As a result, the leading edge of the highly rigid sheet (P) may not reach the pair of conveying rollers (5) at the downstream side so that the sheet (P) is conveyed only by a pair of rollers (2*a*, 2*b*) on the upstream side. However, when the sheet (P) is bent by the curve fix guiding member, the conveying force of the pair of rollers (2*a*, 2*b*) alone is insufficient for conveying the highly rigid sheet (P) to counter to the resistance caused by the bending action. As a result, the following conveyance failures may be caused. Specifically, the sheet (P) is caused to move in an oblique manner because the center line of the highly rigid sheet (P) does not match the center line of the conveying path, or a paper jam occurs because the highly rigid sheet (P) becomes caught inside the curve fix guiding member and stops moving.

Accordingly, Japanese Laid-Open Patent Application No. 2004-338923 also discloses the following sheet feeding device. A sheet is sent out from a first conveying member and conveyed to a second conveying member arranged at a position downstream in the conveying direction and substantially perpendicularly above the first conveying member. A pair of linear guiding members is provided between the first conveying member and the second conveying member, and the sheet is conveyed by being guided by these linear guiding members. In this sheet feeding device, the guiding members do not have curved shapes but have linear shapes, and therefore, the conveyance load can be maintained at a low level. That is, the load can be prevented from rising abruptly so that conveyance failures such as a paper jam or oblique movements can be prevented.

That is, according to the above described sheet feeding device, the conveyed sheet is not caused to deform (bend) only at one position, but is caused to deform at two positions, i.e., near the front and the back ends of the linear guiding members in the conveying direction. Furthermore, the linear guiding members are arranged in oblique manners at substantially intermediate angles, so that the sheet bends by the same amount at the aforementioned two positions. Therefore, the conveyance load is prevented from rising abruptly. Specifically, the sheet changes its traveling direction by bending at the two positions, namely, when the sheet is passed from the pair of rollers located at the upstream side to the linear guiding member, and when the sheet is passed from the linear guiding member to the pair of rollers located at the downstream side. Thus, the sheet bends by smaller extents at these two positions compared to abruptly bending at one position. Thus, the resistance caused by the bending action of the sheet can be reduced at each of the two positions, thus preventing the conveyance load from rising abruptly.

Another type of sheet feeding device with a first conveying member and a second conveying member having substantially the same configurations as those of Japanese Laid-Open Patent Application No. 2004-338923 (Patent Document 1) is described as follows. This type includes a reverse guiding member provided in an inclined manner between the first conveying member and the second conveying member. This reverse guiding member is configured to move toward the second conveying member (see, for example, Patent Document 2).

In this sheet feeding device, when the trailing edge of the sheet contacts the reverse guiding member, the reverse guiding member shifts its position in a direction substantially according to the trailing edge of the sheet. This shift makes it possible to absorb the shock caused when the trailing edge of the sheet contacts the reverse guiding member. Hence, a flipping noise can be reduced.

Yet another type of sheet feeding device has been disclosed. This sheet feeding device includes plural sheet storing units for storing sheets, and each of the sheet storing units is provided with a conveying path and a sheet conveying unit. The ends of the conveying paths merge into a common conveying path. Each of the conveying paths has a curvature section at the end thereof where it merges with the common conveying path. At least one of the conveying paths provided for a sheet storing unit storing highly rigid sheets has a first curvature section with a larger curvature radius than those of the other conveying paths (see, for example, Patent Document 3).

Therefore, in this sheet feeding device, highly rigid sheets are caused to bend more moderately compared to plain paper sheets. A highly rigid sheet moves along the conveying path and passes through the first curvature section having a large curvature radius, so that it does not bend as much as a plain paper sheet passing through a curvature section having a smaller curvature radius. Accordingly, it is possible to reduce the resistance while conveying a highly rigid sheet, so that the sheet is conveyed to the common conveying path without being suspended or stopped.

The following is a description of a sheet reversing unit provided in an image forming apparatus. This sheet reversing unit includes a pair of reverse rollers and a reverse conveying path for conveying/guiding a sheet received from the pair of reverse rollers. The reverse conveying path includes a direction changing section for changing the direction of conveying a sheet. Rotatable rollers are arranged inside the direction changing section in a direction orthogonal to the sheet conveying direction, so that a sheet sent into the reverse conveying path can be sent out while being in abutment with the rollers (see, for example, Patent Document 4).

According to this sheet reversing unit, when a sheet is sent inside, it is ensured that the portion of the sheet inside of the direction changing section contacts the rollers, and the rollers are caused to rotate by (rotate following) the movement of the sheet in the conveying direction. Thus, compared to a conventional guiding plate, the conveying resistance can be reduced. Specifically, it is possible to eliminate frictional resistance occurring between a fixed guiding member and the moving sheet while changing the conveying direction of the sheet at the direction changing section.

Patent Document 1: Japanese Laid-Open Patent Application No. 2004-338923 (pp. 1-3, FIGS. 1-7)

Patent Document 2: Japanese Laid-Open Patent Application No. 2005-89008 (pp. 2-3, FIGS. 4, 5)

Patent Document 3: Japanese Laid-Open Patent Application No. H10-129883 (pp. 1-2, FIG. 1)

Patent Document 4: Japanese Laid-Open Patent Application No. 2005-1771 (pp. 1-2, FIG. 1)

However, the sheet conveying apparatus disclosed in Patent Document 1 merely provides a fixed member for guiding a conveyed sheet, and thus does not eliminate the speed difference between the conveyed sheet, which is a mobile object, and the fixed guiding member. Accordingly, regardless of the shape or position of the guiding member, resistance occurs in such a direction to obstruct the sheet from being conveyed, resulting in a conveyance load.

That is, this conventional configuration is insufficient for preventing conveyance failures or paper jams. Although the linear guiding member can reduce the conveyance load from rising abruptly, a conveyance load is generated nonetheless. Particularly when conveying a highly rigid sheet, such as a cardboard recording paper or an envelope, conveyance failures and paper jams frequently occur and flipping noises made by the trailing edge of the sheet become considerably large.

Furthermore, as described in Patent Document 2, the reverse guiding member can shift its position in a direction according to the trailing edge of the sheet contacting the reverse guiding member; however, the reverse guiding member merely functions as a fixed guide member in terms of changing the direction of the sheet. Accordingly, similar to the above, this conventional technology does not eliminate the relative speed difference between the sheet and the reverse guiding member when changing the direction of/guiding the sheet, thus generating a conveyance load. Particularly when conveying a highly rigid sheet, such as a cardboard recording paper or an envelope, conveyance failures and paper jams frequently occur and flipping noises made by the trailing edge of the sheet become considerably large.

Furthermore, as described in Patent Document 3, the conveying path with a large curvature radius dedicated for highly rigid sheets makes it possible for sheets traveling therethrough to bend moderately so as to reduce the conveyance resistance applied from the conveying path on the sheet. However, a conveyance load is somewhat generated nonetheless. Particularly when conveying a highly rigid sheet, such as a cardboard recording paper or an envelope, conveyance failures and paper jams frequently occur.

Furthermore, as described in Patent Document 4, movable members such as rollers are provided at predetermined positions inside the direction changing section of the conveying path. Therefore, in the process of conveying the sheet, the frictional resistance between the sheet and the guiding member can be effectively reduced while the internal rollers are supporting the middle portion of the sheet between the leading edge and the trailing edge. However, there are no measures provided for reducing the conveyance load before and after the sheet is supported by the internal rollers, i.e., when the sheet is in contact with the conveying path outside the direction changing section. Furthermore, nothing is particularly mentioned about behaviors of the leading edge and the trailing edge of the sheet while being conveyed. Particularly when conveying a highly rigid sheet, such as a cardboard recording paper or an envelope, conveyance failures and paper jams frequently occur and flipping noises made by the trailing edge of the sheet become considerably large.

SUMMARY OF THE INVENTION

The present invention provides a sheet conveying apparatus, an image scanning apparatus provided with the sheet conveying apparatus, and an image forming apparatus provided with the sheet conveying apparatus in which one or more of the above-described disadvantages are eliminated.

A preferred embodiment of the present invention provides a sheet conveying apparatus including a first conveying unit configured to convey a sheet in a first sheet conveying direction; and a second conveying unit arranged on a downstream side of the first conveying unit in the first sheet conveying direction and configured to convey the sheet conveyed by the first conveying unit in a second sheet conveying direction different from the first sheet conveying direction; wherein among the first conveying unit and the second conveying unit, at least the second conveying unit acts as a holding/conveying unit with a holding section to hold and convey the sheet and comprises a moving/guiding unit arranged along an outer side of a sheet conveying path extending between the first conveying unit and the second conveying unit, the moving/guiding unit being configured to move/guide the sheet toward the holding section of the second conveying unit, and the moving/guiding unit is arranged in a discontinuous manner along a sheet width direction orthogonal to the first sheet conveying direction so as to contact at least one part of the sheet in the sheet width direction.

A preferred embodiment of the present invention provides a sheet conveying apparatus including a first conveying unit configured to convey a sheet in a first sheet conveying direction; and a second conveying unit arranged on a downstream side of the first conveying unit in the first sheet conveying direction and configured to convey the sheet conveyed by the first conveying unit in a second sheet conveying direction different from the first sheet conveying direction; wherein among the first conveying unit and the second conveying unit, at least the second conveying unit acts as a holding/conveying unit with a holding section to hold and convey the sheet, wherein the holding/conveying unit comprises a pair of members facing each other, wherein one of the members is a rotating conveying driving unit configured to transmit a driving force to the other member by rotating, and the other member is a moving/guiding unit arranged along an outer side of a sheet conveying path extending between the first conveying unit and the second conveying unit, the moving/guiding unit being caused to rotate following rotation of the rotating conveying driving unit to move/guide the sheet toward the holding section.

According to one embodiment of the present invention, a compact-sized, space-saving sheet conveying apparatus capable of conveying various sheet types with a simple and low-cost configuration and enabling a user to make a selection as to performance and cost according to the user's requirements, an image scanning apparatus provided with the sheet conveying apparatus, and an image forming apparatus provided with the sheet conveying apparatus are provided.

BRIEF DESCRIPTION OF THE DRAWINGS

Other objects, features and advantages of the present invention will become more apparent from the following detailed description when read in conjunction with the accompanying drawings, in which:

FIG. 6A illustrates an example in which the belt conveying unit is provided in a first conveying unit, FIG. 6B illustrates an example in which the belt conveying units are provided in both the first and second conveying units, and FIG. 6C illustrates an example in which the belt conveying unit is provided separately from the first and second conveying units;

DETAILED DESCRIPTION OF THE PREFERRED EMBODIMENTS

Figure 1:
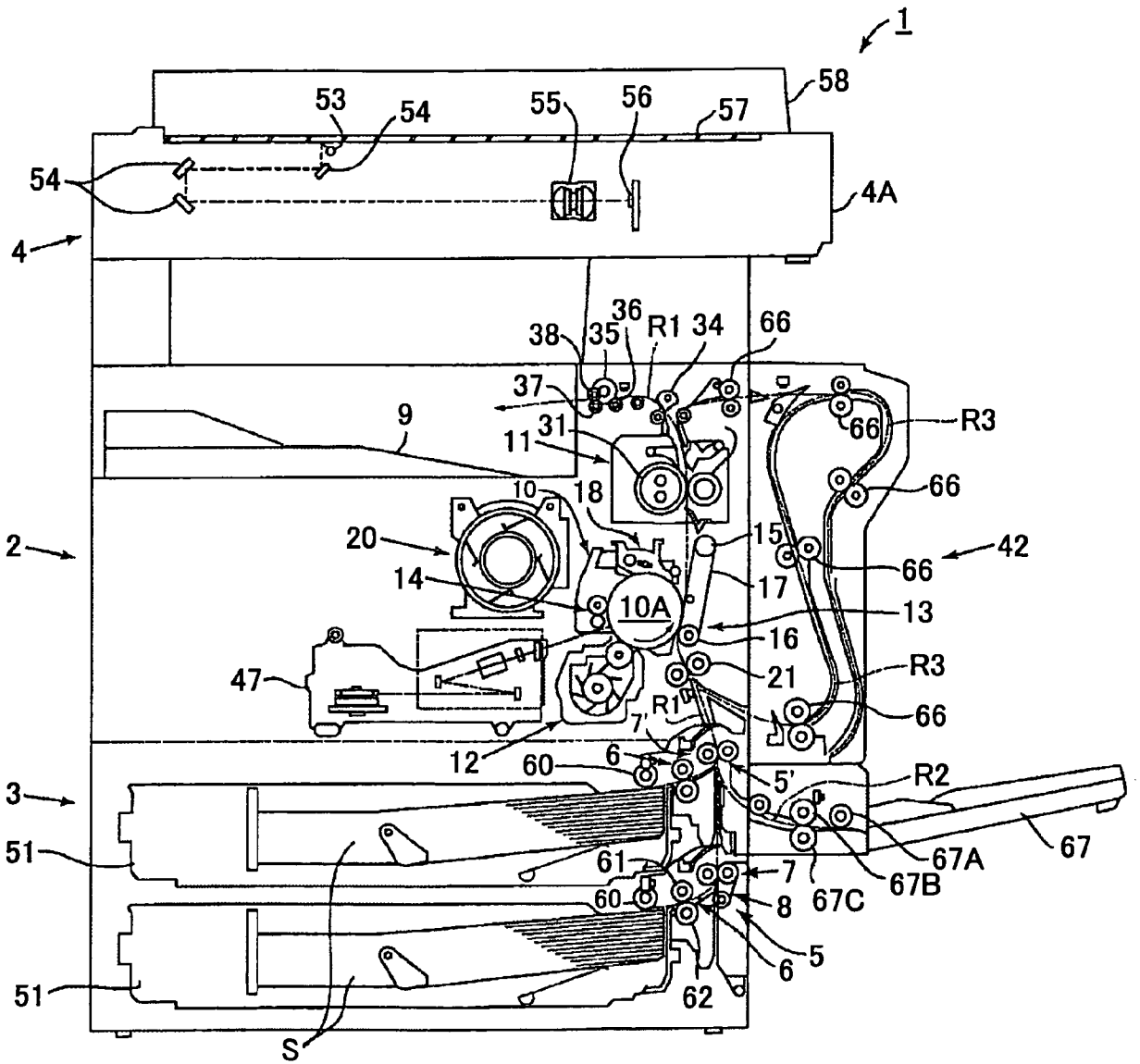
FIG. 1 schematically illustrates an overall configuration of an image forming apparatus provided with a sheet conveying apparatus according to a first embodiment to which the present invention is applied.

Descriptions are given, with reference to the accompanying drawings, of embodiments, modification examples, practical examples, etc., of a sheet conveying apparatus according to example embodiments and an image forming apparatus including the same. Elements having the same functions and shapes are denoted by the same reference numerals throughout the specification and redundant descriptions are omitted. Elements that do not require descriptions may be omitted from the drawings as a matter of convenience. Reference numerals of elements extracted from patent publications are in parentheses so as to be distinguished from those of example embodiments discussed herein.

First Embodiment

Figure 2:
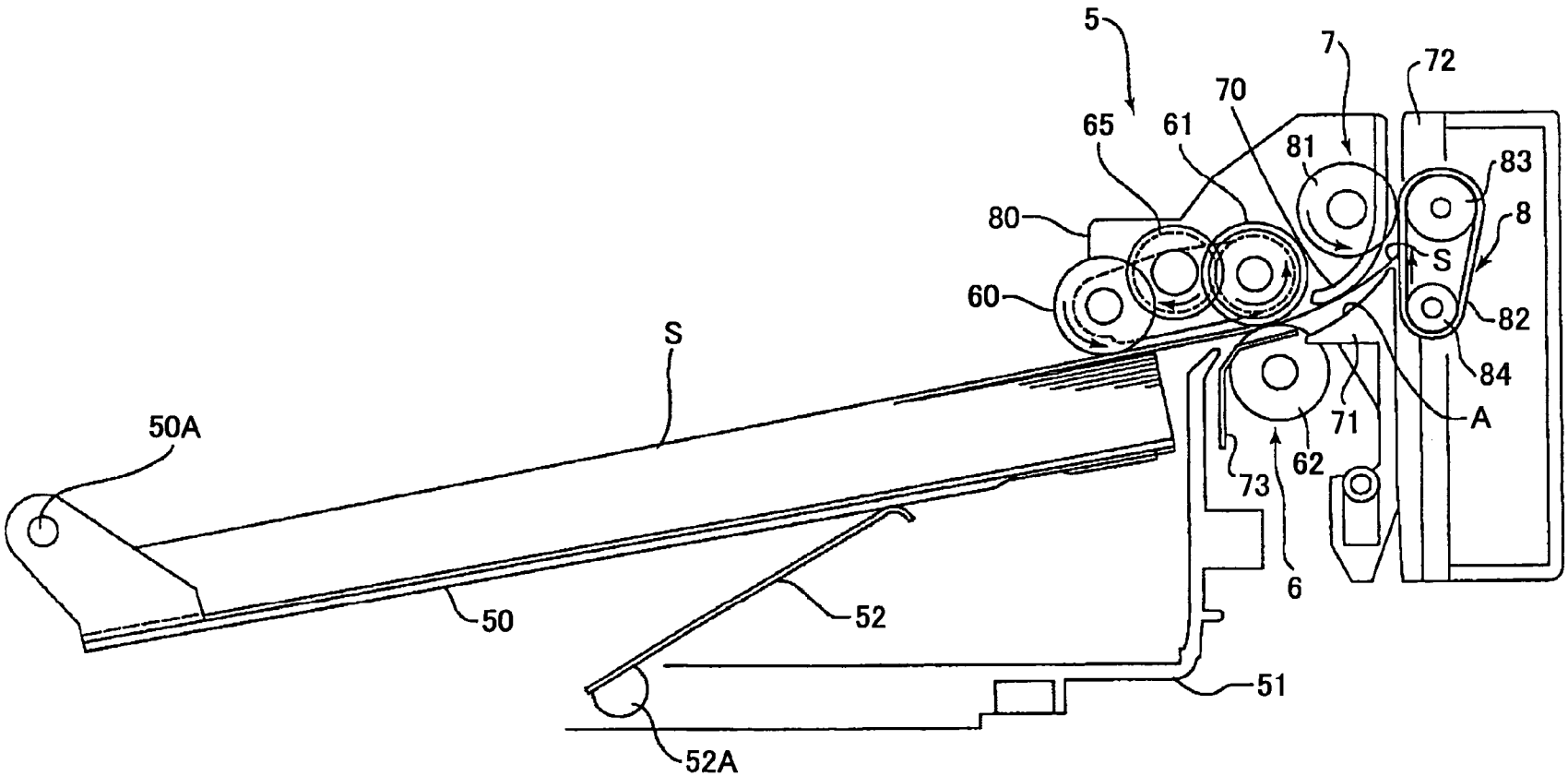
FIG. 2 is a diagram of the sheet conveying apparatus shown in FIG. 1 and a sheet feeding tray stage around the sheet conveying apparatus, more specifically, an enlarged sectional view of relevant parts illustrating an operation status when a leading edge of a sheet has reached a belt conveying unit.
Figure 3:
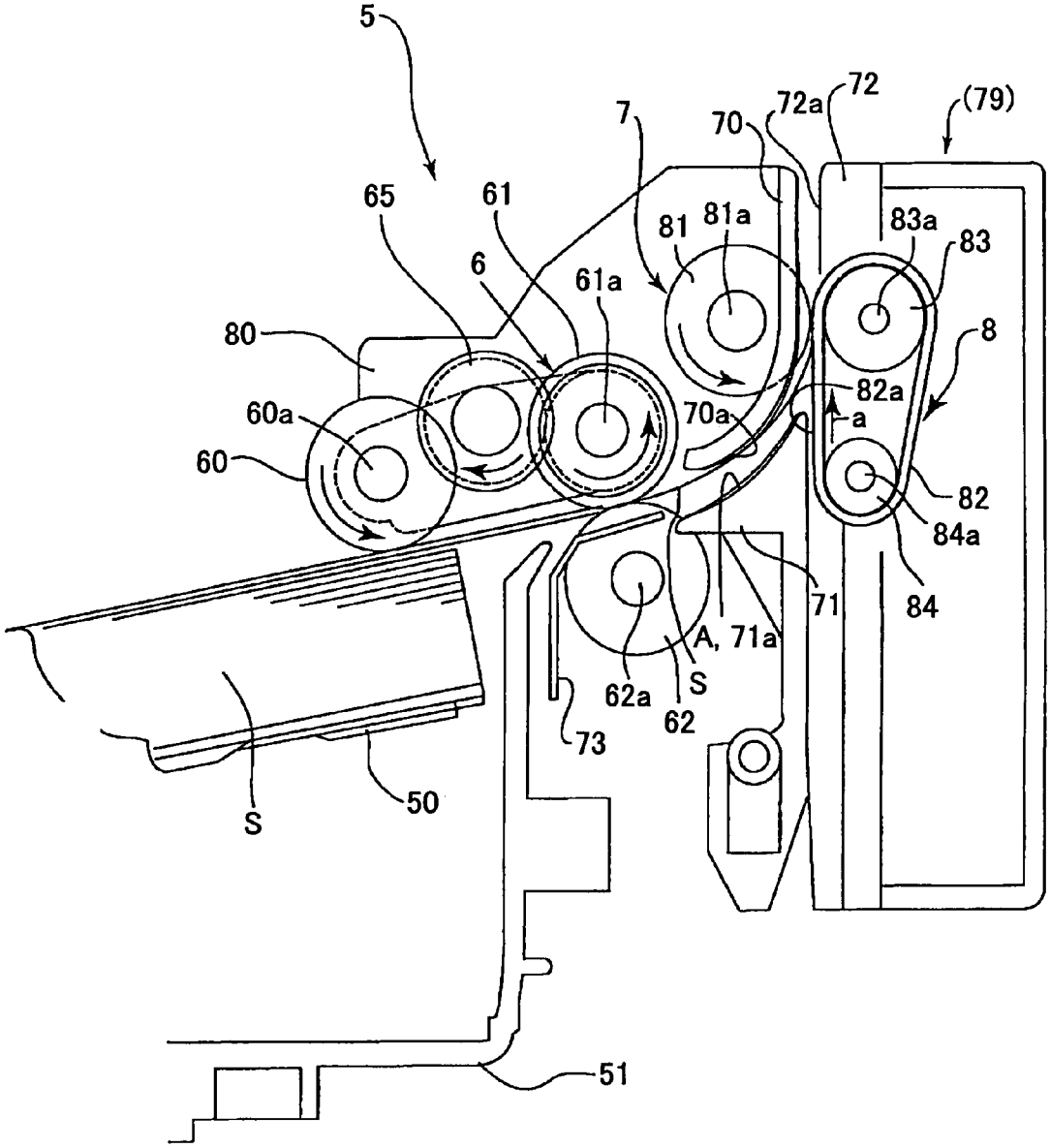
FIG. 3 is an enlarged sectional view of relevant parts of the sheet conveying apparatus shown in FIG. 2 illustrating an operation status immediately before the leading edge of the sheet reaches a nip section of a second conveying unit.

FIGS. 1-3 illustrate a first embodiment of a sheet conveying apparatus to which the present invention is applied and an image forming apparatus including the same. FIG. 1 illustrates an overall configuration of a copier 1 as an example of an image forming apparatus according to an embodiment to which the present invention is applied.

The copier 1 is a monochrome copier that scans an image from a face of an original and forms a copied image onto various sheet-type recording media (hereinafter, "sheet")

such as recording paper, transfer paper, paper sheets, and OHP transparencies. The copier 1 includes an image forming apparatus main unit 2, a sheet feeding device 3 on which the image forming apparatus main unit 2 is mounted, and an original scanning device 4 attached on the image forming apparatus main unit 2. The image forming apparatus main unit 2 includes an image forming section for performing a predetermined image forming process based on a scanned original image. The sheet feeding device 3 supplies one sheet S at a time to the image forming apparatus main unit 2. The original scanning device 4 scans an original image and sends the original image information to the image forming apparatus main unit 2.

A sheet eject tray 9 is provided at the upper portion of the image forming apparatus main unit 2, forming a space beneath the original scanning device 4. Sheets that have passed through the image forming apparatus main unit 2 are ejected to and stacked on the sheet eject tray 9. A sheet conveying path R1 (hereinafter, also referred to as "conveying path R1") extends from the sheet feeding device 3 to the sheet eject tray 9. A large proportion of the conveying path R1 extends between the sheet feeding device 3 and the upper portion of the image forming apparatus main unit 2 in a substantially vertical direction with respect to a substantially horizontal direction. Sheet conveying units including pairs of conveying rollers and pairs of subordinate rollers are provided along the conveying path R1 with predetermined intervals therebetween determined according to the smallest sheet S size. Some of these sheet conveying units are configured to hold (sandwich) the sheet S to ensure that the sheet S continues to be conveyed along the conveying path R1. Furthermore, the sheet feeding device 3 includes a sheet conveying apparatus 5 for feeding/conveying the sheets S stored in paper trays of the sheet feeding device 3.

Inside the image forming apparatus main unit 2, a photoconductor unit 10 and a fixing device 11, acting as the image forming section for forming images, are arranged in this order from the upstream side toward the downstream side of the conveying path R1. As the sheet S is conveyed from the upstream side toward the downstream side of the conveying path R1, the photoconductor unit 10 transfers a toner image that it has generated onto the sheet S and the fixing device 11 fixes the transferred toner image onto the sheet S. The sheet S on which the toner image is fixed is ejected onto the eject tray 9 arranged at the end of the conveying path R1.

The photoconductor unit 10 includes a single drum-type photoconductor 10A acting as an image carrier. The photoconductor 10A is supported by a not shown side panel inside the image forming apparatus main unit 2 so as to rotate around a substantially horizontal axis. The photoconductor 10A has a cylindrical shape of a predetermined diameter and a generally known configuration. The photoconductor 10A receives a rotational driving force from a driving source such as a motor provided on one end of the photoconductor 10A, either on the photoconductor unit 10 side or on the image forming apparatus main unit 2. Accordingly, the photoconductor 10A rotates in a direction indicated by an arrow shown in FIG. 1 at a steady, constant speed.

Around the photoconductor 10A, elements are arranged in the following order in the direction indicated by the arrow: a developing device 12, a transfer device 13, a photoconductor cleaning device 18, a discharge device, and a charging device 14. Within a range corresponding to one rotation of the photoconductor 10A in the anticlockwise direction, there are a developing position, a transferring position, a cleaning position, a discharging position, and a charging position from upstream to downstream positions for each of the above-described devices 12-14.

Between the charging position and the developing position, there is a latent image forming position. An exposing device 47 is provided at a position somewhat spaced apart from and diagonally downward from the photoconductor 10A. At the latent image forming position, the exposing device 47 irradiates a predetermined laser beam onto the photoconductor 10A to form an invisible latent image thereon according to image information. In synchronization with the rotation of the photoconductor 10A in the anticlockwise direction, the above-described devices 12-14 and the exposing device 47 perform interlinked operations so as to execute a sequence of an image forming process in cooperation with each other.

The developing device 12 has an appropriate, generally known configuration including a developing roller for generating a toner brush by causing toner particles to stand erect on the surface of the developing device 12 in a radial direction. The developing device 12 causes the toner particles at the tips of the toner brush to adhere onto the latent image formed on a predetermined position on the surface of the photoconductor 10A, as the latent image moves in a circumferential direction of the photoconductor 10A and passes through the developing position in accordance with the rotation of the photoconductor 10A. Accordingly, the invisible latent image is turned into a visible, monochrome toner image.

The transfer device 13 includes two support rollers 15, 16 spaced apart from each other in a substantially vertical direction and a transfer belt 17, which is an endless belt stretched around the support rollers 15, 16. The transfer device 13 transfers the toner image from the circumferential surface of the photoconductor 10A onto the sheet S, and conveys the sheet S onto which an unfixed toner image is transferred to the downstream side of the conveying path R1. Specifically, a portion of the lower support roller 16 where the transfer belt 17 is stretched around is pressed against a substantially diagonally downward right portion of the photoconductor 10A, and the transferring position corresponds to where the surface of the photoconductor 10A and the transfer belt 17 contact each other. The upper support roller 15 is arranged in front of the inlet of the fixing device 11.

The photoconductor cleaning device 18 includes either one or both of a not shown blade member and a rotating brush. The blade member has a blade edge at the tip thereof that abuts against the cleaning position on the photoconductor 10A while maintaining a predetermined pressure level. The rotating brush contacts the cleaning position and is caused to rotate following the rotation of the photoconductor 10A. The photoconductor cleaning device 18 removes toner or foreign matter remaining on the surface of the photoconductor 10A after the transfer operation.

The discharge device is primarily configured with a lamp that can emit a light beam of a predetermined light intensity. This lamp irradiates a light beam used for the discharging onto the discharging position to neutralize the charged surface of the photoconductor 10A passing by the discharging position. Accordingly, the discharge device initializes the surface potential of the photoconductor 10A that had passed by the transferring position.

The fixing device 11 includes a heating roller 31 with a built-in electrothermal heater acting as a heat source and a pressuring roller 32 facing and pressed against the heating roller 31 in a substantially horizontal direction. When the heating roller 31 is rotated by a not shown driving source such as a motor, the pressuring roller 32 in contact with the heating roller 31 is caused to rotate following the rotation of the heating roller 31. At the same time, the portion where the heating roller 31 and the pressuring roller 32 contact each other is made to have a predetermined heating temperature and predetermined pressure so as to function as a nip section for fixing the toner image onto the sheet.

In FIG. 1, 20 denotes a toner storing container, which is a toner bottle storing unused/new toner. A not shown toner conveying path extends from the toner storing container 20 to the developing device 12. When the developing device 12 has consumed the toner provided therein and there is a toner shortage, the new replenishment toner is supplied from the toner storing container 20 into the developing device 12.

The sheet feeding device 3 is provided beneath the image forming apparatus main unit 2, so that the sheet size can be chosen automatically or according to a user's manual input. The sheet feeding device 3 includes plural sheet feeding trays 51 acting as sheet storing units arranged therein in multiple stages. Each of the sheet feeding trays 51 can be individually pulled outside of the sheet feeding device 3 so as to be replenished with an appropriate number of sheets corresponding to that individual sheet feeding tray 51. Different types of sheets S that are of various sheet sizes and oriented in vertical/horizontal directions with respect to the sheet conveying direction are stacked/stored in the sheet feeding trays 51.

The original scanning device 4 includes a scanning device main unit 4A acting as a framework of the original scanning device 4. On top of the scanning device main unit 4A, an exposure glass 57 is arranged across a predetermined range. A scanning unit is housed inside the scanning device main unit 4A for optically scanning an original image by scanning the predetermined range of the exposure glass 57. The scanning unit primarily includes at least a first traveling body 53, a second traveling body 54, an imaging lens 55, and a scanning sensor 56 such as a CCD.

The original scanning device 4 includes a platen cover 58 configured to open and close between a closed position covering the exposure glass 57 and an open position. The platen cover 58 is arranged on the top surface of the scanning device main unit 4A. The platen cover 58 has larger length/width sizes than those of the exposure glass 57, and one side thereof is fixed to the top surface of the scanning device main unit 4A so as to freely open/close.

On the basis of the above configuration, operations of the copier 1 are described below. First, in order to make a copy of an original with the copier 1, the user manually opens the platen cover 58 of the original scanning device 4 from the closed position to the open position, places/sets the original on the exposure glass 57, and then manually brings the platen cover 58 to the closed position, so that the platen cover 58 presses the original set on the exposure glass from above. Accordingly, the original spreads out in a planar manner in close contact with the exposure glass 57 so that the original face can be scanned accurately, and the original is fixed on the exposure glass 57.

As the user presses a start key of a not shown operation panel section initially provided in the copier 1, a scanning operation of the original scanning device 4 immediately starts, and a not shown driving mechanism causes the first traveling body 53 and the second traveling body 54 to travel. A light beam from a light source of the first traveling body 53 is irradiated toward the original; the light beam is reflected from the original face and is directed toward the second traveling body 54; the light beam is then reflected by a mirror of the second traveling body 54; and the light beam enters the scanning sensor 56 via the imaging lens 55. As a result, the image of the original is photoelectrically converted and scanned by the scanning sensor 56.

When the start key is pressed, the photoconductor 10A of the photoconductor unit 10 starts rotating and an operation starts for forming a toner image on the photoconductor 10A based on the scanned original image. Specifically, as the photoconductor 10A rotates, a predetermined position on the circumferential surface of the photoconductor 10A sequentially passes by the respective positions between the charging device 14, the exposing device 47, the developing device 12, the transfer device 13, the photoconductor cleaning device 18, and the discharge device. Accordingly, the predetermined position on the photoconductor 10A is charged to a predetermined charged status, a latent image is generated thereon, the latent image is turned into a visible toner image, the toner image is transferred onto the sheet S, residual toner is removed from the photoconductor 10A, and the charged status is cancelled, thus completing one cycle of operations in the above order. This cycle is continued until the toner image is created in an area of a predetermined size on the circumferential surface of the photoconductor 10A in the rotational direction, according to the size of the image to be formed.

When the start key is pressed, one sheet S is extracted from the sheet feeding tray 51 in the sheet feeding device 3 corresponding to the sheet feeding stage storing the type of sheet S selected automatically or manually, and the extracted sheet S is conveyed to the conveying path R1 via a predetermined sheet conveying path by the sheet conveying apparatus 5 attached to the corresponding sheet feeding stage. This sheet S is conveyed in a substantially vertically upward direction through the sheet conveying path R1 in the image forming apparatus main unit 2 by conveying rollers, and is temporarily stopped when the leading edge of the sheet S abuts against a pair of resist rollers 21.

In a case where manual sheet feeding is performed, the sheet S is set on a bypass tray 67, and is rolled out by the rotation of a sheet feeding roller 67A provided for the bypass tray 67. When plural sheets S are stacked/set on the bypass tray 67, separating rollers 67B, 67C separate the sheets S one by one. The sheet is conveyed to a bypass sheet feeding path R2, conveyed from the bypass sheet feeding path R2 to the conveying path R1, and is temporarily stopped when the leading edge of the sheet S abuts against the pair of resist rollers 21.

The pair of resist rollers 21 starts rotating at an accurate timing in synchronization with the relative movement of the toner image on the rotating photoconductor 10A so as to send the sheet S, that has been temporarily stopped, into the transferring position. As a result, the toner image is transferred onto the sheet S by the transfer device 13.

The sheet S, onto which an unfixed monochrome toner image is transferred, is then conveyed to the fixing device 11 by the transfer belt 17 of the transfer device 13 acting as part of the conveying path R1. The sheet S passes through the nip section of the fixing device 11. The nip section applies predetermined heat and pressure onto the sheet S so that the image is fixed on the sheet S. The sheet S with the fixed image is guided by a switching claw 34 to the conveying path R1 extending to the sheet eject tray 9, ejected onto the sheet eject tray 9 by eject rollers 35-38, and is stacked on the sheet eject tray 9. The user can retrieve the sheet S stacked on the sheet eject tray 9 through an opening, which is between the sheet eject tray 9 and the original scanning device 4 facing the front of the apparatus.

When a double-sided copy mode is selected by user input, the sheet S with an image fixed on one side thereof is guided by the switching claw 34 to be conveyed toward a sheet reversing device 42. Plural rollers 66 and not shown guiding members arranged inside the sheet reversing device 42 convey the sheet S back and forth along a reverse conveying path R3 to reverse the sides of the sheet S. Then, the sheet S is conveyed from a position in front of the photoconductor unit 10 back to the sheet conveying path R1 through the pair of resist rollers 21. The sheet S is conveyed upward along the conveying path R1 and guided to the transferring position once again, where an image is transferred and fixed this time onto the backside of the sheet S. Finally, the sheet S is ejected onto the sheet eject tray 9 by the eject rollers 35-38.

A description is given of features of the sheet conveying apparatus 5 according to the first embodiment to which the present invention is applied.

As shown in FIGS. 2 and 3, the sheet conveying apparatus 5 extracts one sheet S from the stack of sheets S stacked/stored in the sheet feeding tray 51 of a predetermined stage (in this example, the lower stage) in the sheet feeding device 3 shown in FIG. 1, changes the sheet conveying direction of the extracted sheet S, and conveys the sheet S substantially vertically upward to the image forming apparatus main unit 2.

The sheet conveying apparatus 5 primarily includes a first conveying unit 6 for conveying the sheet S, a second conveying unit 7 arranged on a downstream side of the first conveying unit 6 in the sheet conveying direction for conveying the sheet S received from the first conveying unit 6 in a sheet conveying direction different from that of the first conveying unit 6, and a first conveying path A formed between the first conveying unit 6 and the second conveying unit 7.

In the sheet conveying apparatus 5, both the first conveying unit 6 and the second conveying unit 7 act as a holding/conveying unit to hold and convey the sheet S with a pair of rotating conveying members. Specifically, the first conveying unit 6 includes two rotating conveying members arranged facing each other, namely a feed roller 61 and a reverse roller 62, and acts as a first pair of rotating conveying members. The second conveying unit 7 includes two rotating conveying members arranged facing each other, namely a grip roller 81 and a conveyor belt 82 stretched around a roller-type pulley 83 and a roller-type pulley 84, and acts as a second pair of rotating conveying members. One member of the second pair of rotating conveying members is a belt conveying unit 8 (moving/guiding unit) provided with the conveyor belt 82 to move/guide (convey) the sheet S toward a holding section (nip section) of the second conveying unit 7 while keeping the leading edge of the sheet S in contact with the conveyor belt 82. A conveying surface 82*a*, which is a belt traveling surface on the conveyor belt 82 of the belt conveying unit 8, is arranged along an outer side of the first conveying path A.

As described above, the sheet conveying direction of the first pair of rotating conveying members including the feed roller 61 and the reverse roller 62 is different from the sheet conveying direction of the second pair of rotating conveying members including the grip roller 81 and the conveyor belt 82. Specifically, the sheet conveying direction of the first pair of rotating conveying members is substantially horizontal and directed to a diagonally upward right position, whereas the sheet conveying direction of the second pair of rotating conveying members is directed in a substantially vertically upward direction, as viewed in FIGS. 2, 3. Accordingly, the first conveying path A formed between the first conveying unit 6 and the second conveying unit 7 includes a curved section (curvature section) with a small radius, which causes the sheet conveying direction to change abruptly in the first conveying path A.

Figure 4:
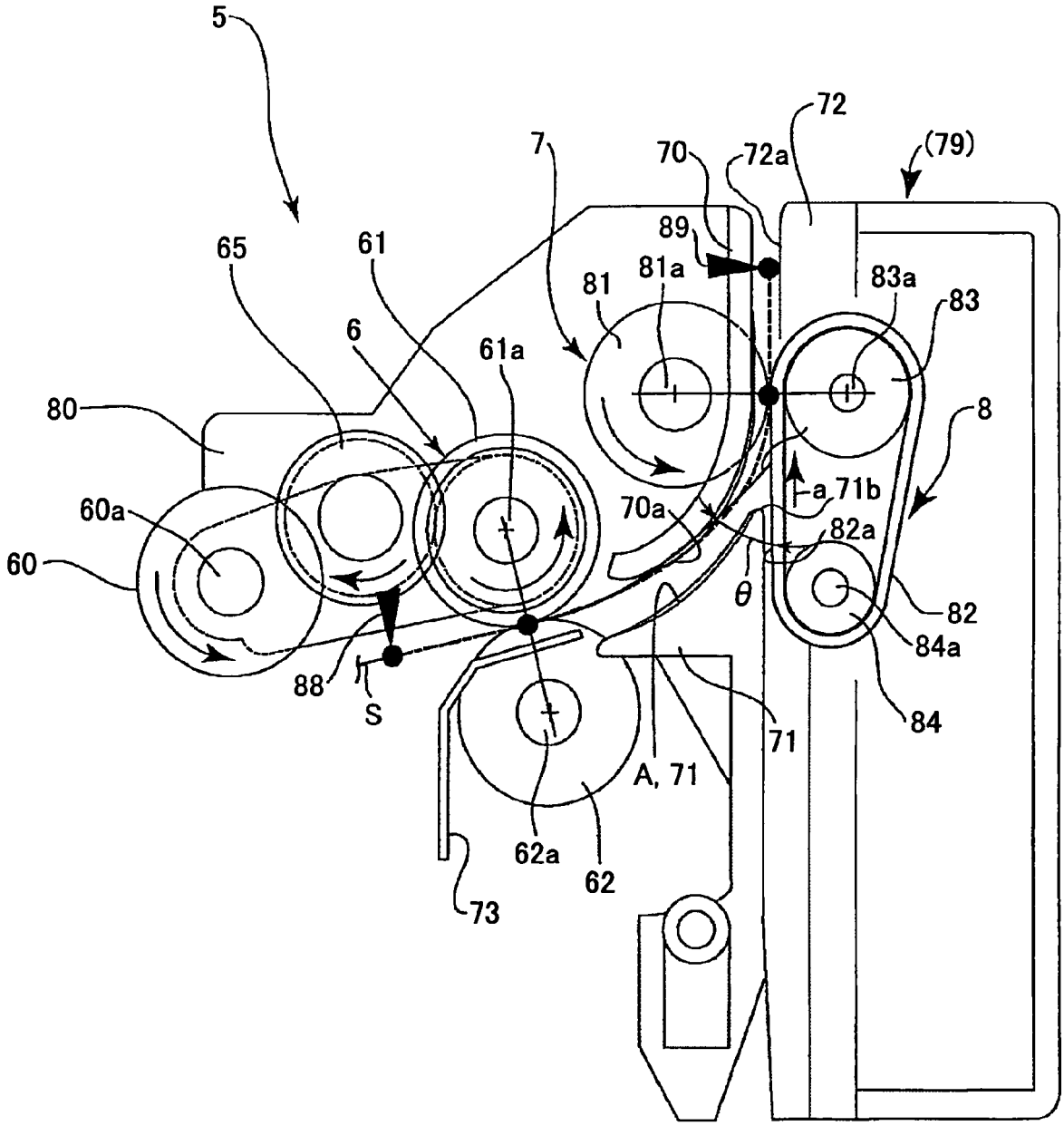
FIG. 4 is an enlarged sectional view of relevant parts of the sheet conveying apparatus for describing a first practical example.

A more specific description is given of the sheet conveying directions of the first and second conveying units 6, 7. As shown in FIG. 4, the sheet conveying direction orthogonally intersecting the center of the nip section of the first conveying unit 6 is substantially horizontal with respect to a line connecting three points, namely the rotational center of the feed roller 61, the rotational center of the reverse roller 62, and the holding section (also referred to as "nip section") of the feed roller 61 and the reverse roller 62.

Similarly, the sheet conveying direction orthogonally intersecting the center of the nip section of the second conveying unit 7 is substantially vertical with respect to a line connecting three points, namely the rotational center of the grip roller 81, the rotational center of the roller-type pulley 83, and the holding section (also referred to as "nip section") of the grip roller 81 and the conveyor belt 82.

That is, in the sheet conveying path formed between the first conveying unit 6 and the second conveying unit 7, the sheet conveying direction changes. The sheet conveying path includes two opposite surfaces that define the orientation of the conveyed sheet S in the thickness direction of the sheet S. When the sheet S is sent out from the first conveying unit 6, the leading edge of the sheet S abuts against a conveying guiding surface, which is one of the two above-mentioned surfaces. The conveying guiding surface moves continuously and constantly within a predetermined range, starting at least from the position where the sheet S abuts against the conveying guiding surface, along the lengthwise direction of the sheet conveying direction, toward the holding section of the second conveying unit 7. This conveying guiding surface corresponds to the belt traveling surface (the conveying surface 82*a*) on the conveyor belt 82 of the belt conveying unit 8. The area surrounded by an extended line along the sheet conveying direction of the first conveying unit 6 and an extended line along the sheet conveying direction of the second conveying unit 7 is referred to as an inner area, and the rest of the areas are referred as an outer area (an inner side and an outer side refer to sides closer toward the inner area and a side closer toward the outer area, respectively). The conveying surface 82*a* of the conveyor belt 82, which is the planar belt traveling surface used for conveying a sheet, is arranged along the outer edge of the inner area, and substantially intersects the sheet traveling direction.

As shown in FIGS. 3, 4, the belt conveying unit 8 primarily includes the conveyor belt 82, and the roller-type pulley 83 and the roller-type pulley 84 configuring a pair of belt holding rotating members for rotatably holding the conveyor belt 82.

It is imperative that the belt conveying unit 8 be arranged in such a manner that the leading edge of the sheet S conveyed from the first conveying unit 6 abuts (contacts) the conveying surface 82*a* of the conveyor belt 82, at portions of the conveying surface 82*a* other than portions where the conveyor belt 82 is held by the roller-type pulley 83 and the roller-type pulley 84. As shown in FIG. 4, the belt conveying unit 8 is arranged in such a manner that the axial center of the roller-type pulley 84 (center of a pulley shaft 84*a*) is arranged above the bottom edge of the reverse roller 62 and beneath the height of the downstream end of a guide surface 71*a* of a conveying guiding member 71. Accordingly, the leading edge of the sheet S collides with the abdominal portion (i.e., an "effective conveying portion") of the conveyor belt 82, where the conveyor belt 82 constantly and appropriately becomes elastically displaced/deformed (when colliding with the sheet S), so that the leading edge of the sheet S does not bounce back. Hence, it is ensured that the leading edge of the sheet S is kept in abutment with the conveying surface 82*a* (also referred to as "belt conveying surface 82*a*") of the conveyor belt 82, so that the effects described below can be achieved.

If the belt conveying unit 8 is arranged in such a manner that the leading edge of the sheet S may abut (contact) the conveyor belt 82 at the portions where the conveyor belt 82 is held by (in contact with) the roller-type pulley 83 and the roller-type pulley 84, the following problem arises. That is, the portions where the conveyor belt 82 is held by the roller-type pulley 83 and the roller-type pulley 84 are generally harder than the abdominal portion of the conveyor belt 82, and thus do not become elastically displaced/deformed as much as the abdominal portion. Hence, this arrangement is disadvantageous as the sheet S would bounce back from the conveyor belt 82 because the conveyor belt 82 would not constantly and appropriately become elastically displaced/deformed when the leading edge of the sheet S abuts against the portions where the conveyor belt 82 is held by the roller-type pulley 83 and the roller-type pulley 84. The same applies to other embodiments, modification examples, and practical examples according to the present invention described below (hereinafter, also referred to as "the same applies to other examples").

Furthermore, as shown in FIG. 4, it is imperative that the belt conveying unit 8 be arranged in such a manner that the leading edge of the sheet S conveyed from the first conveying unit 6 approaches the conveying surface 82*a* at an acute collision angle θ. By arranging the belt conveying unit 8 in such a manner, the leading edge of the sheet S constantly abuts the abdominal portion of the conveyor belt 82. Accordingly, it is ensured that the leading edge of the sheet S is kept in abutment with the conveying surface 82*a*, so that the effects described below can be achieved.

If the belt conveying unit 8 is arranged in such a manner that the leading edge of the sheet S approaches the conveying surface 82*a* at a substantially perpendicular or an orthogonal collision angle θ, the leading edge of the sheet S may abut the conveying surface 82*a* in an irregular manner. For example, the sheet S may bend in the opposite direction to which the conveyor belt 82 is moving or bounce back from the conveyor belt 82. Hence, this arrangement is disadvantageous (the same applies to other examples).

Each of the sheet feeding trays 51 in the stages of the sheet feeding device 3 has a planar shape large enough to store the maximum size of the sheet S used in the copier 1. Each of the sheet feeding trays 51 is a substantially flat box with an upper opening and a bottom plate 50 provided at the bottom acting as a sheet stacking unit. The rear end of the bottom plate 50, on the left side as viewed in FIG. 2, is fixed to a horizontal shaft 50A supported by the sheet feeding tray 51 so that the bottom plate 50 can freely rotate within a predetermined angle range, i.e., so as to pivot back and forth (oscillate). The free end of the bottom plate 50 on the right side as viewed in FIG. 2 can pivot back and forth about the shaft 50A inside the sheet feeding tray 51.

At the bottom of the sheet feeding tray 51, there is a hollow section of a predetermined shape. A rising arm 52 is provided in the hollow section. The rear end of the rising arm 52 is fixed to a horizontal shaft 52A so that the rising arm 52 can freely rotate within a predetermined angle range, i.e., so as to pivot back and forth, in the hollow section. The horizontal shaft 52A receives a driving force from a not shown rotational driving source, causing the horizontal shaft 52A to rotate in arbitrary directions. As the horizontal shaft 52A rotates, the rising arm 52 is caused to pivot about the horizontal shaft 52A to come to a predetermined tilted position. Accordingly, the free end of the rising arm 52 pushes up the bottom plate 50 so that one edge of the topmost face of the sheets S stacked on the bottom plate 50 is maintained at a predetermined height.

As described above, in the sheet feeding tray 51, the sheets S are stacked on the bottom plate 50 and stored therein. Furthermore, the free end of the bottom plate 50 on the right side as viewed in FIG. 2 rises so that the bottom plate 50 tilts and the sheets S stacked thereon are pushed up. Therefore, even if the sheets S are fed out one by one and the number of stacked sheets decreases, the topmost surface of the sheets S can be maintained at a predetermined height.

As described above, the sheet feeding tray 51 can be freely attached to/detached from and inserted in/removed from the main unit of the sheet feeding device 3. Specifically, the sheet feeding tray 51 can be set at an inserted position in the main unit of the sheet feeding device 3 as shown in FIG. 1 so that sheet feeding can be performed. The sheet feeding tray 51 can be pulled out and detached from the main unit of the sheet feeding device 3 toward the front as viewed in FIG. 1 to a detached position, so that sheets S can be supplied or sheets S can be replaced with sheets S of a different size.

At least the first conveying unit 6, the second conveying unit 7, and the sheet conveying path arranged between the first conveying unit 6 and the second conveying unit 7 remain in the main unit even when the sheet feeding tray 51 is pulled out. Although the image forming apparatus of this example is an in-body paper eject type (i.e., the sheet eject tray 9 is located within the main unit of the image forming apparatus), by providing the moving/guiding unit (belt conveying unit 8), the curvature of the conveying path can be kept equal to or less than that of the conventional technology. Hence, the width of the image forming apparatus does not need to be increased, so that the advantage of the in-body paper eject type is not diminished.

A pickup roller 60 is axially rotatably supported by a housing 80 that configures the outer shape of a structure provided on the main unit of the sheet feeding device 3, in such a manner that the pickup roller 60 contacts the topmost face of the sheets S raised to the predetermined height. On an extended line along the direction in which the pickup roller 60 extracts the sheet S, a sheet feed separating mechanism is provided for separating one sheet S from the stack of sheets S and feeding out the separated sheet S. In the sheet feed separating mechanism, the feed roller 61 and the reverse roller 62 contact each other by a predetermined pressure level to form a nip section therebetween.

As illustrated in detailed in FIG. 3, the pickup roller 60 can be a generally known roller that is integrally fixed around a shaft 60*a* that is integrally formed with a not shown cored bar, and is supported together with the shaft 60*a* so as to freely rotate. Alternatively, a one-way clutch (not shown) can be provided between the shaft 60*a* and the cored bar, and the pickup roller 60 can be supported so as to freely rotate with respect to the shaft 60*a* when it is not driven. The circumferential section of the pickup roller 60 (including its circumferential surface) is made of a soft, highly frictional material such as rubber, which has a high frictional coefficient with respect to the sheet S, so as to easily pick up the sheet S by contacting the sheet S. Furthermore, in order to increase the frictional resistance, substantially sawtooth-shaped projections can be formed over the entire circumferential surface of the pickup roller 60.

There are various sheet feeding methods for separating a sheet from a stack of sheets S to prevent multifeeding of sheets (i.e., prevent plural sheets from being sent out at once). In this example, the FRR sheet feeding method is employed, which is a return separate method. Specifically, when two or more sheets S are picked up by the pickup roller 60, one sheet in contact with the feed roller 61 is separated from the other sheet in contact with the reverse roller 62. The feed roller 61 continues to send the sheet in contact therewith in the sheet conveying direction while the reverse roller 62 returns the other sheet in the opposite direction to the sheet conveying direction, back to the original position on the stack of sheets. Furthermore, the reverse roller 62 is configured not to obstruct the sheet conveying operation performed by the feed roller 61.

More specifically, the sheet feed separating mechanism employing the FRR sheet feeding method as a sheet separating mechanism includes the feed roller 61 that is rotated in the forward direction of the sheet conveying direction and the reverse roller 62 that is rotated in the reverse direction by receiving a rotational driving force in the reverse direction via a torque limiter. The feed roller 61 contacts the top face of the topmost sheet S fed out from the bottom plate 50, while the reverse roller 62 contacts the bottom face of at least one sheet S under the feed roller 61.

The feed roller 61 can be a roller that is integrally fixed around a shaft 61*a* that is integrally formed with a not shown cored bar, and is supported together with the shaft 61*a* so as to freely rotate. Alternatively, the feed roller 61 can be supported in a similar manner to the pickup roller 60.

Similarly to the pickup roller 60, the circumferential section of the feed roller 61 (including its circumferential surface) is made of a soft, highly frictional material such as rubber, which has a high frictional coefficient with respect to the sheet S, so as to easily convey the sheet S in the sheet conveying direction by contacting the sheet S. Furthermore, in order to increase the frictional resistance, substantially sawtooth-shaped projections can be formed over the entire circumferential surface of the feed roller 61.

The reverse roller 62 is integrally formed with a not shown cored bar, and is supported together with a reverse roller driving shaft 62*a* by the housing 80 so as to freely rotate by receiving a rotational driving force via the torque limiter.

In the FRR separating method, the reverse roller 62 receives a low level of torque in a direction opposite to that of the rotational direction of the feed roller 61 via the torque limiter (not shown). Therefore, when the reverse roller 62 is in contact with the feed roller 61, or when one sheet S enters in between the feed roller 61 and the reverse roller 62, the reverse roller 62 is caused to rotate following the rotation of the feed roller 61. That is, the function of the torque limiter causes the reverse roller 62 to slip on the reverse roller driving shaft 62*a*, so that the reverse roller 62 rotates in a forward direction in the sheet feeding direction, similarly to the feed roller 61. Conversely, when the reverse roller 62 is separated from the feed roller 61 or when two or more sheets S enter in between the feed roller 61 and the reverse roller 62, the reverse roller 62 rotates in the opposite direction. Therefore, when more than one sheet S enters in between the feed roller 61 and the reverse roller 62, the reverse roller 62 returns the sheets S other than the topmost sheet S in contact with the feed roller 61, i.e., the sheets S in contact with the reverse roller 62, toward the upstream side of the sheet conveying direction. Accordingly, it is possible to prevent multifeeding of sheets S (feeding more than one sheets S at once).

Therefore, the conveying force applied from the reverse roller 62 to the sheet S in contact therewith is large enough in the reverse direction for returning the sheet S to its original position on the stack of sheets S. However, this conveying force is sufficiently smaller than the conveying force applied from the feed roller 61 to the sheet S for conveying the sheet S in the forward direction, so as not to obstruct the feed roller 61 from conveying the sheet S in the forward direction. Due to this configuration, the conveying force applied from the feed roller 61 to the sheet S is reduced by the opposite conveying force applied from the reverse roller 62 to the sheet S.

In FIG. 3, 65 denotes an idler gear joined to a driving shaft that outputs a rotational driving force from a driving source provided in the main unit of the sheet feeding device 3. The idler gear 65 distributes and transmits a rotational driving force supplied from the sheet feeding device 3 through the engagement of gears or through a belt to the pickup roller 60 and the feed roller 61 to rotate them at predetermined speeds.

At a diagonally upper position of the feed roller 61, a grip roller 81 is provided as the other rotating conveying member of the second pair of rotating conveying members configuring the second conveying unit 7. The grip roller 81 is rotatably supported by the housing 80 via a rotational driving shaft 81*a* integrally formed with the grip roller 81. Similarly to the feed roller 61, the circumferential section of the grip roller 81 (including its circumferential surface) is made of a soft, highly frictional material such as rubber, which has a high frictional coefficient with respect to the sheet S, so as to easily convey the sheet S in the sheet conveying direction by contacting the sheet S.

The pulley 83 is provided near the grip roller 81. The pulley 83 is axially rotatably supported by the housing 80 so as to contact the circumferential surface of the grip roller 81 via the conveyor belt 82, facing the grip roller 81 in a horizontal direction.

The pulley 83 is integrally formed with a pulley shaft 83*a*, and is rotatably supported together with the pulley shaft 83*a* by the housing 80. The pulley 84 is arranged at a diagonally downward left position of the pulley 83, and is axially rotatably supported by the housing 80. The pulley 84 is integrally formed with a pulley shaft 84*a*, and is rotatably supported together with the pulley shaft 84*a* by the housing 80. The pulleys 83, 84 function as the belt holding rotating members for rotatably holding the conveyor belt 82. Each of the pulley shafts 83*a*, 84*a* is a single, continuous shaft, and is made a metal material such as steel.

The arrangement of the belt conveying unit 8 is not limited to the aforementioned descriptions; the belt conveying unit 8 can be arranged as follows. In FIG. 3, etc., (79) in parenthesis denotes an opening/closing guide that opens and closes with respect to the housing 80, which opening/closing guide is part of the main unit of the sheet conveying apparatus 5. The opening/closing guide (79) is configured to open and close by pivoting about a fulcrum shaft hinge (not shown) below the housing 80 so that the conveyor belt 82 can be separated from the grip roller 81, making it easier for a user to resolve a paper jam in the first conveying path A or the vertical conveying path extending substantially upward.

When the sheet conveying apparatus 5 is provided with the opening/closing guide (79), the pulley 83, the pulley 84, and their respective pulley shafts 83*a*, 84*a*, are rotatably supported by the opening/closing guide (79).

The conveyor belt 82 is an endless belt stretched around the pulley 83 and the pulley 84, as described above. The axes of the pulley 83 and the pulley 84 are spaced apart by a predetermined distance. The linear belt traveling surface (conveying surface 82*a*) of the conveyor belt 82 between the pulley 83 and the pulley 84 is arranged at a position to ensure that it is contacted by the leading edge of the sheet S sent out from the first conveying unit 6. As described above, the circumferential surface of the conveyor belt 82 stretched around the circumferential surface of the pulley 83 directly contacts the circumferential surface of the grip roller 81 at a predetermined pressure level. The portion where the conveyor belt 82 contacts the grip roller 81 corresponds to the holding section (nip section). More specifically, a not shown forcing unit (e.g., springs 92 shown in FIG. 20 described below) is attached to a not shown bearing member or supporting member (e.g., belt supporting members 86 shown in FIG. 20 described below) for supporting the pulley shaft 83*a*. This forcing unit presses the conveyor belt 82 against the grip roller 81.

The conveyor belt 82 is made of an elastic material such as rubber. The frictional coefficient of the surface of the conveyor belt 82 is specified at a predetermined value with respect the conveyed sheet S. The frictional coefficient is defined by characteristics of the material of the belt itself or by treating the surface with an appropriate process. Specifically, the frictional coefficient is specified to ensure that the surface of the conveyor belt 82 acting as the conveying surface 82*a* transmits a conveying/propelling force to the face of the sheet S in contact with the conveyor belt 82, without allowing the sheet face to slip along the belt surface.

The belt width of the conveyor belt 82 in a sheet width direction orthogonal to the sheet conveying direction is at least substantially equal to the width of a maximum-size sheet to be conveyed. That is, the belt width of the conveyor belt 82 is substantially equal to or wider than the width of a maximum-size sheet to be conveyed. The sizes in the sheet width direction (axial lengthwise direction) of the pulleys 83, 84 around which the conveyor belt 82 is stretched and the grip roller 81 facing/contacting the conveyor belt 82 are equal to or larger than the aforementioned belt width of the conveyor belt 82. Hence, it is ensured that the entire width of the sheet S sent out from the first conveying unit 6 contacts the conveyor belt 82, so that the contact area therebetween can be maximized. Accordingly, it is possible to maximize the conveying/propelling force for conveying the sheet S in the conveying direction, which force is constantly transmitted to the sheet S from the conveyor belt 82 moving in the sheet conveying direction.

Figure 23:
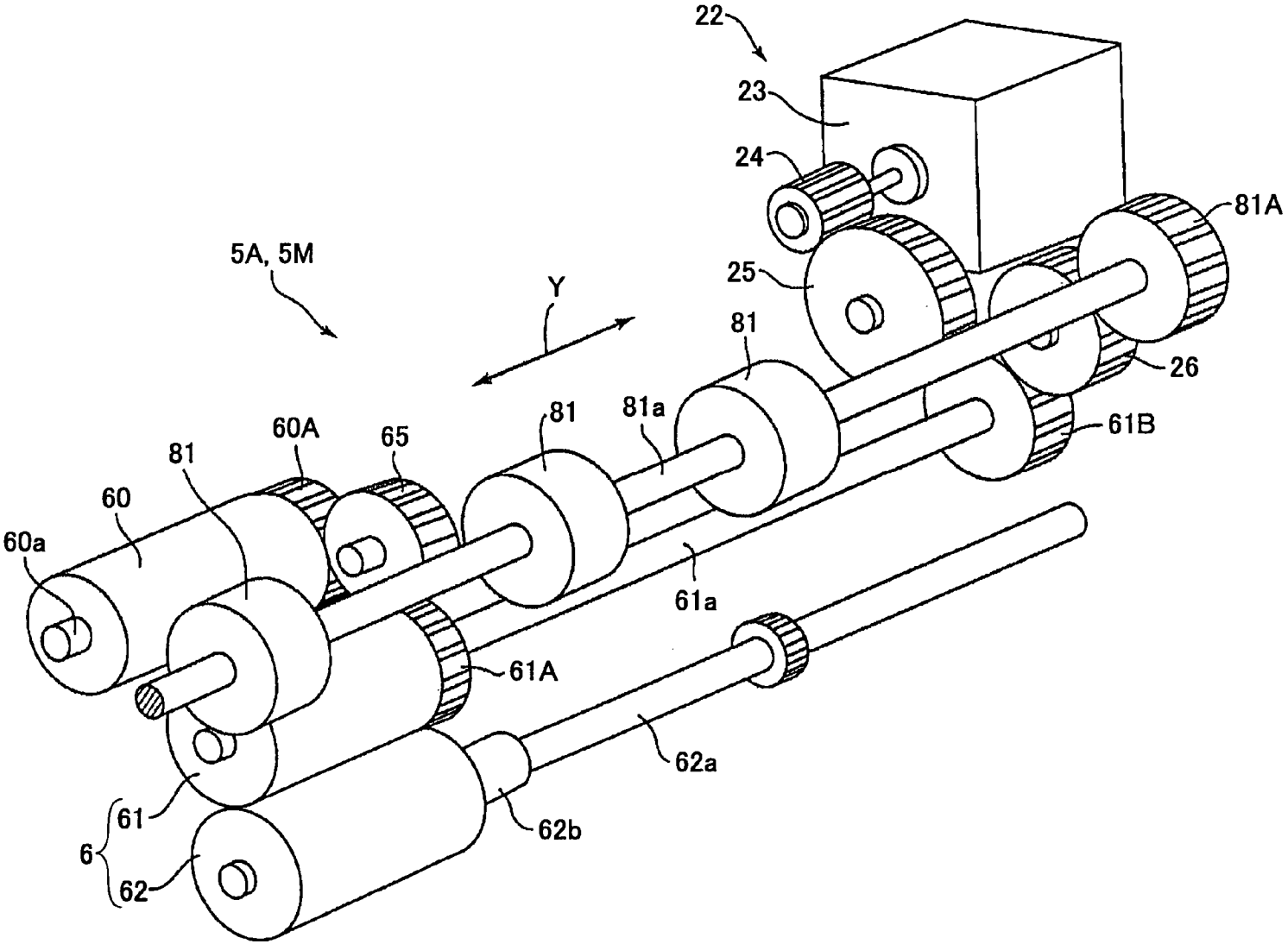
FIG. 23 is a schematic perspective view of a driving mechanism of a sheet conveying apparatus according to the first embodiment and the sixth embodiment.
Figure 24:
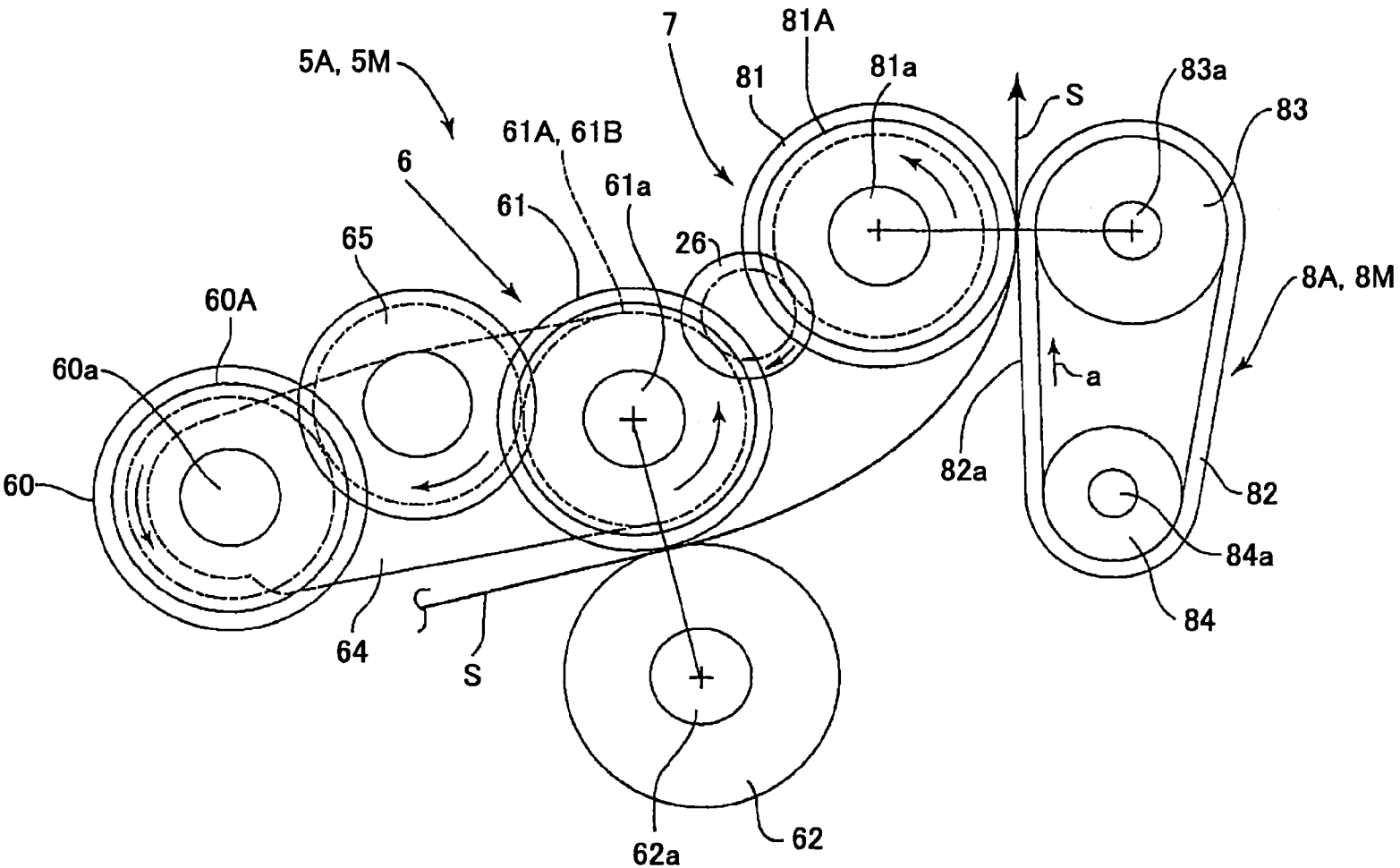
FIG. 24 is a schematic front view of relevant parts of the driving mechanism shown in FIG. 23.

A not shown rotational driving source such as an electric motor provided specifically for rotating the grip roller 81 is connected to the rotational driving shaft 81*a* of the grip roller 81 via a not shown driving force transmitting unit such as a gear or a belt (e.g., a driving mechanism 22 according to a fourth embodiment shown in FIGS. 23, 24). The grip roller 81 is rotated by receiving a rotational driving force of a predetermined rotational speed from the rotational driving source via the driving force transmitting unit. Accordingly, the grip roller 81 acts as a driving roller; the conveyor belt 82 in contact with the grip roller 81 acts as a subordinate belt that is caused to move following the rotation of the grip roller 81 acting as the driving roller; and the pulley 83 supporting the contact portion between the conveyor belt 82 and the grip roller 81 from inside the belt acts as a subordinate roller that is caused to rotate via the subordinate belt (conveyor belt 82). As a matter of course, the pulley 84 also acts as a subordinate roller that is caused to rotate via the subordinate belt (conveyor belt 82).

If the effects of the fourth embodiment described below with reference to FIGS. 23, 24 are not particularly desired, the driving system for driving the grip roller 81 can be removed from the driving mechanism 22 to make the grip roller 81 act as the subordinate side, and the conveyor belt 82 can be driven with a not shown driving mechanism.

As shown in FIGS. 2 and 3, a conveying guiding member 70 is positioned in the inner area of the sheet conveying apparatus 5, including a curved guide surface 70*a* swelling in a substantially downward direction with which the sheet S comes in contact. The conveying guiding member 71 is positioned in the outer area of the sheet conveying apparatus 5, including the guide surface 71*a* curved in a caved-in shape in accordance with the conveying guiding member 70. Furthermore, the conveying guiding member 71 is spaced apart with a predetermined gap from the guide surface 70*a* of the conveying guiding member 70. The conveying guiding members 70 and 71 are both fixed to the housing 80. Accordingly, the first conveying path A is formed between the first conveying unit 6 and the second conveying unit 7 by the guide surface 70*a* of the conveying guiding member 70, the guide surface 71*a* of the conveying guiding member 71 facing the conveying guiding member 70, and the conveying surface 82*a* of the conveyor belt 82.

As shown in FIGS. 2 and 3, a conveying guiding member 72 is positioned along the outer side of the vertical conveying path extending substantially upward from the second conveying unit 7, including a vertical conveying guide surface 72*a* facing the guide surface 70*a* with a predetermined gap therebetween. A conveying guiding member 73 forms a sheet conveying path from the sheet feeding tray 51 to the holding section (nip section) between the feed roller 61 and the reverse roller 62, and forms an inlet for guiding the sheet S into the nip section. Accordingly, the vertical conveying path communicating with (connected to) the sheet conveying path R1 is formed by the vertical conveying guide surface 72*a* of the conveying guiding member 72 and the guide surface 70*a* of the conveying guiding member 70. The curved surface (guide surface 70*a*) of the conveying guiding member 70 swells in a substantially downward direction (toward the conveying guiding member 71 provided on the outer side), beneath a line connecting the nip sections of the first conveying unit 6 and the second conveying unit 7. The degree of swelling is defined so that the sheet S moderately bends to ensure that the leading edge of the sheet S reaches the conveying surface 82*a*.

As shown in FIG. 1, the configuration of the upper stage of the sheet feeding device 3 is the same as that of the conventional technology. The difference between the lower stage described above is that a sheet conveying apparatus 5' is employed instead of the sheet conveying apparatus 5. The sheet conveying apparatus 5' is different from the sheet conveying apparatus 5 in that it employs a second conveying unit 7' instead of the second conveying unit 7. The second conveying unit 7' is different from the second conveying unit 7 in that the second pair of rotating conveying members only includes the grip roller 81 and a subordinate roller that is caused to rotate following the rotation of the grip roller 81 (practically the same size/shape as the pulley 83). The sheet feeding tray 51 of the upper stage and the sheet conveying apparatus 5' are used for sheets S of a relatively low rigidity such as plain paper and not for sheets S of a relatively high rigidity such as cardboard or envelopes.

Next, a description is given of an operation of feeding a sheet from a predetermined stage in the sheet feeding device 3 and a conveying operation of the sheet conveying apparatus 5 that starts in conjunction with the sheet feeding operation.

As shown in FIG. 2, the sheets S stacked on the bottom plate 50 are raised by the pivoting/rising movement of the rising arm 52 so that the topmost face is at a predetermined height. First, the pickup roller 60 rotates to extract the topmost sheet S, and sends it to the sheet feed separating mechanism including the feed roller 61 and the reverse roller 62. In the sheet feed separating mechanism, the feed roller 61 and the reverse roller 62 cooperate with each other to separate only the topmost sheet from the others. The separated sheet S is conveyed to the downstream side of the sheet conveying path. As shown in FIGS. 2 and 3, the leading edge of the sheet S is guided and moved as the conveyor belt 82 travels in the direction indicated by the arrow while being kept in contact with the belt conveying surface 82*a*. When the leading edge of the sheet S reaches the nip section between the grip roller 81 and the conveyor belt 82, the grip roller 81 and the conveyor belt 82 hold the sheet S and convey it further vertically upward, and finally send out the sheet S in a vertical manner.

More specifically, the leading edge of the sheet S is held by the nip section of the feed roller 61 and the reverse roller 62, sent out from the nip section, and then reaches the belt conveying surface 82*a* of the conveyor belt 82. As shown in FIG. 3, as the conveying surface 82*a* is caused to move in the sheet conveying direction by the movement of the conveyor belt 82 in the direction indicated by an arrow a, the sheet S gradually bends starting from the leading edge thereof. As the sheet S bends further, the contact area between the belt conveying surface 82*a* and the sheet S face becomes larger. Hence, even if the sheet S is a highly rigid sheet, a sufficient amount of conveying/propelling force can be applied from the belt conveying surface 82*a* to the face of the sheet S face in order to convey the sheet S in the sheet conveying direction. When conveyance resistance is generated while the highly rigid sheet S is being conveyed and considerably bent, the conveying/propelling force applied to the sheet S by the first conveying unit 6 alone is insufficient for conveying the sheet S. This insufficiency can be thoroughly compensated for by the conveying/propelling force applied to the sheet S from the belt conveying unit 8. Thus, it is possible to prevent conveyance failures of the sheet S at least between the first conveying unit 6 and the second conveying unit 7 so that the leading edge of the sheet S reaches the nip section of the second conveying unit 7.

The conveying surface 82*a* of the conveyor belt 82 continuously extends to the nip section of the second conveying unit 7, thus ensuring that the leading edge of the sheet S in contact with the conveying surface 82*a* smoothly and constantly reaches the holding section (nip section). More specifically, a highly rigid sheet S being conveyed by the first conveying unit 6 is caused to bend moderately so that the leading edge of the sheet S surely contacts the belt conveying surface 82*a*. The belt conveying surface 82*a* applies an active conveying/guiding effect to the leading edge of the sheet S in contact thereto. Accordingly, the sheet S receives a second conveying/propelling force from the belt conveying surface 82*a* for moving in the sheet conveying direction. Subsequently, the sheet S is caused to bend even further so as to reach the holding section of the second conveying unit 7.

After the leading edge of the sheet S reaches the second conveying unit 7, the sheet S is held and conveyed by both the first conveying unit 6 and the second conveying unit 7. Thus, a sufficient amount of conveying force is applied to the sheet S from both the first conveying unit 6 and the second conveying unit 7. Therefore, it is possible to continue conveying the highly rigid sheet S in a smooth manner. After the trailing edge of the sheet S is separated from the first conveying unit 6, the sheet S can no longer receive a conveying force from the first conveying unit 6. However, this loss is compensated for by the conveying/propelling force from the belt conveying surface 82*a* applied once again to the sheet S, depending on how the sheet S is contacting the belt conveying surface 82*a* between the holding section of the second conveying unit 7 and the trailing edge. Furthermore, the sheet S gradually becomes less bent. Therefore, it is possible to continue conveying the sheet S even after the trailing edge of the sheet S is separated from the first conveying unit 6. Accordingly, in the sheet conveying apparatus 5, it is ensured that the sheet S from the first conveying unit 6 is steadily sent to the second conveying unit 7 and then to the downstream sheet conveying path, regardless of the rigidity of the sheet S.

As described above, the belt conveying unit 8 is arranged along the outer side of the first conveying path A formed between the first conveying unit 6 and the second conveying unit 7. The belt conveying unit 8 functions as the moving/guiding unit for moving/guiding the sheet S toward the second conveying unit 7 while keeping the leading edge of the sheet S in contact with the belt.

In this example, the belt conveying unit 8 acting as the moving/guiding unit also has a function of changing, with the conveyor belt 82, the conveying direction of the sheet S into a direction toward the holding section (nip section) of the second conveying unit 7.

First Practical Example

Next, a reference first practical example (hereinafter, "first practical example") of the first embodiment to which the present invention is applied is described. A comparative test was conducted to compare the sheet conveying (sheet passing) properties of a copier according to the first embodiment to which the present invention is applied (indicated as "belt method" in Table 1) and a copier according to a conventional method (indicated as "conventional method" in Table 1). Among the components of "imagio Neo 453" manufactured by RICOH, only the sheet feeding device was modified to be used for the "belt method" of this test. The modified sheet feeding device used for the "belt method" basically has the same configurations and specifications as that of the sheet feeding device 3 of the sheet conveying apparatus 5 shown in FIGS. 1-3. For the "conventional method", "imagio Neo 453" manufactured by RICOH was used, in this case including a sheet feeding device with a conventional sheet conveying apparatus (referring to FIGS. 1-3, the conventional sheet conveying apparatus corresponds to the conventional sheet conveying apparatus 5' of the sheet feeding device 3 shown in FIG. 1, in which the roller-type pulley 83 is the only rotating conveying member facing and contacting the grip roller 81, and the conveyor belt 82 and the roller-type pulley 84 are removed).

Details of the belt conveying unit 8 and peripheral components used for this comparative test in the belt method (including conventional method) are described below.

Material of conveyor belt 82: ethylene propylene rubber (EPDM)

Hardness of conveyor belt 82: JIS K6253 A type 40 degrees

Frictional coefficient of conveyor belt 82 with respect to sheet: 2.6

Thickness of conveyor belt 82: 1.5 mm

Diameter of pulley 83: 13 mm

Diameter of pulley 84: 7 mm

Gap between pulleys 83 and 84: 13 mm (distance between axes of pulley shaft 83*a* and pulley shaft 84*a*)

Extension factor of conveyor belt 82: 7%

Diameter of rollers 60, 61, 62, 81: all 20 mm

Figure 5:
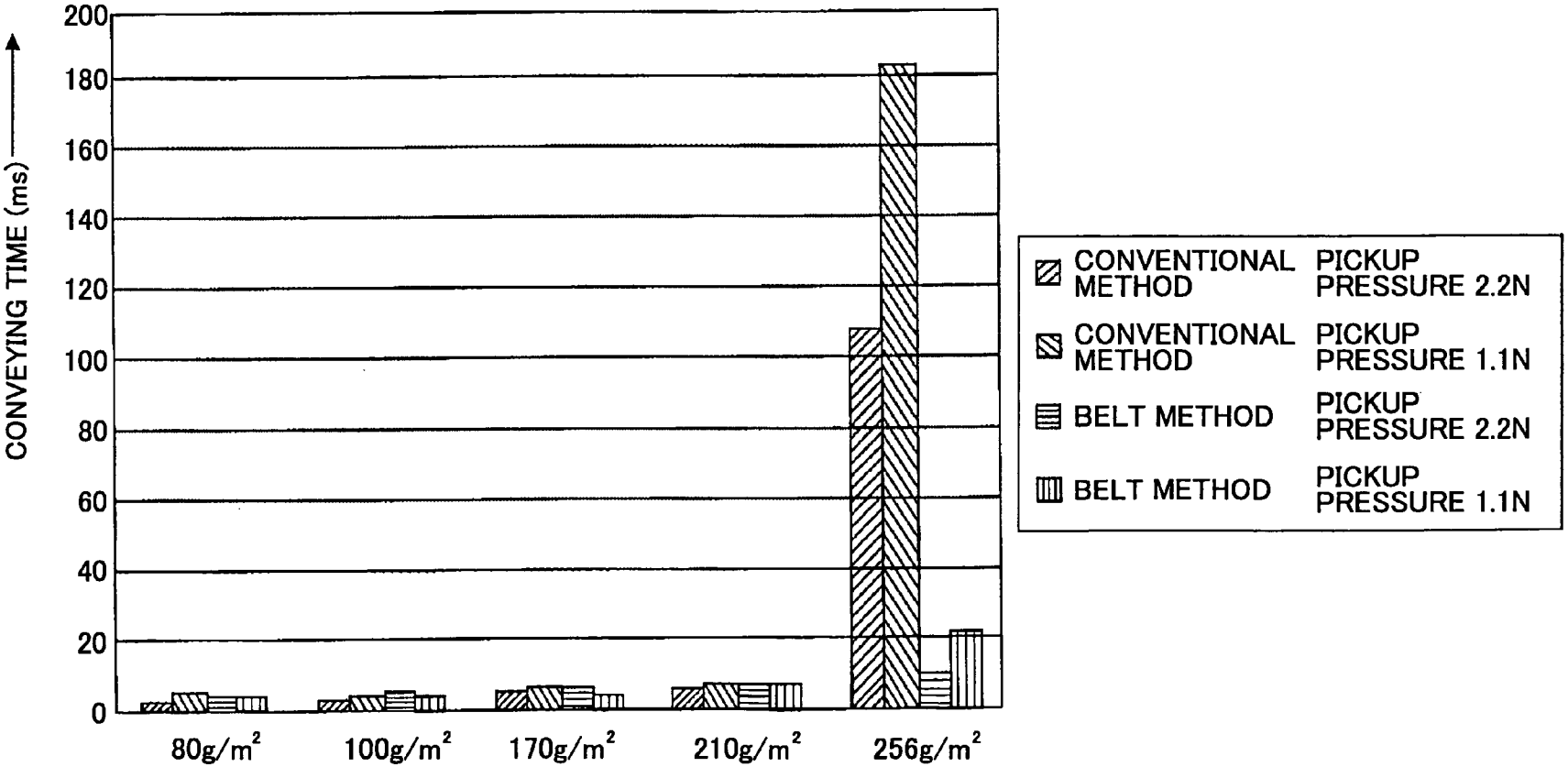
FIG. 5 is a graph for describing test results indicating the differences in conveying time in the first practical example.

As the basic test conditions, the weight of a sheet (meter basis weight) was employed to represent the stiffness (rigidity) of the sheet. Six types of sheets with different weights were passed through the above copiers from sheet feeding trays corresponding to the same stages under an environment of normal temperature (23° C., relative humidity 50%). Other test conditions described below with reference to FIG. 4 were also applied to test the differences in conveying time between the different types of sheets. The test results indicating the differences in conveying time are shown in FIG. 5, and Table 1 indicates a summary of the sheet passing properties based on the test results shown in FIG. 5.

Referring to FIG. 4, a sheet feeding sensor 88 detects the leading edge of the sheet S picked up by the pickup roller 60 and a vertical conveyance sensor 89 detects the leading edge of the sheet S conveyed by the second conveying unit 7 (belt method) or the pair of the grip roller 81 and the roller-type pulley 83 (conventional method). The sheet feeding sensor 88 and the vertical conveyance sensor 89 are both reflection type photo-sensors.

The conveying path length (sheet conveying distance) between the positions where the sheet feeding sensor 88 and the vertical conveyance sensor 89 are arranged is 57 mm both in the belt method and the conventional method. The conveying path length between the position where the sheet feeding sensor 88 is arranged and the nip section between the feed roller 61 and the reverse roller 62 is 10 mm; the conveying path length between the nip section between the feed roller 61 and the reverse roller 62 and the nip section of the second conveying unit 7 (belt method) or between the nip section between the feed roller 61 and the reverse roller 62 and the nip section between the grip roller 81 and the roller-type pulley 83 (conventional method) is 38 mm for both methods; and the conveying path length between the nip section of the second conveying unit 7 (belt method) and the position where the vertical conveyance sensor 89 is arranged or between the nip section between the grip roller 81 and the roller-type pulley 83 (conventional method) and the position where the vertical conveyance sensor 89 is arranged is 9 mm for both methods. Accordingly, the total conveying path length is 57 mm for both methods.

The curvature radius at the center of the curved sheet conveying path (first conveying path A) between the first conveying unit 6 and the second conveying unit 7 of the sheet conveying apparatus 5 is 20 mm for both the belt method and the conventional method.

For both the belt method and the conventional method, tests were conducted for two different values of a parameter indicating the pickup pressure (sheet feeding pressure) of the pickup roller 60, namely 1.1 N and 2.2 N. The linear speed of both the feed roller 61 on the driving side and the grip roller 81 on the driving side was 154 mm/s. The time required for the leading edge of the sheet S to be conveyed from the sheet feeding sensor 88 to the vertical conveyance sensor 89, corresponding to 57 mm of the conveying path, was measured for five different types of paper with an oscilloscope. Results indicating differences between the conveyance times between different types of paper are shown in a graph of FIG. 5.

The test results in FIG. 5 say that in the conventional method, if the sheet is 256 g/m$^2$ basis weight or more, the conveyance time considerably changes (becomes long) and the sheet is caused to slip considerably. Meanwhile, in the belt method to which the present invention is applied, even if the sheet is 256 g/m$^2$ basis weight or more, the conveyance time changes only scarcely (does not become as long as the conventional method), and the sheet is caused to slip only scarcely. Furthermore, if the pickup pressure is reduced, the conveying force decreases. However, in the belt method to which the present invention is applied, the conveying force is not affected as much even if the pickup pressure is reduced. This means that the pickup pressure can be made smaller by employing the belt method to which the present invention is applied, and therefore, the power of the driving motor can be reduced. As a result, the apparatus can be made compact.

Table 1 summarizes the sheet passing properties based on the test results shown in FIG. 5.

In Table 1, "meter basis weight" corresponds to the weight (grams) of a sheet per one square meter. In general, a sheet with a small meter basis weight is "light paper" or "thin paper", and a sheet with a large meter basis weight is "heavy paper" or "thick paper".

In the first test results shown in Table 1, "sheet passing property is good" indicated by 0 means that the leading edge of the sheet S reached the vertical conveyance sensor 89 within a predetermined time after the sheet feeding sensor 88 had turned on and detected the leading edge of the sheet S. Conversely, "sheet passing property is unacceptable" indicated by x means that the leading edge of the sheet S did not reach the vertical conveyance sensor 89 within a predetermined time after the sheet feeding sensor 88 had turned on and detected the leading edge of the sheet S.

TABLE 1

| Meter basis weight | Conventional method | Belt method |
|---|---|---|
| 80 g/m$^2$ | ○ | ○ |
| 100 g/m$^2$ | ○ | ○ |
| 170 g/m$^2$ | ○ | ○ |
| 210 g/m$^2$ | ○ | ○ |
| 256 g/m$^2$ | x | ○ |
| 300 g/m$^2$ | x | ○ |

○: sheet passing good
x: sheet passing unacceptable

In the first test results shown in Table 1, if the paper type is 256 g/m$^2$ basis weight or more, the results were "sheet passing property is unacceptable" in the conventional method, whereas all of the results were "sheet passing property is good" in the belt method according to the first embodiment to which the present invention is applied shown in FIGS. 1-4.

By comparing the sheet passing/conveying properties observed in the test, it was found that in the in the conventional method, if the paper type is 256 g/m$^2$ basis weight or more, the sheet is too stiff to bend along the curved sheet conveying path. Hence, the leading edge of the sheet S is disadvantageously crushed against the roller-type pulley 83 that faces/contacts the grip roller 81 (see FIGS. 1-4).

Furthermore, tests were conducted with sheets of 256 g/m$^2$ basis weight or more with coated surfaces and uncoated surfaces to observe whether it makes a difference in sheet passing/conveying properties; however, no particular results distinguishable from those of the first test shown in Table 1 were obtained.

The conclusions described below can be made from the tests results observed in the first practical example. That is, when conveying a highly rigid sheet that is 256 g/m$^2$ basis weight or more from the first conveying unit 6 to the conveying surface 82*a* of the belt conveying unit 8 via the first conveying path A, the following configuration is possible. Specifically, because the highly rigid sheet is capable of being conveyed in a rectilinear manner, various guiding members configuring the first conveying path A can be made to have simplified shapes so as to reduce the conveyance load resistance, or the various guiding members can be completely omitted.

Therefore, in the sheet conveying apparatus dedicated for conveying the sheet S with a relatively high rigidity, the essential components are the first conveying unit 6, the second conveying unit 7, and the belt conveying unit 8 (moving/guiding unit) for guiding the sheet to the second conveying unit 7 while keeping the leading edge of the sheet S in contact with the belt conveying unit 8. The belt conveying unit 8 is arranged along the outer side of the first conveying path A (in this case, guiding members are unnecessary) formed between the first conveying unit 6 and the second conveying unit 7.

For the above reasons, the various guiding members forming the first conveying path A are necessary for conveying a sheet S with a relatively low rigidity, such as plain paper (PPC). As such a PPC sheet S cannot be conveyed in a rectilinear manner compared to the case of a highly rigid sheet S such as cardboard, the various guiding members of the first conveying path A are necessary to compensate for this disadvantage in guiding the sheet S to the conveying surface 82*a* of the belt conveying unit 8. That is, as the rigidity of the sheet S becomes lower, it moves in a less rectilinear manner. Therefore, to assist the sheet S to move in a rectilinear manner, guiding surfaces of the various guiding members in the first conveying path A need to have appropriate shapes so as to ensure that the leading edge of the sheet S abuts against the abdominal portion of the conveying surface 82*a* of the conveyor belt 82.

This means that the higher the rigidity of the sheet S (more meter basis weight), more freedom is allowed in designing the shapes and positions of the various guide members configuring the sheet conveying path with a curvature section of a relatively small curvature radius.

The material of the conveyor belt 82 is not limited to that of the above comparative test; the material can be, for example, chloroprene rubber, urethane rubber, or silicon rubber. The hardness of the rubber of the conveyor belt 82 can be JIS K6253 A type 40 degrees-80 degrees (JIS: Japan Industrial Standard).

As described above, with the sheet conveying apparatus 5 shown in FIGS. 1-4 and the copier 1 including the same, it is possible to provide a sheet conveying apparatus and an image forming apparatus that is compact and space-saving, having a simple and low-cost configuration, and capable of conveying various sheet types. The basic configuration is made by adding the belt conveying unit 8 configured with a conveyor belt stretched around conventional rollers including one of the second conveying unit, and a driving source dedicated to the belt conveying unit 8 can be omitted. Therefore, it is possible to realize a sheet conveying apparatus in an image forming apparatus that has a simple configuration that is thus low-cost.

In the conventional configuration, a conveyance failure occurs when conveying a highly rigid type of sheet. The failure is caused by a large conveyance resistance generated as the sheet contacts the conveying guiding member 70, or by a conveyance load in the first conveying path A between the first conveying unit 6 and the second conveying unit 7. However, the sheet conveying apparatus 5 according to an embodiment to which the present invention is applied can convey highly rigid sheets without failures, and is thus capable of conveying various sheet types. That is to say, the conventional configuration merely provides a fixed member for guiding a sheet, and thus does not eliminate the speed difference between the conveyed sheet, which is a mobile object, and the fixed guiding member. As a result, a conveyance resistance is always generated. However, in the sheet conveying apparatus 5 and the copier 1 according to the first embodiment to which the present invention is applied, the conveyance resistance can be substantially completely eliminated, and moreover, the sheet can be guided by actively applying a conveying/propelling force to move the sheet in the downstream direction (or the conveying force of the second conveying unit 7 is applied to the sheet in addition to the conveying force of the first conveying unit 6 so as to counter the conveyance load in the first conveying path A between the first conveying unit 6 and the second conveying unit 7 and move the sheet in the downstream direction). In the sheet conveying apparatus 5, the frictional resistance between the sheet S and the conveyor belt 82 does not obstruct the sheet S from being conveyed; the frictional resistance functions as a negative resistance to apply a conveying/propelling force to the sheet S. That is, the frictional resistance does not obstruct the sheet S from being conveyed, but is converted into an advantageous negative resistance to apply a conveying/propelling force to the sheet S.

Furthermore, in the conveying direction of the sheet S, as the leading edge of the sheet S abuts the moving surface (conveying surface) of the conveyor belt 82 and is then conveyed forward by the conveyor belt 82, the leading edge of the sheet S gradually overlaps the moving surface of the conveyor belt 82, although there may be differences according to the rigidity of the sheet type. As a result, the area of the sheet in contact with the moving surface of the belt gradually increases. Thus, the resistance between the sheet and the moving surface of the conveyor belt 82 increases as the contact area increases, so that an even larger conveying/propelling force for moving the sheet S in the conveying direction can be applied from the conveyor belt 82 to the sheet S. Moreover, the conveyor belt 82 can change the direction of the sheet S in a direction toward the nip section between the grip roller 81 and the conveyor belt 82. This configuration ensures a steady increase of the conveying/propelling force transmitted from the moving surface (conveying surface) of the conveyor belt 82 to the sheet surface.

Therefore, even if the sheet S is highly rigid, it is possible to overcome this rigidity and appropriately deform (bend) the sheet S in its thickness direction, so as to ensure that the sheet S is steadily conveyed toward the holding section of the second conveying unit 7 in the downstream direction. In this manner, it is possible to address the factors of major conveyance failures caused by the fact that the sheet S is highly rigid. Therefore, it is ensured that the sheet S can be steadily conveyed after the leading edge of the sheet S reaches the holding section of the second conveying unit 7. As a result, the sheet conveying apparatus 5 is able to convey various sheet types and achieve excellent sheet conveyance properties.

Modification Examples of First Embodiment

Figure 6A:
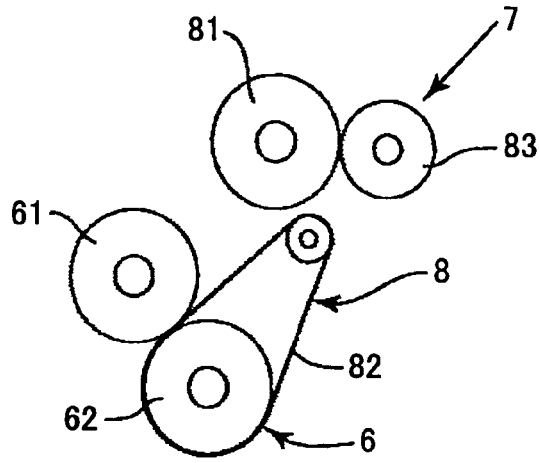
FIGS. 6A-6C illustrate modification examples of the sheet conveying apparatus according to the first embodiment to which the present invention is applied.
Figure 6B:
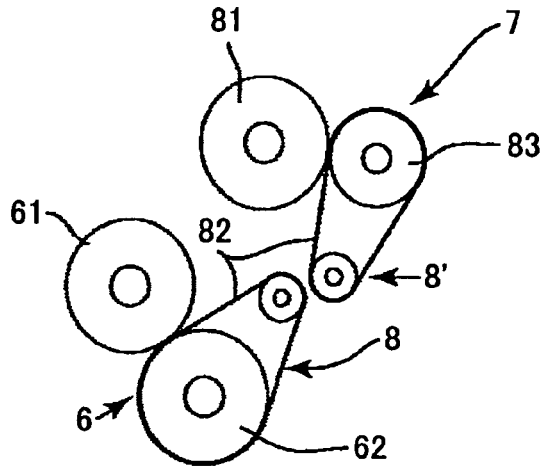
Figure 6C:
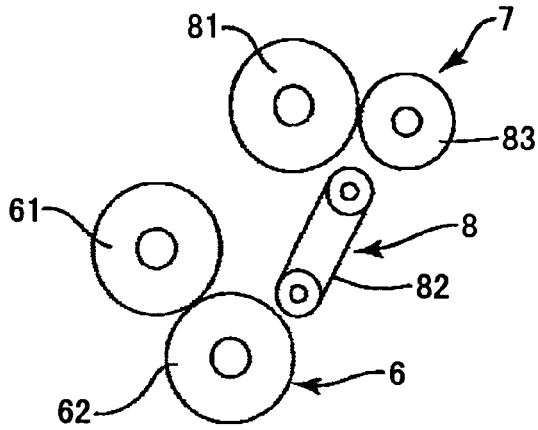

FIGS. 6A-6C illustrate modification examples of the first embodiment to which the present invention is applied.

As shown in FIG. 6A, one member of the pair of rollers facing/contacting each other in the first conveying unit 6 can be the belt conveying unit 8. Furthermore, as shown in FIG. 6B, one member of the pair of rollers facing/contacting each other in the in the first conveying unit 6 and one member of the pair of rollers facing/contacting each other in the second conveying unit 7 can be the belt conveying unit 8 and a belt conveying unit 8', respectively. Furthermore, as shown in FIG. 6C, a separate, independent belt conveying unit 8 can be provided as a moving/guiding unit alternative to one member of the pair of rollers in the first conveying unit 6 arranged on the upstream side or one member of the pair of rollers in the second conveying unit 7 arranged on the downstream side, and arranged between the first conveying unit 6 and the second conveying unit 7.

In the belt conveying unit 8 of the modification examples shown in FIG. 6A and at the bottom of FIG. 6B, there is provided an intermediate roller-type pulley (not shown) with an outside diameter somewhat smaller than the outside diameter of the reverse roller 62. The reverse roller 62 is divided into a shish-kebab-like structure in its axial direction, and the intermediate roller-type pulley is arranged inside the divided reverse roller 62 (at a position where the reverse roller 62 does not exist) via a not shown rolling bearing, on the outer circumference of a shaft holding the reverse roller 62. The intermediate roller-type pulley is arranged so as not to affect the separating function of the reverse roller 62 (rotation in the anticlockwise direction for returning the sheet S). By providing this intermediate roller-type pulley, the conveyor belt 82 can be moved/rotated in the clockwise direction to convey the sheet S to the second conveying unit 7 or the belt conveying unit 8' at the downstream side of the conveying path. The conveyor belt 82 is one step lower than the circumferential surface of the reverse roller 62 so that the conveyor belt 82 does not form part of the nip section between the feed roller 61 and the reverse roller 62. Accordingly, after the sheet S is separated from the rest of the sheets at the nip section between the feed roller 61 and the reverse roller 62, the conveyor belt 82 can provide the above-described functions.

Hence, in any of the above described modification examples, the same effects as those of the first embodiment can be achieved.

Second Embodiment

A second embodiment to which the present invention is applied is described with reference to FIGS. 7-9. Elements/members corresponding to those of the sheet conveying apparatus 5 shown in FIGS. 1-4 are denoted by the same reference numerals and descriptions thereof are omitted or summarized. Although not particularly mentioned, configurations of the sheet conveying apparatus, etc., and operations that are not particularly described in the second embodiment are the same as those of the sheet conveying apparatus 5 of the first embodiment and the first practical example described with reference to FIGS. 1-4.

Figure 7:
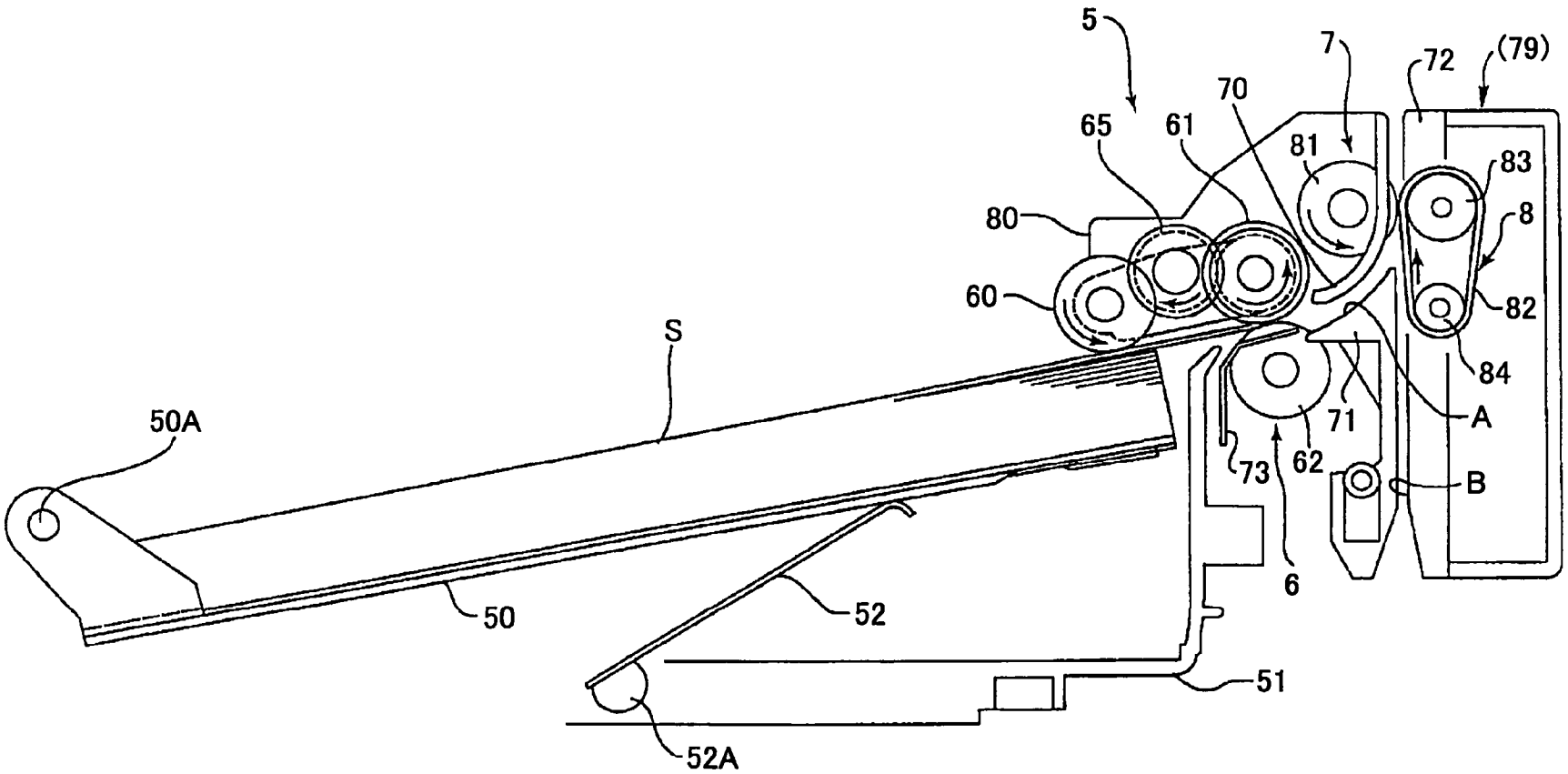
FIG. 7 is a sectional view of relevant parts of a sheet conveying apparatus according to a second embodiment to which the present invention is applied and a sheet feeding tray stage around the sheet conveying apparatus.
Figure 8:
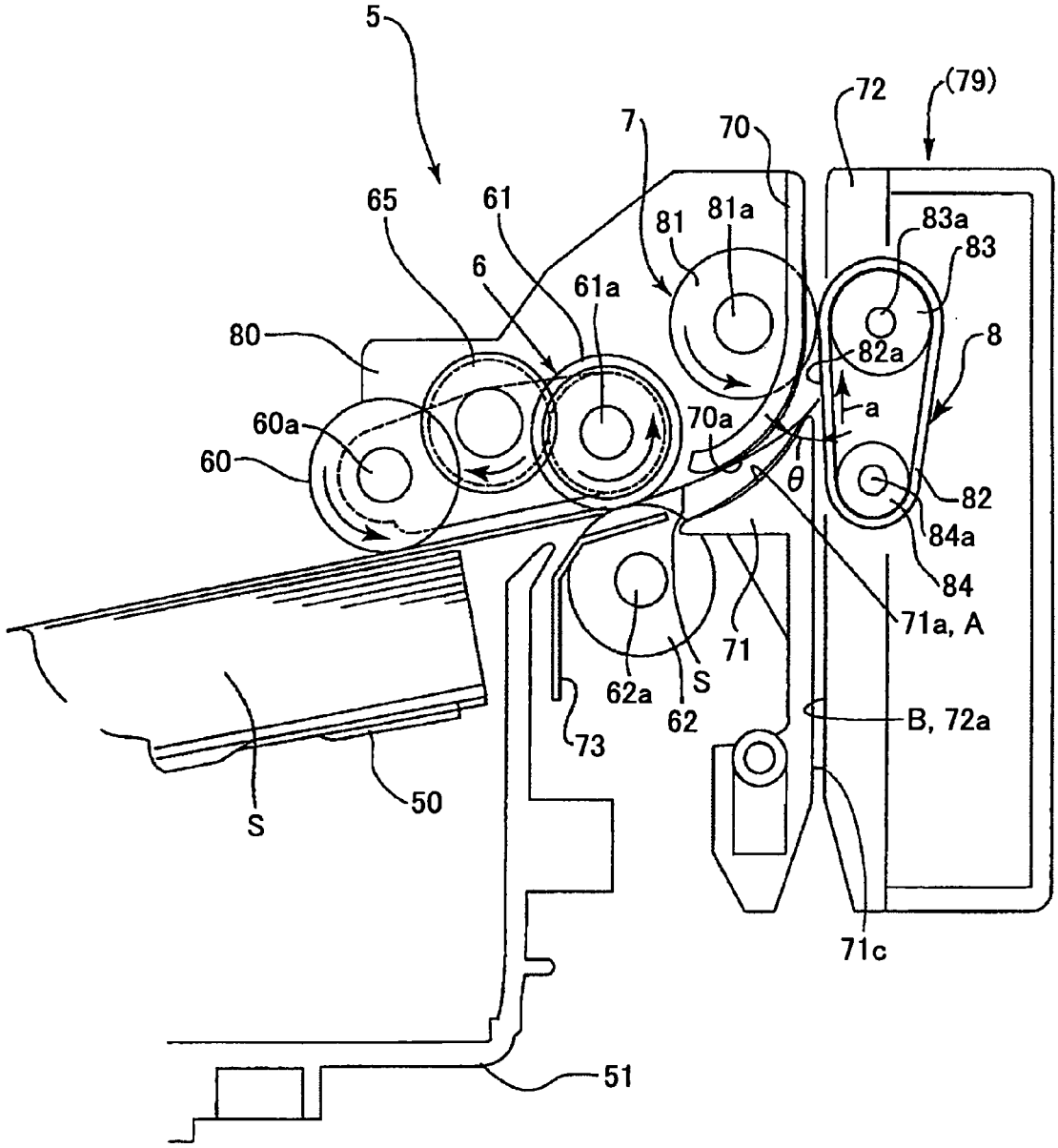
FIG. 8 is an enlarged sectional view of relevant parts of the sheet conveying apparatus shown in FIG. 7 illustrating an operation status when a leading edge of a sheet has reached a belt conveying unit.
Figure 9:
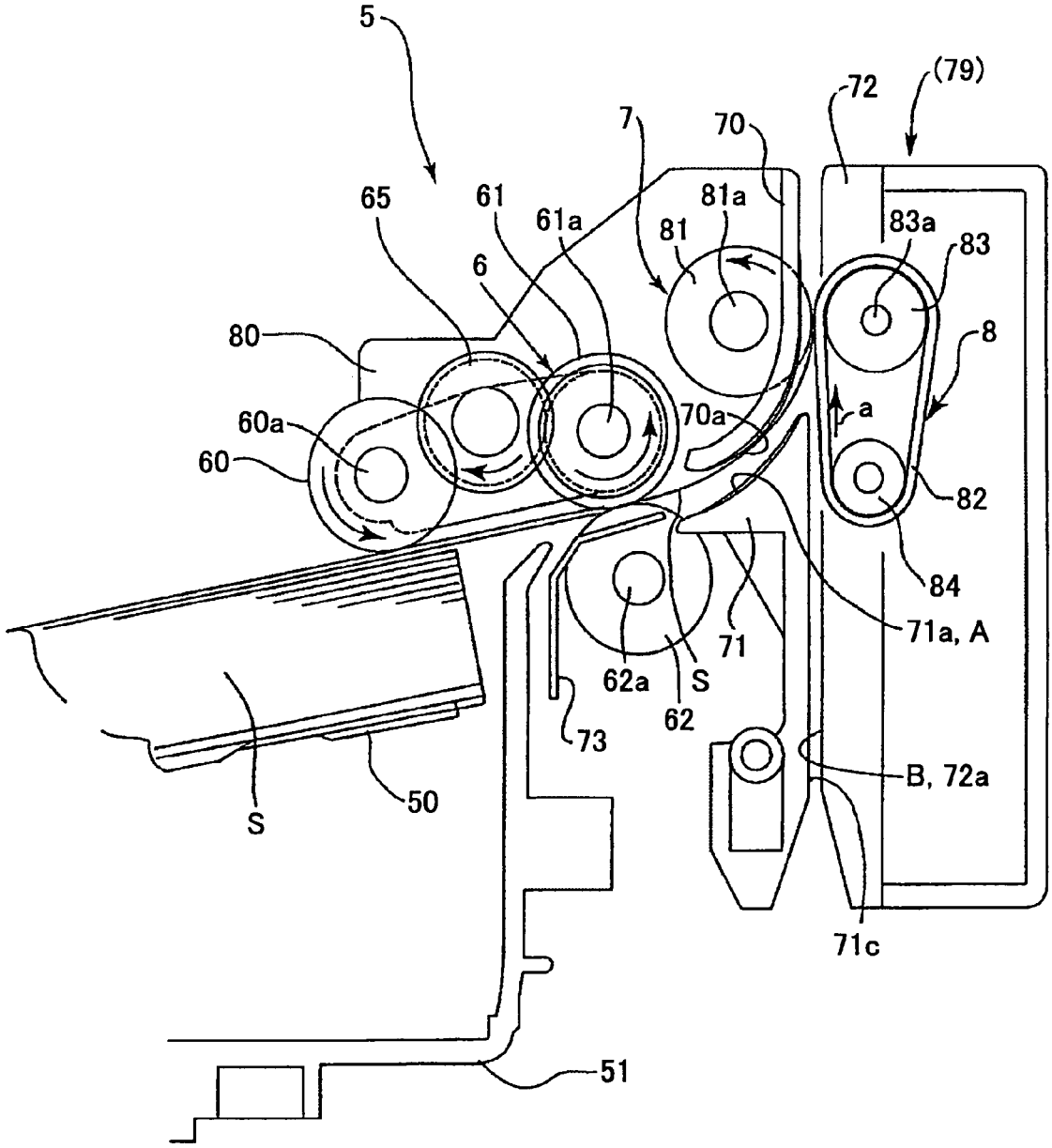
FIG. 9 is an enlarged sectional view of relevant parts of the sheet conveying apparatus shown in FIG. 7 illustrating an operation status immediately before the leading edge of the sheet reaches a nip section of a second conveying unit.

The main differences between the sheet conveying apparatus 5 shown in FIGS. 1-4 and the sheet conveying apparatus 5 shown in FIGS. 7-9 are as follows. In addition to the first conveying path A acting as a first sheet conveying path formed between the first conveying unit 6 and the second conveying unit 7, a second conveying path B acting as a second sheet conveying path is formed. The second conveying path B, which is different and separate from the first conveying path A, extends from an upstream position of the second conveying unit 7 to the second conveying unit 7. The first conveying path A and the second conveying path B merge at an upstream side of the second conveying unit 7, thereby forming a merged conveying path. The belt conveying unit 8, which is one of the members of the second conveying unit 7, is arranged along the outer side of the first conveying path A and the second conveying path B. Apart from these differences, the sheet conveying apparatus 5 shown in FIGS. 7-9 is the same as the sheet conveying apparatus 5 shown in FIGS. 1-4.

That is, in the belt conveying unit 8, the pulley 84 around which the conveyor belt 82 is stretched, which pulley 84 is one member of the pair of roller-type pulleys 83, 84, is axially rotatably supported by the housing 80, and is arranged beneath the pulley 83 with a space therebetween. Therefore, it is ensured that the leading edge of the sheet S conveyed by the first conveying unit 6 into the first conveying path A abuts the conveying surface 82*a* of the conveyor belt 82, and that the sheet S conveyed along the second conveying path B by a not shown conveying unit is not obstructed from reaching the second conveying unit 7.

The conveying guiding member 71 is different from that of the first embodiment shown in FIGS. 1-4 in that it has a vertical conveying guide surface 71*c* on the right side thereof as viewed in the drawings. The conveying guiding member 72 is different from that of the first embodiment shown in FIGS. 1-4 in that it is arranged along the outer side of the second conveying path B extending downward from the above-described vertical conveying path. Furthermore, a vertical conveying guide surface 72*a* is formed on the conveying guiding member 72 for guiding the sheet S conveyed from an upstream side of the second conveying path B.

As described above, the second conveying path B is formed by the vertical conveying guide surface 71*c* of the conveying guiding member 71 and the vertical conveying guide surface 72*a* of the conveying guiding member 72 facing the vertical conveying guide surface 71*c* with a predetermined gap therebetween.

Next, conveying operations of the sheet conveying apparatus 5 shown in FIGS. 7-9 are described. The sheet S is extracted and conveyed from a stack of sheets stacked horizontally in the sheet feeding tray 51. Therefore, the sheet conveying direction in the sheet feed separating mechanism of the first conveying unit 6 is a substantially horizontal direction. Subsequently, the sheet S is conveyed upward toward an image creating unit of the image forming apparatus main unit 2 positioned above, and therefore, the sheet S needs to be conveyed in a substantially vertical and upward direction, which is orthogonal to the substantially horizontal direction.

Thus, as shown in FIG. 8, after the sheets S are separated one by one in the sheet feed separating mechanism, the sheet S bends moderately while being conveyed to minimize the conveyance resistance, and then the leading edge of the sheet S abuts the conveyor belt 82.

The conveyor belt 82 moves in a substantially vertically upward (substantially directly upward) direction as indicated by an arrow in FIG. 8. Therefore, as shown in FIG. 9, the leading edge of the sheet S abutting the conveyor belt 82 is conveyed to the holding section (nip section) between the grip roller 81 and the conveyor belt 82, and is then conveyed to the downstream side in the substantially directly upward direction by the grip roller 81 and the conveyor belt 82 while being held therebetween. As described above, a conveying/propelling force is transmitted from the conveyor belt 82 to the sheet S for moving the sheet S in the conveying direction. Moreover, the conveyor belt 82 changes the direction of the sheet S toward the nip section between the grip roller 81 and the conveyor belt 82. Accordingly, even a highly rigid sheet S can be steadily conveyed without causing conveyance failures.

As described above, with the sheet conveying apparatus 5 provided with the merged conveying path shown in FIGS. 7-9, the same effects as those of the sheet conveying apparatus 5 shown in FIGS. 1-4 can be achieved. That is, a highly rigid sheet such as cardboard can be steadily conveyed, so that various sheet types can be conveyed, and excellent sheet conveyance properties can be achieved. Moreover, the sheet conveying apparatus 5 of the second embodiment can be applied as a sheet conveying apparatus having plural conveying paths, at least the first conveying path A and the second conveying path B, so as to be applied to a wider range of machine types.

Incidentally, the second embodiment is not limited to the belt conveying unit 8 including the conventional pair of second conveying rollers 81, 83; the belt conveying unit 8 can be provided separately from the pair of second conveying rollers 81, 83, as in the modification example of the first embodiment shown in FIG. 6C.

Third Embodiment

A third embodiment to which the present invention is applied is described with reference to FIG. 10. Elements/members corresponding to those of the second embodiment are denoted by the same reference numerals and descriptions thereof are omitted or summarized. Although not particularly mentioned, configurations of the sheet conveying apparatus, etc., and operations that are not particularly described in the third embodiment are the same as those of the sheet conveying apparatus 5 of the second embodiment described with reference to FIGS. 7-9.

Figure 10:
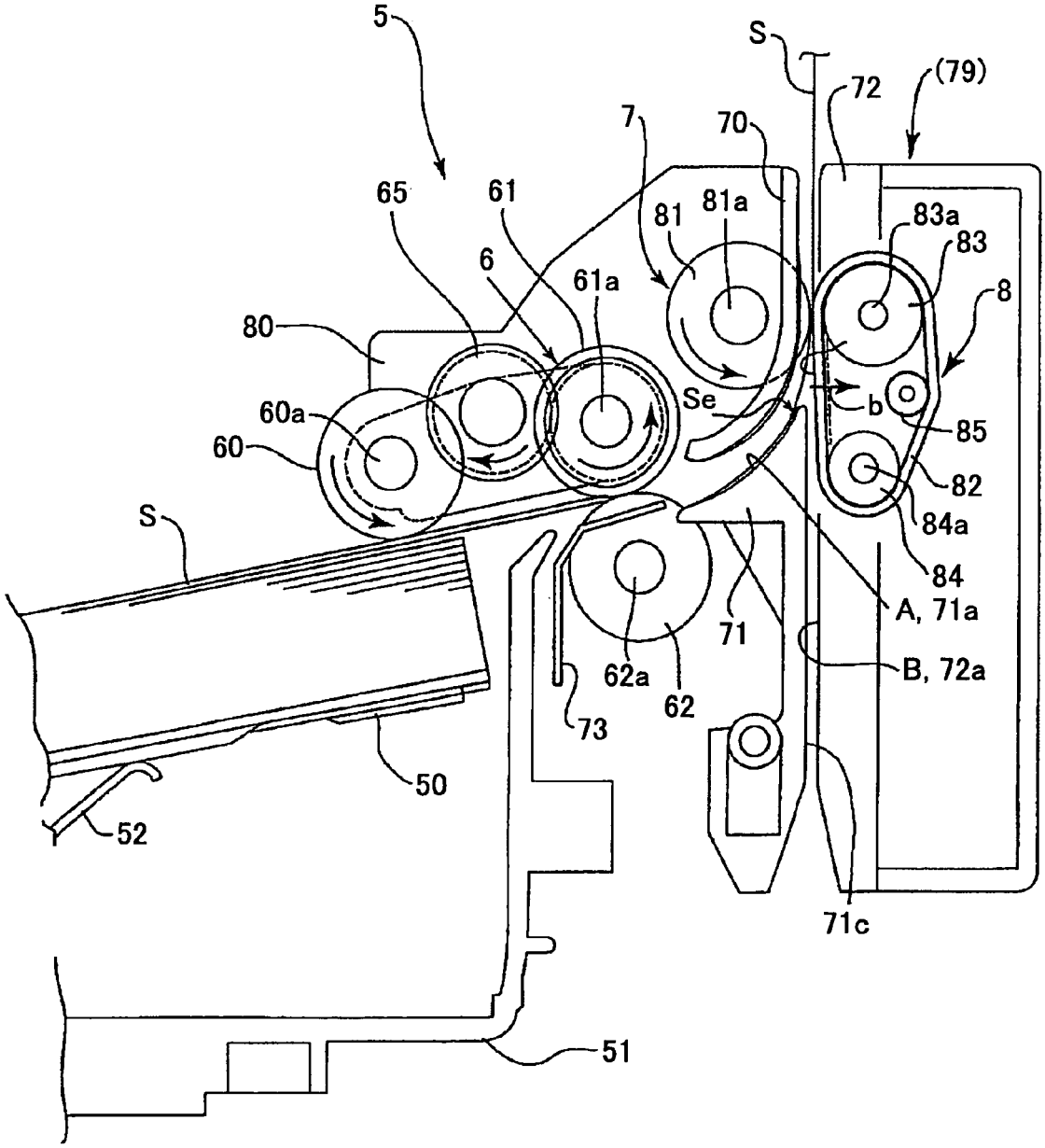
FIG. 10 is a schematic enlarged sectional view of a sheet conveying apparatus according to a third embodiment to which the present invention is applied.

As shown in FIG. 10, when a trailing edge Se of the sheet S that is bent while being conveyed is released from the conveying guiding member 71, the reaction force of the bent sheet S causes the trailing edge Se of the sheet S to move in a direction indicated by an arrow b shown in FIG. 10, i.e., causes a flipping phenomenon. Particularly, if the sheet S is stiff (highly rigid) such as cardboard, the reaction force is larger, and therefore, a sudden noise caused by this flipping phenomenon becomes a problem.

Specifically, in the process of being conveyed, the sheet S is held at least two supporting points and is forcibly bent. When the trailing edge Se of the sheet S is released from the holding section of the first conveying unit 6 or the conveying guiding member 71 acting as one of the supporting points, the sheet S is only supported at the leading edge. Thus, an elastic restoring force of the bent sheet S causes the trailing edge of the sheet S to immediately collide against the conveying surface 82*a*. The impact of the collision becomes larger as the rigidity of the sheet S becomes higher. Accordingly, the sudden noise made when the trailing edge Se of the sheet S is caused to collide against the conveyor belt 82 by the flipping phenomenon is not only unpleasant for the user but may also cause the user to have a misperception that a failure has occurred. That is, even if the sheets S are being conveyed normally, regardless of whether the sheet S is a regular type or a highly rigid type, the above-described sudden noises may give the wrong impression to the user that the apparatus is malfunctioning.

To address this issue, as shown in FIG. 10, in the belt conveying unit 8, a contacting member such as a tension roller 85 is not provided on the side of the conveying surface 82*a* of the conveyor belt 82. This tension roller 85 is a member that contacts the conveyor belt 82, other than the pair of roller-type pulleys 83, 84 around which the conveyor belt 82 is stretched, and the grip roller 81. Accordingly, the portion of the conveying surface 82*a* is made to have appropriate elasticity, so that the impact caused by the flipping phenomenon of the trailing edge Se of the sheet S can be absorbed by the elastic property of the conveyor belt 82. Thus, the sheet conveying apparatus 5 can remain silent even while a highly rigid sheet S such as cardboard is being conveyed.

Among the two linear portions of the conveyor belt 82 stretched around the pair of pulleys 83, 84, the tension roller 85 is not arranged on the side of the conveying surface 82*a*, but on the opposite side and in contact with the inside perimeter of the conveyor belt 82. Furthermore, the tension roller 85 is axially supported so as to be movable in an outward direction from inside the conveyor belt 82, and is pressed outward in the right direction as viewed in FIG. 10 by a not shown forcing unit. Therefore, the tension roller 85 is caused to rotate by the movement of the conveyor belt 82, and contacts the inside perimeter of the conveyor belt 82 while constantly receiving a predetermined pressing force in an outward direction, so that the conveyor belt 82 maintains a fixed tension without slackening in its circumferential direction.

Accordingly, in the sheet conveying apparatus 5 of the third embodiment, the following advantage is achieved. That is, as the leading edge of the sheet S in the sheet conveying direction is held and conveyed by the second conveying unit 7, the trailing edge Se of the sheet S is released from being supported by the conveying guiding member 71 and is made to collide against the conveying surface 82*a*. However, the conveying surface 82*a* can elastically deform enough and change its position in the direction of collision as indicated by the chain double-dashed line in FIG. 10. Accordingly, the impact caused by the flipping phenomenon of the trailing edge Se of the sheet S can be absorbed, and the noise caused by the impact can be reduced, so that abnormal noises can be reduced and mitigated during the operation of the sheet conveying apparatus 5.

As described above, in the sheet conveying apparatus 5 of the third embodiment, as one of the contacting members to support the conveyor belt 82, the tension roller 85 is provided in contact with the conveyor belt 82 where the trailing edge Se of the conveyed sheet S does not come in contact with the conveying surface 82*a*. When the sheet S that is bent to a predetermined extent is conveyed and the trailing edge Se of the sheet S is released from either one of the nip section of the first conveying unit 6 or the conveying guiding member 71, the trailing edge Se collides against the conveying surface 82*a*. However, the portion of the conveyor belt 82 where this collision occurs elastically bends enough to absorb the impact of the collision. Therefore, the sudden noise (flipping noise) caused by the collision can be reduced. That is, when the trailing edge Se of the sheet S contacts the conveying surface 82*a* of the conveyor belt 82, the contacting member (tension roller 85) does not obstruct the deforming motion of the conveyor belt 82 where it is contacted by the trailing edge Se of the sheet S. Thus, the conveyor belt 82 sufficiently bends in the same direction as the direction in which the trailing edge Se of the sheet S contacts the conveyor belt 82.

Particularly, when a highly rigid sheet S such as cardboard is being conveyed, and the trailing edge Se of the sheet S in the sheet conveying direction strongly collides against the conveyor belt 82, the elastic deforming motion of the conveyor belt 82 absorbs and mitigates the impact caused by the collision so that an impulsive noise is sufficiently reduced.

Accordingly, as sudden noises can be reduced while conveying the sheet S, operations can be performed quietly so that unpleasant noises are prevented and misperceptions that a failure has occurred are not created. This results in advantageous usability of the sheet conveying apparatus 5.

In the process of conveying the sheet S, even if a sudden noise is not generated when the leading edge of the sheet S first contacts the conveying surface 82*a* of the conveyor belt 82, the above-described configuration still has an advantageous effect. That is, as the conveyor belt 82 elastically deforms to some extent, the leading edge of the sheet S is prevented from bouncing back from the conveying surface 82*a*. Instead, the leading edge of the sheet S softly abuts the conveying surface 82*a* and stays in contact with the conveying surface 82*a*. Specifically, when the leading edge of the sheet S conveyed by the first conveying unit 6 first abuts the conveying surface 82*a* of the conveyor belt 82 moving in the sheet conveying direction at an oblique collision angle θ (see FIG. 8), the leading edge of the sheet S is prevented from bouncing back from the conveying surface 82*a*. Rather, the leading edge of the sheet S is caused to follow the direction of movement of the conveying surface 82*a* and change its direction to that of the conveyor belt 82.

The third embodiment is not limited to that shown in FIG. 10 as long as the conveyor belt can be deformed in such a manner that the sheet conveying apparatus 5 operates sufficiently quietly. For example, among the two substantially linear belt moving surfaces of the conveyor belt 82 stretched around the pair of pulleys 83, 84 spaced apart in a predetermined manner, the tension roller 85 is not limited to being provided on the linear surface opposite to the conveying side of the conveyor belt 82, i.e., the side not facing the first conveying unit 6. The tension roller 85 can be provided on the belt moving surface facing the first conveying unit 6. That is, regardless of the rigidity of the sheet S in its thickness direction, the trailing edge of the sheet S always contacts substantially the same position of the belt conveying surface. Accordingly, the tension roller 85 is to be arranged in contact with the conveyor belt 82 at a position sufficiently spaced apart from where the trailing edge of the sheet S contacts the belt conveying surface so as to allow the belt to deform.

In the third embodiment, the tension roller 85 is arranged at a position defined as above to apply a pressing force from inside to stretch the belt outward. Conversely, the tension roller 85 can be arranged so as to apply a pressing force from outside the belt to stretch the belt inward.

In such a configuration, the tension roller 85 can also have a function of cleaning the circumferential surface of the belt in addition to the function of applying tension to the belt. With such a tension roller having functions of both applying pressure to the belt and cleaning the belt conveying surface, the belt conveying surface can be maintained in a clean condition, which may improve the image quality. Furthermore, at a position defined as above, both a tension roller and a cleaning roller can be provided separately, or only a cleaning roller that primarily functions as a cleaning unit and does not primarily function as a tensioning unit can be provided.

As described above, the conveyor belt 82 of the sheet conveying apparatus 5 described with reference to FIGS. 1-4 and FIGS. 7-10 has a width in a sheet width direction Y that is at least substantially equal to the width of a maximum-size sheet to be conveyed. That is, the belt width of the conveyor belt 82 extends across the entire width of the sheet, so as to be substantially equal to or wider than the width of a maximum-size sheet to be conveyed. The pulleys 83, 84 around which the conveyor belt 82 is stretched and the grip roller 81 facing/contacting the conveyor belt 82 extends across the entire width of the sheet, in such a manner that their sizes in the sheet width direction Y (axial lengthwise direction) are equal to or larger than the aforementioned width of the conveyor belt 82. Hence, it is ensured that the entire width of the sheet S sent out from the first conveying unit 6 contacts the conveyor belt 82, so that the contact area therebetween can be maximized. Accordingly, it is possible to maximize the conveying/propelling force for conveying the sheet S in the conveying direction, which force is constantly transmitted to the sheet S from the conveyor belt 82 moving in the sheet conveying direction. Next, a fourth embodiment according to the present invention is described below.

Fourth Embodiment

Figure 11:
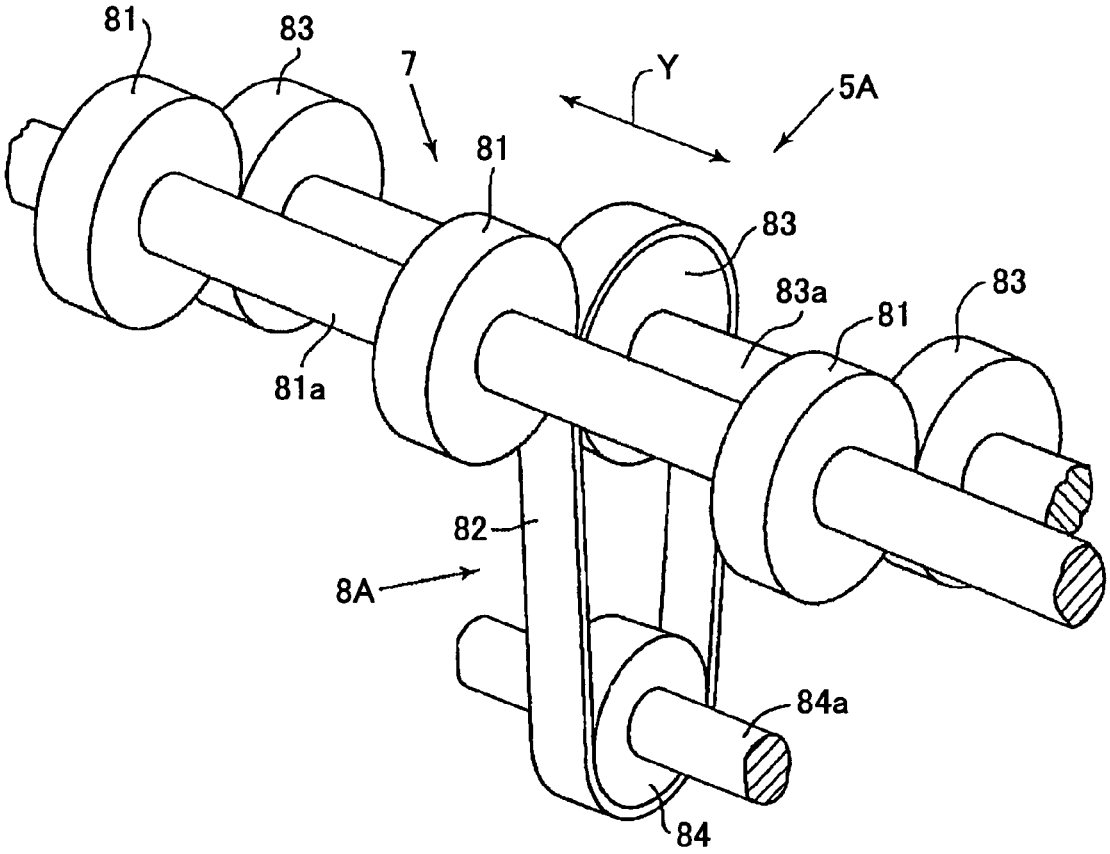
FIG. 11 is a perspective view of relevant parts around grip rollers and a belt conveying unit of a sheet conveying apparatus according to a fourth embodiment of the present invention.

A sheet conveying apparatus 5A according to the fourth embodiment of the present invention is described with reference to FIGS. 11, 23, and 24. FIGS. 23 and 24 schematically illustrate the driving mechanism 22 acting as a sheet feeding driving unit (sheet feeding driving system) of the first conveying unit 6 and the second conveying unit 7 in the sheet conveying apparatus 5A according to the fourth embodiment. FIGS. 11 and 24 illustrate the surroundings of a belt conveying unit 8A of the second conveying unit 7 in the sheet conveying apparatus 5A according to the fourth embodiment.

The primary differences between the sheet conveying apparatus 5 shown in FIGS. 1-4 and 7-10 and the sheet conveying apparatus 5A are as follows. In the sheet conveying apparatus 5A, the relationship between the driving member and the subordinately driven member of the second conveying unit 7 acting as a holding/conveying unit is clearly defined. Furthermore, the belt conveying unit 8A is employed instead of the belt conveying unit 8. Elements of the belt conveying unit 8A including the conveyor belt 82 are arranged in a discontinuous manner (i.e., in a spaced-apart manner) along the sheet width direction Y so as to contact parts of the sheet S in the sheet width direction Y (i.e., not in contact with the entire sheet width). Apart from these differences, the sheet conveying apparatus 5A according to the fourth embodiment is the same as the sheet conveying apparatus 5 shown in FIGS. 1-4 and 7-10.

Specifically, in the second conveying unit 7 of the sheet conveying apparatus 5A, the nip section (the holding section) is formed by a pair of members facing each other, namely, the grip roller 81 and the belt conveying unit 8A. The grip roller 81, which is one of the two members of the pair, functions as a rotating conveying driving unit/rotating conveying driving member that transmits a driving force by rotating. The belt conveying unit 8A (moving/guiding unit) including the conveyor belt 82, which is the other member of the pair, is arranged along the outer side of the sheet conveying path (first conveying path A) formed between the first conveying unit 6 and the second conveying unit 7. The conveyor belt 82 directly contacts the grip roller 81, and is caused to rotate following the rotation of the grip roller 81. The conveyor belt 82 conveys (moves/guides) the sheet S toward the nip section of the second conveying unit 7 while keeping the leading edge of the sheet S in contact with the conveyor belt 82.

The sheet conveying apparatus 5A according to the fourth embodiment is different from the sheet conveying apparatus 5 shown in FIGS. 1-4 and 7-10 as follows. In the sheet conveying apparatus 5 shown in FIGS. 1-4 and 7-10, the width of the conveyor belt 82 is equal to or wider than the width of a maximum-size sheet to be conveyed, and the pulleys 83, 84 and the grip roller 81 are formed across the entire sheet width direction Y so that their sizes are equal to or larger than the aforementioned belt width of the conveyor belt 82. Instead of this configuration, as shown in FIG. 11, in the sheet conveying apparatus 5A according to the fourth embodiment, elements of the belt conveying unit 8A including the conveyor belt 82 are arranged in a discontinuous manner along the sheet width direction Y so as to contact parts of a leading edge section the sheet S in the sheet width direction Y (the leading edge section includes the leading edge, the sheet surface around the leading edge, the corners and edges at the leading edge).

The grip roller 81 includes plural rotating/conveying members fixed/arranged in a discontinuous manner along the rotational driving shaft 81*a* in the sheet width direction Y in a shish-kebab-like structure. Meanwhile, the conveyor belt 82 and the pulleys 83, 84 in the belt conveying unit 8A are arranged facing at least one of the plural grip rollers 81 (forming at least one pair of facing members). Specifically, in the sheet conveying apparatus 5A shown in FIG. 11, there are three grip rollers 81 arranged along the rotational driving shaft 81*a* in the second conveying unit 7 acting as the holding/conveying unit. One conveyor belt 82 is arranged facing the center one of the three grip rollers 81, having a substantially equal width to that of the center grip roller 81. The grip rollers 81 positioned at the outermost edges in the sheet width direction Y are arranged so that their outer edges are within the width of a minimum-sized sheet S (sheet size in the sheet width direction Y) used in the copier 1 provided with the sheet conveying apparatus 5A.

In FIG. 23, as a matter of convenience in describing the driving mechanism 22 of the sheet conveying apparatus 5A, the grip rollers 81 are purposely arranged with irregular intervals in the direction of the rotational driving shaft 81*a*. However, in reality, the grip rollers 81 are equally spaced apart at positions facing the conveyor belts 82 and the pulleys 83, as a matter of course.

As shown in FIG. 23, the driving mechanism 22 primarily includes the following elements: a sheet feeding motor 23 that is a stepping motor acting as the only driving source/driving unit; a motor gear 24 fixed on an output shaft of the sheet feeding motor 23; an idler gear 25 in engagement with the motor gear 24; a feed roller driving gear 61B in engagement with the idler gear 25 and fixed to one end of the shaft 61*a* of the feed roller 61; an idler gear 26 in engagement with the feed roller driving gear 61B; a grip roller driving gear 81A in engagement with the idler gear 26 and fixed to one end of the rotational driving shaft 81*a* of the grip rollers 81; a feed roller gear 61A fixed to the other end of the shaft 61*a* near the feed roller 61; an idler gear 65 in engagement with the feed roller gear 61A; and a pickup roller gear 60A in engagement with the idler gear 65 and fixed to the other end of the shaft 60*a* near the pickup roller 60. The sheet feeding motor 23 is fixed to the housing 80. The idler gears 25, 26, and 65 are rotatably supported by the housing 80.

As described above, the sheet conveying apparatus 5A according to the fourth embodiment is configured to be compact and space-saving by making the first conveying path A have a curvature section of a relatively small curvature radius as described in the first practical example, etc. The sheet feeding motor 23 is the only driving source provided for driving both the first conveying unit 6 and the second conveying unit 7, which also contributes in reducing the size of the device.

The reverse roller 62 is driven by a different system including, for example, a solenoid for releasing pressure from the feed roller 61. In FIG. 23, 62*b* denotes the torque limiter described as not being shown in FIGS. 1-4.

In the example shown in FIGS. 1-4, the rotating/driving relationship between the pickup roller 60 and the feed roller 61 is described only briefly. In reality, as shown in an enlarged view of FIG. 24, the respective shafts 60*a*, 61*a* of the pickup roller 60 and the feed roller 61 are connected by a pickup arm member 64. Accordingly, for the pickup action, a not shown combination of a solenoid and a spring causes the pickup roller 60 to pivot/move about the shaft 61*a* of the feed roller 61 via the pickup arm member 64.

In the actual driving mechanism 22, there are many driving force transmitting members such as gears and timing belts arranged between the sheet feeding motor 23 and the feed roller 61. However, the example of the driving mechanism 22 is shown only schematically in FIGS. 23, 24 for the sake of clearly indicating that the grip rollers 81 function as rotating conveying driving members.

As a matter of course, the driving mechanism 22 is also applicable to the sheet conveying apparatus 5 described with reference to FIGS. 1-4 and FIGS. 7-10 and embodiments and modification examples thereof described subsequently. Moreover, the copier 1 according to the first embodiment employs a driving mechanism that is practically the same as the driving mechanism 22.

If the effects described above are not particularly desired, the driving system for driving the grip roller 81 can be removed from the driving mechanism 22 to make the grip roller 81 act as the subordinate side, and the conveyor belt 82 can be driven by a not shown driving mechanism.

In the fourth embodiment shown in FIG. 11, the conveyor belt 82 of the belt conveying unit 8A is made to face/contact the grip roller 81 at the center position in the lengthwise direction of the pulley shaft 83*a* (axial direction). Subordinate rollers that are substantially the same as the roller-type pulley 83 are made to face/contact the grip rollers 81 on both sides of the center grip roller 81. However, the present invention is not limited thereto. A subordinate roller can be made to face/contact the grip roller 81 in the center, and two conveyor belts 82 of the belt conveying unit 8A can be made to face/contact the grip rollers 81 on both sides of the center grip roller 81.

First Modification Example

Figure 12:
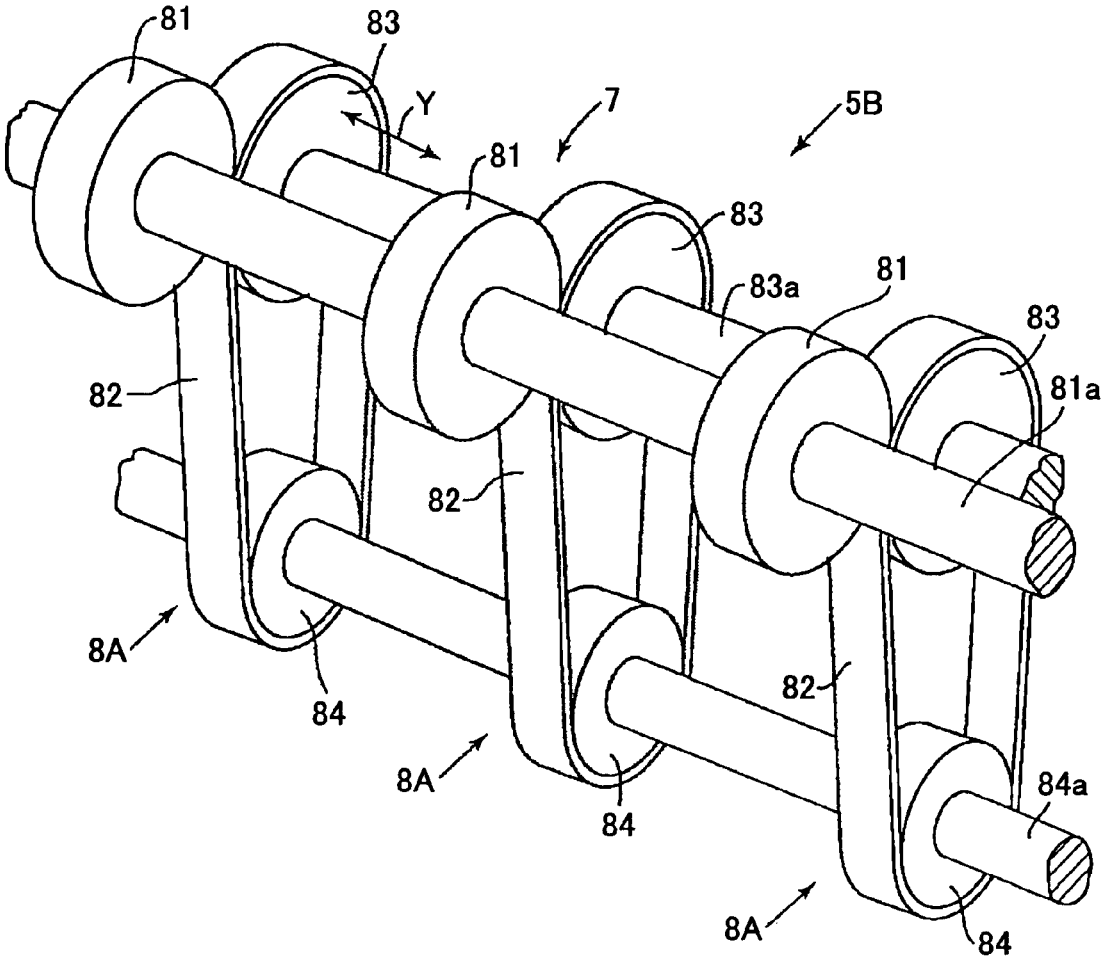
FIG. 12 is a perspective view of relevant parts around grip rollers and belt conveying units of a sheet conveying apparatus according to a first modification example.

FIG. 12 illustrates a first modification example of the fourth embodiment. The first modification example is different from the sheet conveying apparatus 5A according to the fourth embodiment shown in FIGS. 11, 23, and 24 as follows. That is, in a sheet conveying apparatus 5B according to the first modification example, there are conveyor belts 82 provided for all of the pairs of members facing each other in the holding/conveying units of the second conveying unit 7. More specifically, three conveyor belts 82 are facing three of the grip rollers 81 arranged with substantially the same intervals therebetween. Each of the three conveyor belts 82 of the belt conveying units 8A is movably held/arranged in the same manner by the pulleys 83, 84 fixed to the pulley shafts 83*a*, 84*a*, respectively, facing each of the three grip rollers 81. Apart from these differences, the sheet conveying apparatus 5B according to the first modification example is the same as the sheet conveying apparatus 5A shown in FIGS. 11, 23, and 24.

Thus, based on the fourth embodiment and the first modification example, a user can select any one of the sheet conveying apparatuses 5, 5A, or 5B according to the user's requirements by comparing performance and cost. As a matter of course, in terms of cost, the sheet conveying apparatus 5 including the conveyor belt 82 covering the entire widthwise direction is most expensive, while the sheet conveying apparatus 5A including only one conveyor belt 82 covering one part in the widthwise direction is most inexpensive, and the sheet conveying apparatus 5B including three conveyor belts 82 covering three parts in the widthwise direction is second most inexpensive. Maximum performance can be attained by the sheet conveying apparatus 5 including the conveyor belt 82 covering the entire widthwise direction, and a user can select any one of the sheet conveying apparatuses 5, 5A, or 5B according to the user's requirements by comparing performance and cost.

In addition, the conveyor belt 82 of the belt conveying unit 8A according to the fourth embodiment and the first modification example is pressed against the grip roller 81 that drives the pulley 83 by a pressing force of a not shown spring, so as to directly contact the grip roller 81. Therefore, the conveyor belt 82 is caused to rotate following the rotation of the grip roller 81, which is rotated by the driving mechanism 22. Irregularities in the linear speed of the conveyor belt 82 can be reduced more by driving the grip roller 81, compared to the case where the conveyor belt 82 is driven. Therefore, the following advantages can be achieved by arranging the conveyor belt 82 along the outer side of the turning (curving) section of the first conveying path A, which conveyor belt 82 rotates toward the holding section of the second conveying unit 7. That is, it is possible to enhance sheet conveying properties for conveying relatively rigid sheets such as cardboard at the turning section of the first conveying path A. Furthermore, by causing the conveyor belt 82 to rotate following the rotation of the grip roller 81 facing/directly contacting the conveyor belt 82, the sheet S can be conveyed at a steady linear speed beyond the second conveying unit 7.

These advantages/effects are easily understandable by considering the following technology. By driving the grip roller 81, the linear speed of the grip roller 81 is determined by the outside diameter of the grip roller 81 and the rotational speed. Conversely, in order to drive the conveyor belt 82, it is usually necessary to drive the roller-type pulley 83 (belt driving roller, main pulley) provided inside the conveyor belt 82.

In this case, the linear speed of the conveyor belt 82 is determined not only by the outside diameter and the rotational speed of the pulley 83 provided inside the conveyor belt 82. The linear speed is also affected by irregularities in the thickness of the conveyor belt 82 caused by irregularities in components, changes of the thickness of the conveyor belt 82 caused by attrition, or slipping actions between the conveyor belt 82 and the pulley 83. Therefore, irregularities in the linear speed of the conveyor belt 82 can be reduced more by driving the grip roller 81 rather than driving the conveyor belt 82.

In the first modification example shown in FIG. 12, the conveyor belts 82 of the belt conveying unit 8A are provided on the pulley shaft 83*a* to face/contact all of the grip rollers 81 in the lengthwise direction (axial direction). However, the present invention is not limited thereto. There can be no conveyor belts 82 facing the grip rollers 81 on both edges in the lengthwise direction of the pulley shaft 83*a* (the number of grip rollers 81 does not need to match the number of the belt conveying units 8A or subordinate rollers with substantially the same configuration as the roller-type pulleys 83).

In this case, the pulleys 83 of all belt conveying units 8A are fixed to the pulley shaft 83*a*. Accordingly, when the pulley 83 of the center belt conveying unit 8A is caused to rotate following the rotation of the grip roller 81 via the conveyor belt 82 of the center belt conveying unit 8A, the other belt conveying units 8A on both edges, which are not facing/contacting the grip roller 81, are also caused to rotate.

Figure 25A:
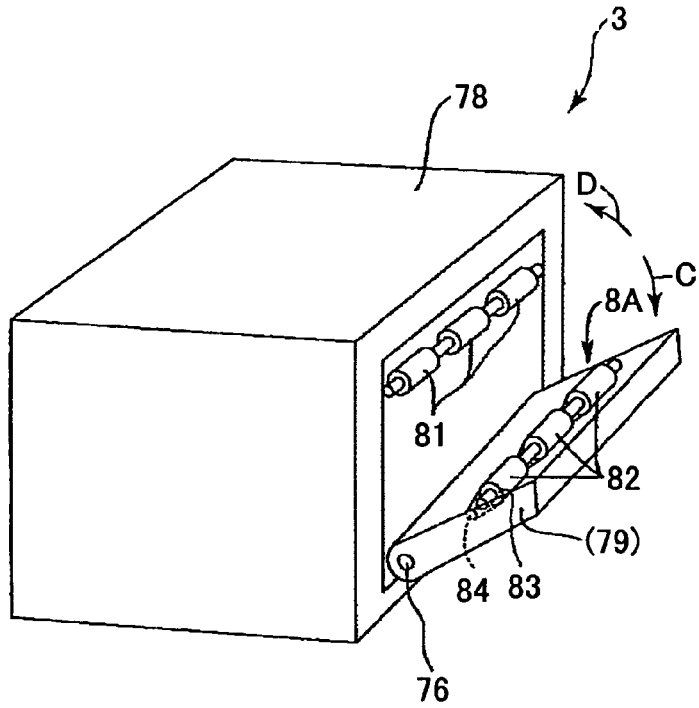
FIG. 25A is a schematic perspective view of an opening/closing configuration on the sheet feeding device main unit according to the second modification example and FIG. 25B is a schematic sectional view of relevant parts where an opening/closing guide is in an open status for removing a paper jam.
Figure 25B:
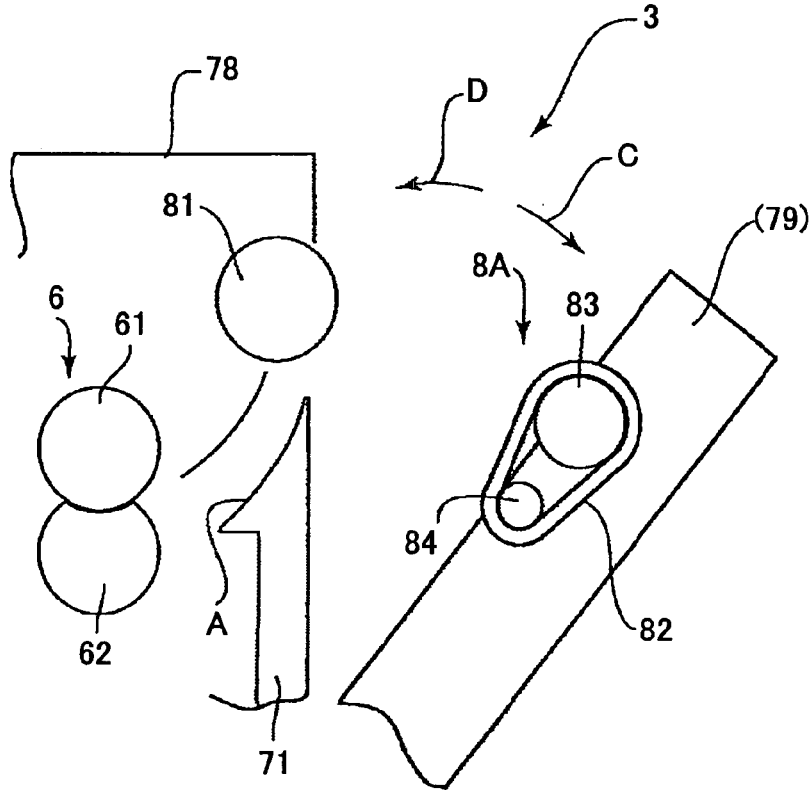

Although the following diagrams are out of sequence, as shown in FIGS. 25A, 25B, similarly to typical conventional sheet feeding devices, in the main unit of the sheet feeding device 3, the second conveying path B can be divided. Specifically, the opening/closing guide (79) acting as an opening/closing unit can freely open and close in directions indicated by arrows C, D in FIGS. 25A, 25B. The opening/closing guide (79) opens and closes with respect to a device body 78 accommodating the housing 80, etc., shown in FIGS. 7-10, by pivoting about a fulcrum shaft hinge 76 provided at the bottom of the device body 78. With such an opening/closing configuration, it is possible to remove sheets caught in the sheet feeding device 3 (paper jam).

Second Modification Example

Figure 13:
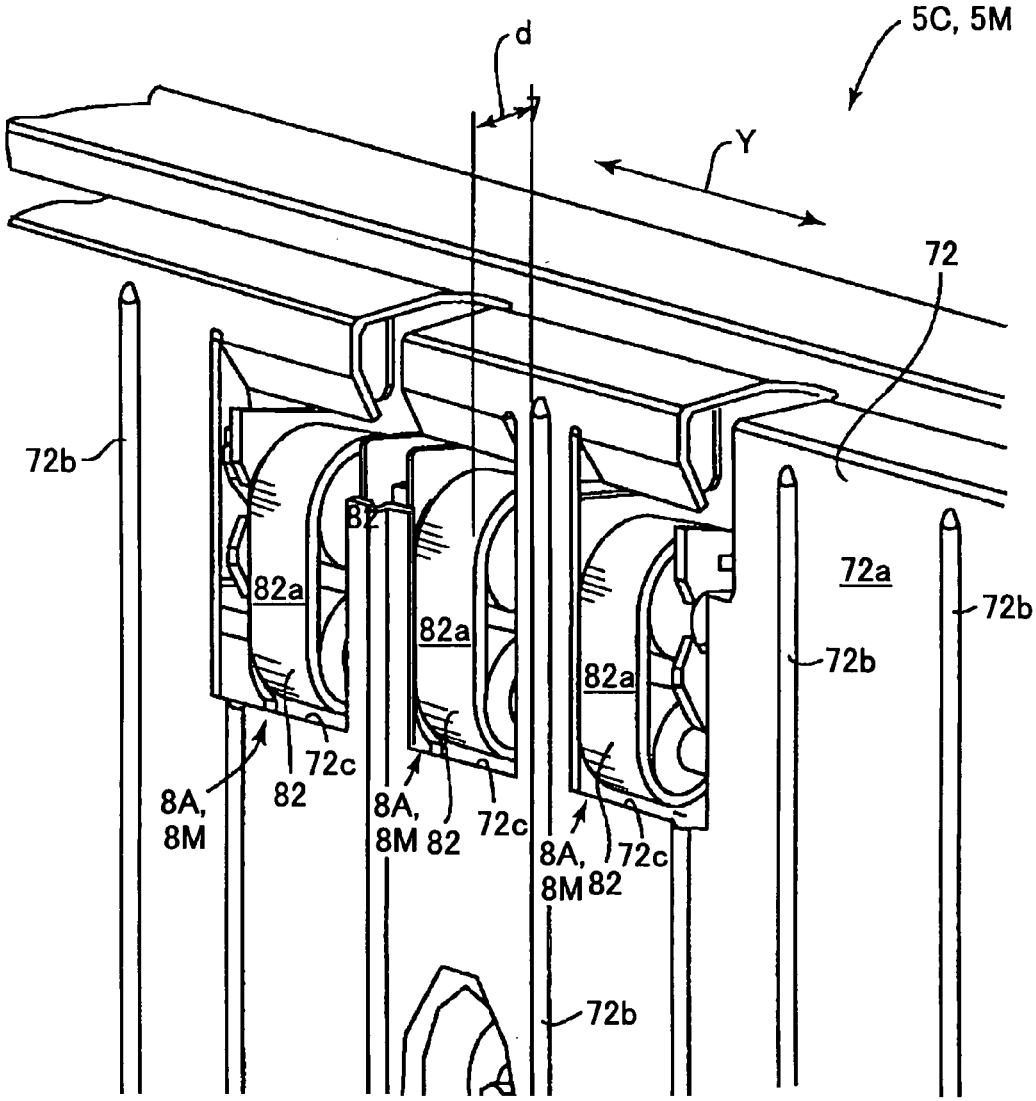
FIG. 13 is a perspective view of relevant parts around belt conveying units and a conveying guiding member of a sheet conveying apparatus according to a second modification example and a sixth embodiment of the present invention.
Figure 14:
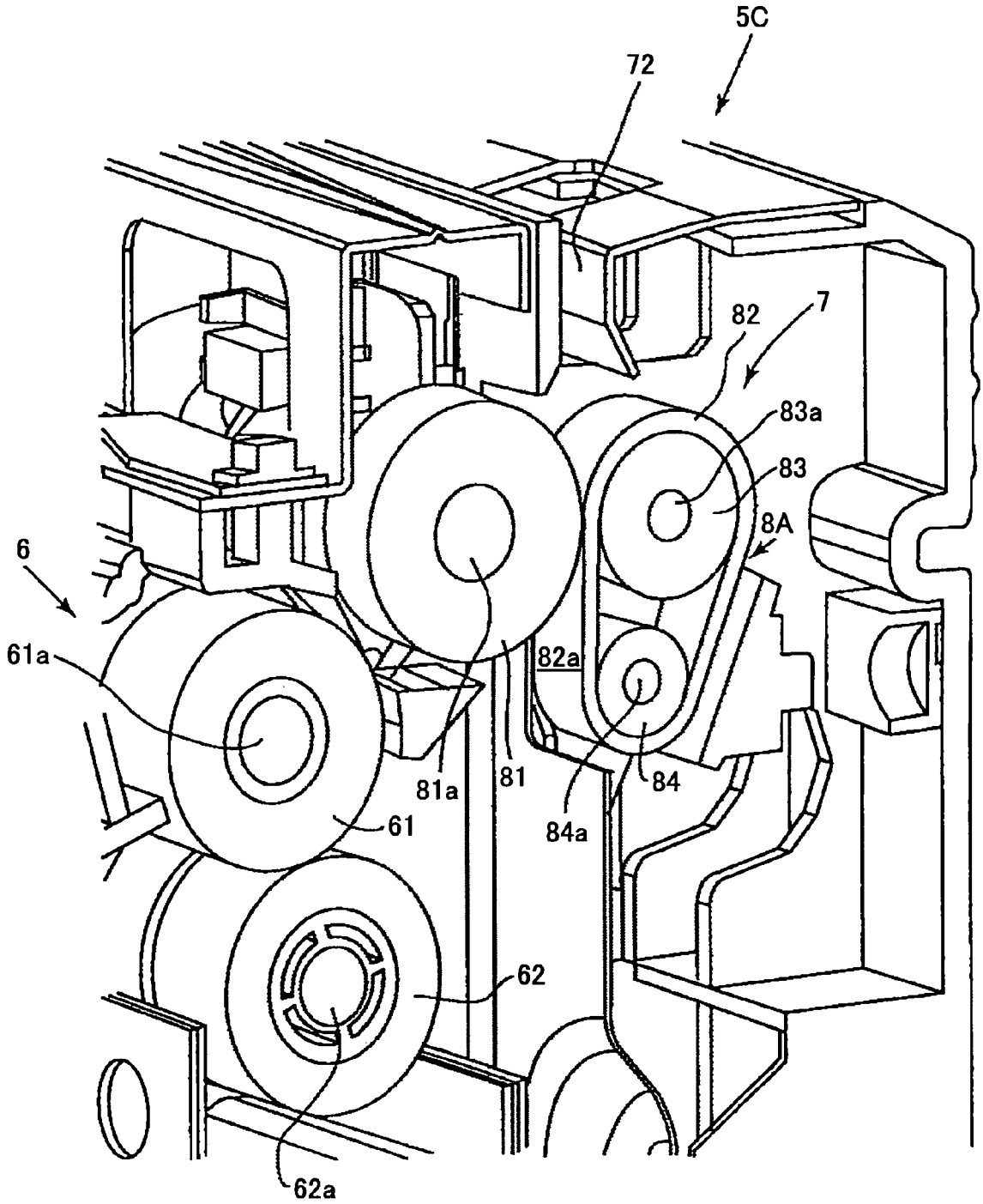
FIG. 14 is a perspective view of relevant parts around first and second conveying units of the sheet conveying apparatus according to the second modification example.

FIGS. 13, 14 illustrate a second modification example of the fourth embodiment. The second modification example is different from the sheet conveying apparatus 5B according to the first modification example shown in FIG. 12 as follows. That is, a sheet conveying apparatus 5C is employed instead of the sheet conveying apparatus 5B. As shown in FIGS. 13, 14, in the sheet conveying apparatus 5C, the conveying surface 82*a*, which is where the sheet S contacts the conveyor belt 82, protrudes out from the vertical conveying guide surface 72*a* of the conveying guiding member 72 inward into the conveying path. Apart from these differences, the sheet conveying apparatus 5C of the second modification example is the same as the sheet conveying apparatus 5B. The inside of the conveying path refers to the middle portion of the conveying path (the same applies to other examples).

As illustrated in detail in FIG. 13, in the sheet width direction Y, on the vertical conveying guide surface 72*a* of the conveying guiding member 72 other than where the conveyor belts 82 are arranged, there are conveying guide ribs 72*b* protruding inward into the sheet conveying path (the sheet conveying path extending vertically upward continuing from the second conveying path B). The conveying guide ribs 72*b* reinforce and maintain the shape of the conveying guiding member 72. The conveying surfaces 82*a* protrude inward into the conveying path by a predetermined protruding amount d (corresponding to step height/size) so that the portion of the conveyor belt 82 stretched around the pulleys 83, 84 forming a vertical surface slightly protrudes out from the conveying guide ribs 72*b*. With such a configuration, when the sheet S, particularly a cardboard sheet (relatively rigid sheet), is conveyed from the first conveying unit 6 shown in FIG. 24, etc., the sheet S can be elastically deformed in a direction toward the right side as viewed in FIG. 24 so that the leading edge of the cardboard sheet can be gripped/held and conveyed to the nip section of the second conveying unit 7. The conveying guide ribs 72*b* are arranged with predetermined intervals therebetween in the sheet width direction Y so as to achieve the advantages/effects described below. In FIG. 13, 72*c* denotes openings in the conveying guiding member 72 designed to expose the conveyor belt 82 of the belt conveying unit 8A in the inside (middle portion) of the sheet conveying path.

In the sheet conveying apparatus 5 described with reference to FIGS. 1-4 and FIGS. 7-10, the conveyor belt 82 contacts the entire width of the sheet to convey the sheet. However, the sheet conveying apparatuses 5A, 5B according to the fourth embodiment and the first modification example only contact part of the sheet, and thus have less conveying force. However, in the sheet conveying apparatus 5C of the second modification example, a step height d is provided between the conveying surface 82*a* of the conveyor belt 82 and the conveying guide ribs 72*b* provided in the sheet width direction Y. Accordingly, it is possible to minimize a rubbing action between the conveying guide ribs 72*b* and the sheet S. As a result, the conveying device 5C can have a conveying force that is substantially equal to that of the sheet conveying apparatus 5.

If it is not particularly desired to have a conveying force that is substantially equal to that of the conveying device 5, the step height d can be made smaller or level with the conveying guide ribs 72*b*. If there are no conveying guide ribs 72*b* provided on the conveying guiding member 72, the step height d can be level with the vertical conveying guide surface 72*a*.

As a matter of course, characteristics of the second modification example are applicable to the fourth embodiment, the first modification example, and a fifth embodiment and modification examples thereof described below.

According to the second modification example, the conveying surface 82*a*, which is where the sheet S contacts the conveyor belt 82, protrudes out from the vertical conveying guide surface 72*a* of the conveying guiding member 72, inward into the conveying path, or the conveying surface 82*a* is substantially level with the vertical conveying guide surface 72*a*. Therefore, although the conveyor belt 82 of the sheet conveying apparatus 5C is narrow and thus low-cost compared to the wide conveyor belt 82 of the sheet conveying apparatus 5, the sheet conveying apparatus 5C can have sheet conveying properties that are equal to that of the sheet conveying apparatus 5.

Third Modification Example

Figure 15:
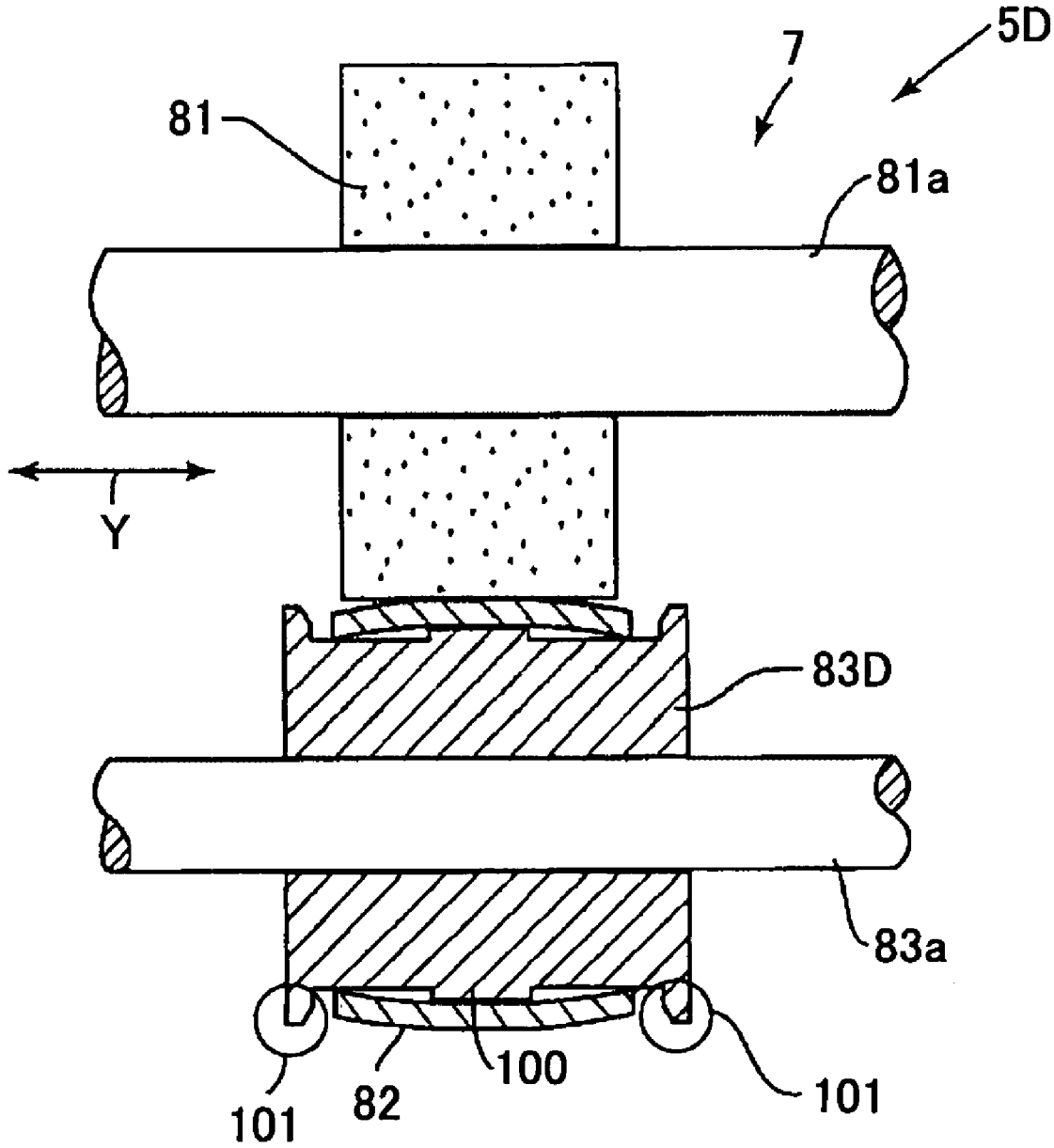
FIG. 15 is a plan sectional view of relevant parts illustrating positional relationships between a grip roller, a conveyor belt, and a pulley of a sheet conveying apparatus according to a third modification example.

FIG. 15 illustrates a third modification example of the fourth embodiment. A sheet conveying apparatus 5D according to the third modification example is different from the sheet conveying apparatus 5A according to the fourth embodiment shown in FIG. 11 as follows. That is, the sheet conveying apparatus 5D includes a pulley 83D instead of the pulley 83. As shown in FIG. 15, the pulley 83D has a ring-shaped protrusion 100 integrally formed therewith, extending substantially around the center of its circumferential surface. The pulley 83D also has flanges 101 protruding from its circumferential surface in the radial direction. The belt width of the conveyor belt 82 in the sheet width direction Y and the pulley width of the pulley 83D are wider than the roller width of the grip roller 81 in the sheet width direction Y. Apart from these differences, the sheet conveying apparatus 5D according to the third modification example is the same as the sheet conveying apparatus 5A.

In the sheet conveying apparatus 5A shown in FIG. 11, the conveyor belt 82 has a substantially equal width to that of the narrow grip roller 81. In such a configuration, it is necessary to prevent the conveyor belt 82 from meandering so that the conveyor belt 82 properly faces the grip roller 81 and is properly held between the grip roller 81 and the pulley 83. Accordingly, in the third modification example, the protrusion 100 is integrally formed along the circumferential surface of the pulley 83D, so that a self-centering effect is applied on the conveyor belt 82. Accordingly, the conveyor belt 82 can be rotated without meandering.

As shown in FIG. 15, even if only the pulley 83D facing the grip roller 81 has a self-centering function and the bottom pulley 84 has a substantially planar circumferential surface without the self-centering function, tests have proved that a self-centering effect can still be applied on the conveyor belt 82.

According to the third modification example, the pulley 83D that movably holds the conveyor belt 82 of the belt conveying unit 8A is provided with the above-described self-centering function for stabilizing the movement of the conveyor belt 82. Therefore, the conveyor belt 82 is prevented from swaying and sheet conveyance is steadily performed. Furthermore, even when a user accidentally touches the conveyor belt 82 while removing a paper jam, the flanges 101 hold the conveyor belt 82 in place, so that the conveyor belt 82 is prevented from coming off the pulley 83D. This configuration realizes a highly reliable sheet conveying apparatus 5D that ensures that the conveyor belt 82 does not come off.

As described above, the conveyor belt 82 is prevented from coming off the pulley 83D with the centering effect of the pulley 83D, and therefore, in the third modification example, the flanges 101 are not essential and can be omitted.

If costs allow, the bottom pulley 84 can also be provided with the same centering function as that of the pulley 83D, so as to further ensure that the conveyor belt 82 is prevented from coming off.

As a matter of course, characteristics of the pulley 83D according to the third modification example are applicable to the fourth embodiment, the first and second modification examples, and the fifth embodiment and modification examples thereof described below.

Fourth Modification Example

Figure 16:
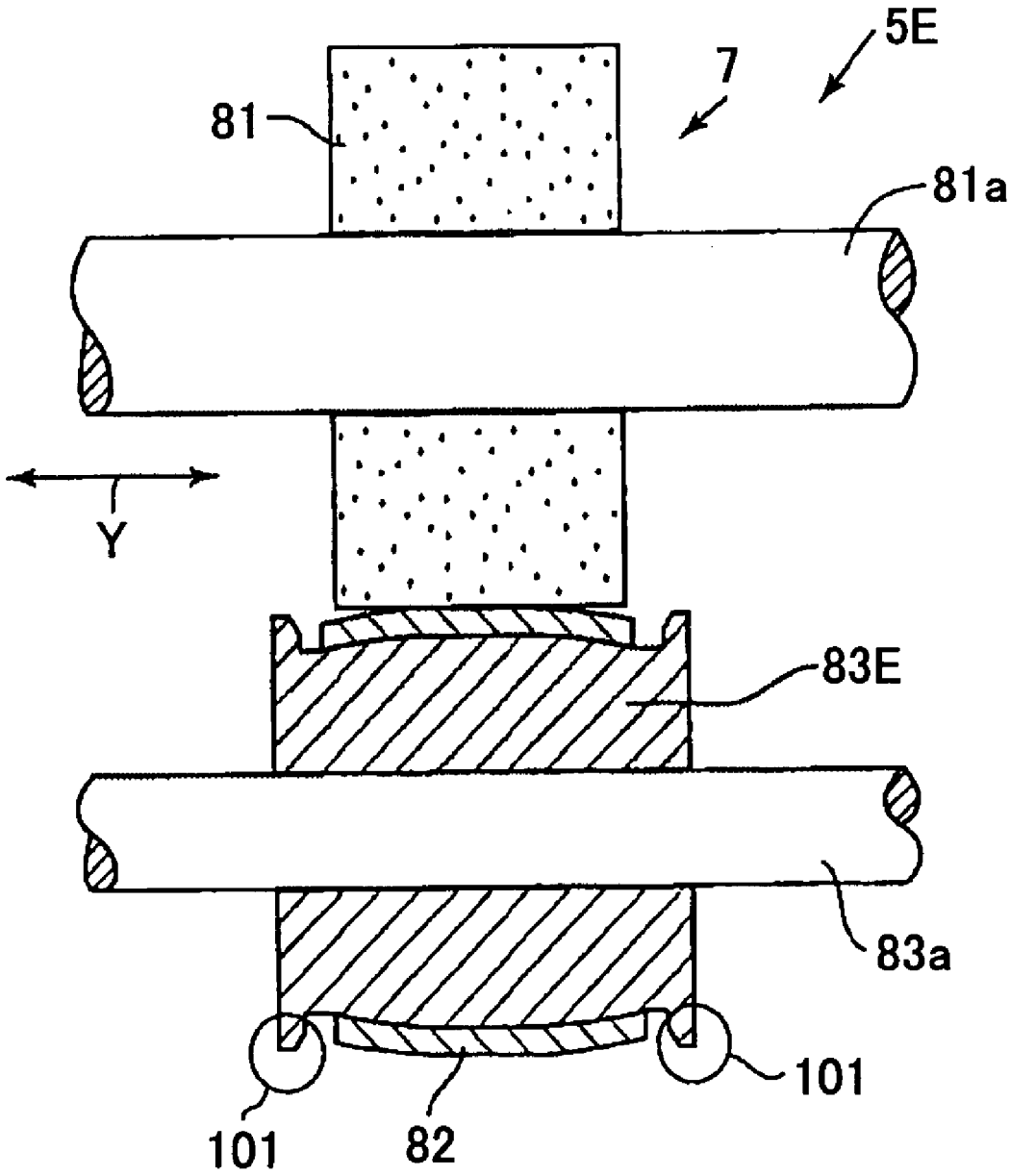
FIG. 16 is a plan sectional view of relevant parts illustrating positional relationships between a grip roller, a conveyor belt, and a pulley of a sheet conveying apparatus according to a fourth modification example.

FIG. 16 illustrates a fourth modification example of the fourth embodiment. A sheet conveying apparatus 5E according to the fourth modification example is different from the sheet conveying apparatus 5A according to the fourth embodiment shown in FIG. 11 as follows. That is, the sheet conveying apparatus 5E includes a pulley 83E instead of the pulley 83. As shown in FIG. 16, the pulley 83E is a crowned pulley having an arc-shaped circumferential surface with a high central portion therearound, and has the flanges 101 protruding from its circumferential surface in the radial direction. The belt width of the conveyor belt 82 in the sheet width direction Y and the pulley width of the pulley 83E are wider that the roller width of the grip roller 81 in the sheet width direction Y. Apart from these differences, the sheet conveying apparatus 5E according to the fourth modification example is the same as the sheet conveying apparatus 5A.

In the sheet conveying apparatus 5A shown in FIG. 11, the conveyor belt 82 has a substantially equal width to that of the narrow grip roller 81. In such a configuration, it is necessary to prevent the conveyor belt 82 from meandering so that the conveyor belt 82 properly faces the grip roller 81 and is properly held between the grip roller 81 and the pulley 83. Accordingly, in the fourth modification example, the pulley 83E is a crowned pulley having an arc-shaped circumferential surface (arc-shaped body), applying a self-centering effect on the conveyor belt 82. Accordingly, the conveyor belt 82 can be rotated without meandering.

As shown in FIG. 16, similar to the third modification example, even if only the pulley 83E facing the grip roller 81 has a self-centering function and the bottom pulley 84 has a substantially planar circumferential surface without the self-centering function, tests have proved that a self-centering effect can still be applied on the conveyor belt 82.

According to the fourth modification example, the pulley 83E that movably holds the conveyor belt 82 of the belt conveying unit 8A is provided with the above-described self-centering function for stabilizing the movement of the conveyor belt 82. Therefore, the conveyor belt 82 is prevented from swaying and sheet conveyance is steadily performed. Furthermore, even when a user accidentally touches the conveyor belt 82 while removing a paper jam, the flanges 101 hold the conveyor belt 82 in place, so that the conveyor belt 82 is prevented from coming off the pulley 83E. This configuration realizes a highly reliable sheet conveying apparatus 5E that ensures that the conveyor belt 82 does not come off.

As described above, the conveyor belt 82 is prevented from coming off the pulley 83E with the centering effect of the pulley 83E, and therefore, in the fourth modification example, the flanges 101 are not essential and can be omitted.

If costs allow, the bottom pulley 84 can also be provided with the same centering function as that of the pulley 83E, so as to further ensure that the conveyor belt 82 is prevented from coming off.

As a matter of course, characteristics of the pulley 83E according to the fourth modification example are applicable to the fourth embodiment, the first and second modification examples, and the fifth embodiment and modification examples thereof described below.

Fifth Modification Example

Figure 17:
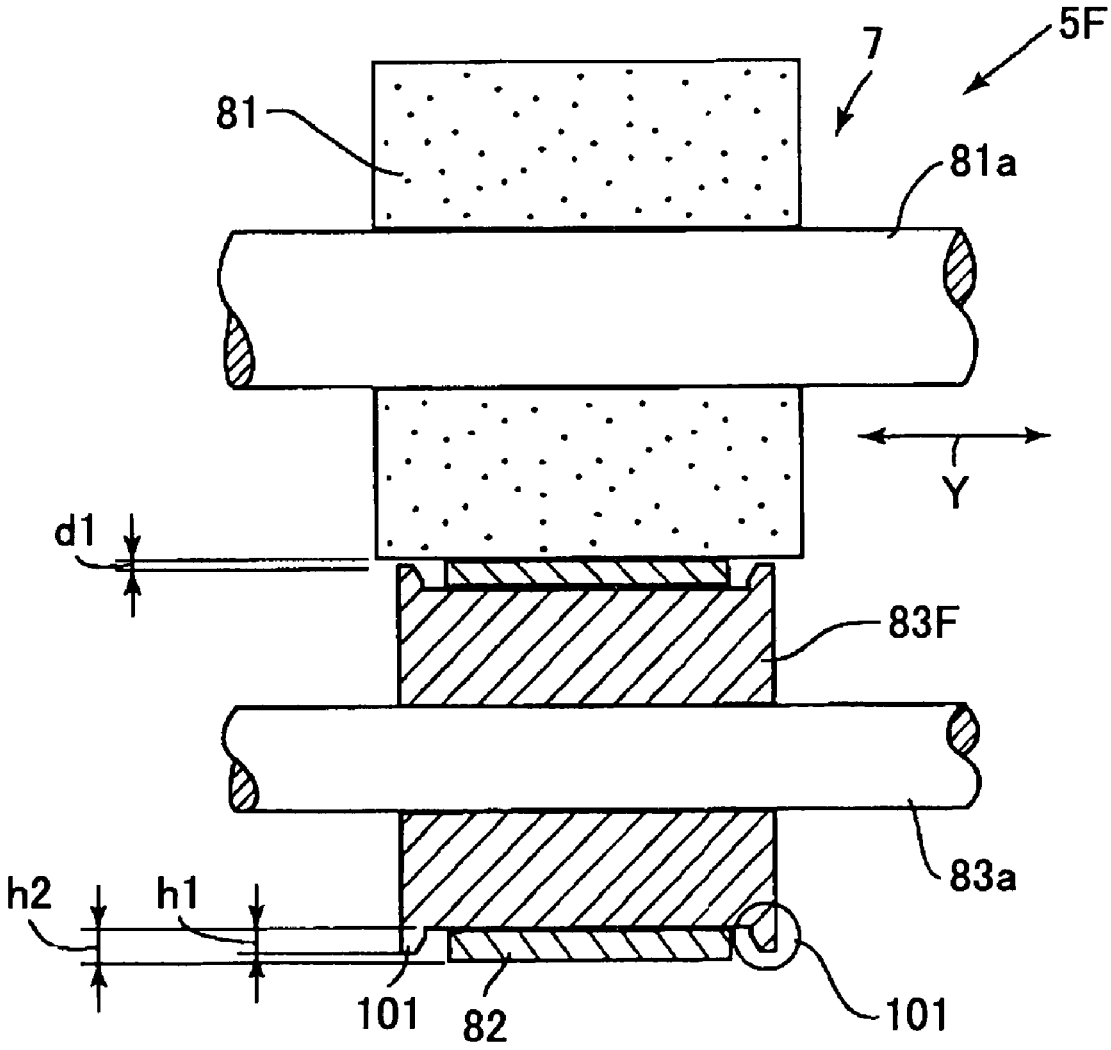
FIG. 17 is a plan sectional view of relevant parts illustrating positional relationships between a grip roller, a conveyor belt, and a pulley of a sheet conveying apparatus according to a fifth modification example and a sixth modification example.

FIG. 17 illustrates the fifth modification example of the fourth embodiment. A sheet conveying apparatus 5F according to the fifth modification example is different from the sheet conveying apparatus 5A according to the fourth embodiment shown in FIG. 11 as follows. That is, the sheet conveying apparatus 5F includes a pulley 83F instead of the pulley 83. As shown in FIG. 17, the belt width of the conveyor belt 82 in the sheet width direction Y and the pulley width of the pulley 83F are shorter than the roller width of the grip roller 81 in the sheet width direction Y. Furthermore, the flanges 101 are integrally formed on both rims of the pulley 83F. The heights of the flanges 101 are lower than the thickness/height of the conveyor belt 82.

More specifically, the roller width of the grip roller 81 is wider than that of the pulley 83F. A height h1 of the flanges 101 formed integrally on the pulley 83F is lower than a height h2 of the thickness/height of the conveyor belt 82. Therefore, there is a gap having a gap size d1 between the grip roller 81 and the flanges 101. As h2>h1>d1 is satisfied, the conveyor belt 82 is prevented from coming off. Furthermore, the flanges 101 do not interfere with the sheet S, so that the sheet S is prevented from being damaged and desirable sheet conveying properties can be maintained.

According to the fifth modification example, the belt width of the conveyor belt 82 in the sheet width direction Y and the width of the pulley 83F are shorter than the roller width of the grip roller 81 in the sheet width direction Y. Furthermore, the height h1 of the flanges 101 formed integrally on the pulley 83F, which pulley 83F movably holds the conveyor belt 82, is lower than the thickness/height h2 of the conveyor belt 82. Therefore, the flanges 101 of the pulley 83F are prevented from contacting the sheet S so that the sheet S is prevented from being damaged and the conveyor belt 82 is prevented from coming off. Accordingly, a highly reliable sheet conveying apparatus 5F can be realized.

Similarly to the third and fourth modification examples, even if the bottom pulley 84 has a substantially planar circumferential surface, tests have proved that the above-described effects and effects described subsequently can be achieved in the fifth modification example and also in sixth and seventh modification examples described below.

Sixth Modification Example

The sheet conveying apparatus according to the fourth embodiment is not limited to the sheet conveying apparatus 5F including the pulley 83F shown in FIG. 17; a sheet conveying apparatus according to the sixth modification example includes a pulley (not illustrated in diagrams) formed by removing the following configuration from the pulley 83F. That is, the pulley according to the sixth modification example excludes the condition that the height h1 of the flanges 101 of the pulley 83F holding the conveyor belt 82 is less than the thickness/height h2 of the conveyor belt 82.

Similar to the pulley 83F according to the fifth modification example, the roller width of the grip roller 81 is wider than the pulley according to the sixth modification example. This pulley does not have a protrusion around its body and does not have an entirely arc-shaped body for applying the self-centering effect on the conveyor belt 82. However, the conveyor belt 82 is held between the flanges 101 of this pulley and the grip roller 81, thus ensuring that the conveyor belt 82 does not come off.

According to the sixth modification example, the flanges 101 are provided along both circumferential rims of the pulley that movably holds the conveyor belt 82, and the width of the grip roller 81 facing the pulley is wider than that of the pulley. The conveyor belt 82 is held between (completely surrounded by) the flanges 101 of the pulley and the circumferential surface of the grip roller 81, thus further ensuring that the conveyor belt 82 does not come off compared to the self-centering function of the third and fourth modification examples. Accordingly, an even more highly reliable sheet conveying apparatus can be realized.

Seventh Modification Example

Figure 18:
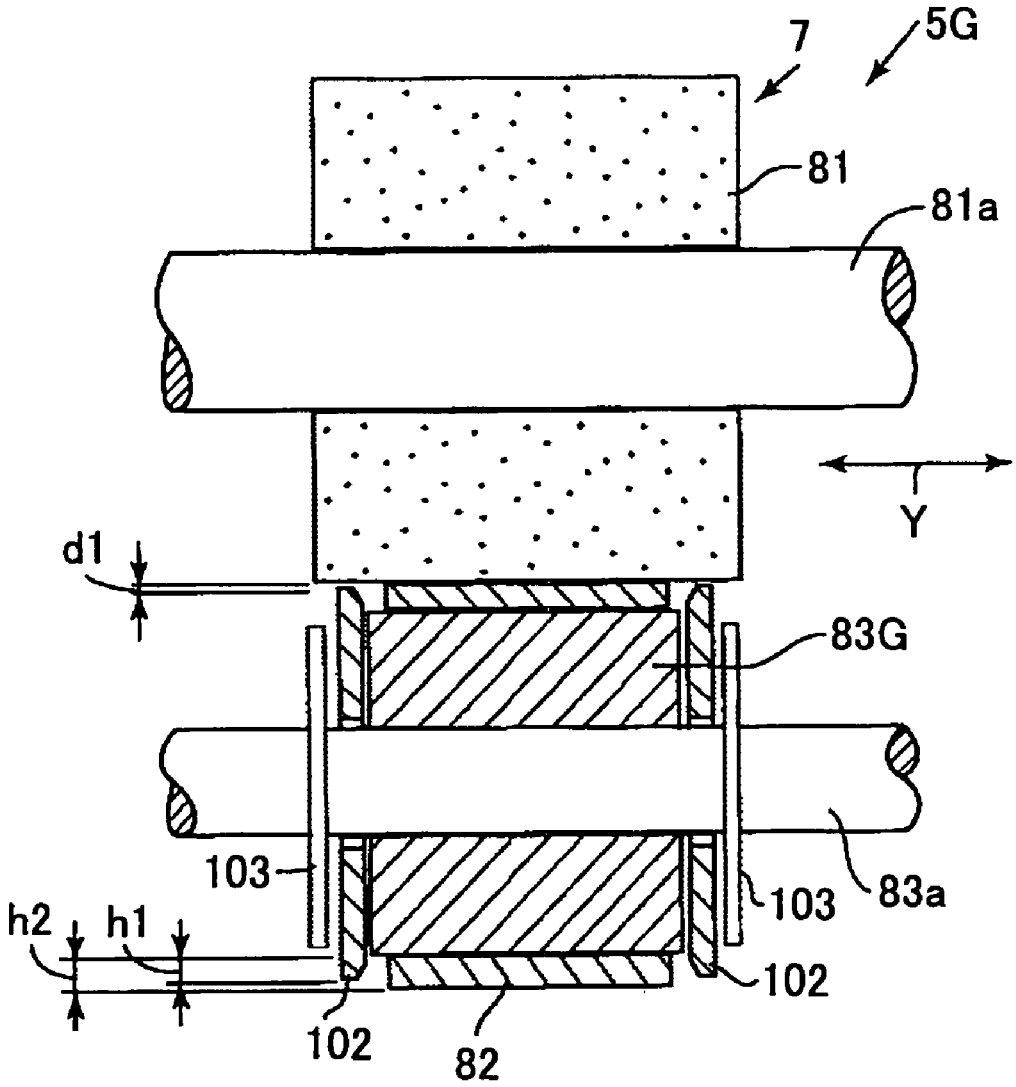
FIG. 18 is a plan sectional view of relevant parts illustrating positional relationships between a grip roller, a conveyor belt, and a pulley of a sheet conveying apparatus according to a seventh modification example.

FIG. 18 illustrates the seventh modification example, which is a modification example of the fifth modification example. A sheet conveying apparatus 5G according to the seventh modification example is different from the sheet conveying apparatus 5F according to the fifth modification example shown in FIG. 17 as follows. That is, the sheet conveying apparatus 5G includes a pulley 83G instead of the pulley 83F. As shown in FIG. 18, the flanges 101 formed on both circumferential rims are omitted from the pulley 83G. Instead, near both side surfaces of the pulley 83G, there are ring-shaped flanges 102 rotatably provided on the pulley shaft 83*a* so as to rotate separately from the pulley 83G. Furthermore, the height of the flanges 102 is less than the thickness/height of the conveyor belt 82.

On both of the outer edge surfaces of the flanges 102, retaining rings 103 are provided on the pulley shaft 83*a* so as to prevent the pulley 83G from moving in the sheet width direction Y.

More specifically, the pulley 83G that is narrower than the roller width of the grip roller 81 in the sheet width direction Y and the flanges 102 are provided separately, and the flanges 102 are rotatably supported on the pulley shaft 83*a*. The circumferential surface of the pulley 83G and the circumferential surface of each of the flanges 102 rotate at different circumferential speeds because they have different radii. However, as they rotate separately from each other on the pulley shaft 83*a*, even if the conveyor belt 82 happens to contact the flanges 102, the conveyor belt 82 is not abraded due to different circumferential speeds, thus further enhancing the reliability.

According to the seventh modification example, the belt width of the conveyor belt 82 in the sheet width direction Y and the width of the pulley 83G are less than the roller width of the grip roller 81 in the sheet width direction Y. Furthermore, the height h1 of the flanges 102 for holding the conveyor belt 82 on the pulley 83G is less than the thickness/height h2 of the conveyor belt 82. Therefore, the flanges 102 are prevented from contacting the sheet S so that the sheet S is prevented from being damaged, and the conveyor belt 82 is prevented from coming off. Furthermore, even if the conveyor belt 82 happens to contact the flanges 102, the conveyor belt 82 is not abraded due to different circumferential speeds. Accordingly, an even more highly reliable sheet conveying apparatus 5G can be realized compared to those of the fifth and sixth modification examples.

Fifth Embodiment

A sheet conveying apparatus 5H according to the fifth embodiment of the present invention is described with reference to FIGS. 19, 20. The sheet conveying apparatus 5H is different from the sheet conveying apparatus 5B shown in FIG. 12 as follows. That is, instead of the belt conveying units 8A with three conveyor belts 82 movably held by three pairs of pulleys 83, 84 fixed on the same pulley shafts 83*a*, 84*a*, respectively, the sheet conveying apparatus 5H employs belt conveying units 8H. There are plural (three in the fifth embodiment) belt conveying units 8H including plural (three in the example shown in FIGS. 19, 20) conveyor belts 82 stretched around three pairs of pulleys 83, 84. The three pairs of pulleys 83, 84 are rotatably supported by separate pulley shafts 83*b*, 84*b*, respectively, arranged in a discontinuous manner along the sheet width direction Y, and are configured to rotate separately from each other. The three pairs of pulleys 83, 84 are made of a resin material such as polyacetal resin. Apart from these differences, the sheet conveying apparatus 5H is the same as the sheet conveying apparatus 5B.

In the sheet conveying apparatus 5H, the three conveyor belts 82 are configured to rotate separately from each other as follows. As shown in FIGS. 19, 20, the sheet conveying apparatus 5H includes three belt conveying units 8H, a shaft supporting member 90 for loosely supporting the pulley shaft 83*b* of the pulley 83 in each of the belt conveying units 8H, and the springs (pressuring springs) 92 acting as forcing units for pressing the backsides of the belt supporting members 86 included in the belt conveying units 8H in such a direction that the conveyor belts 82 constantly contact the grip rollers 81 as shown in FIG. 20.

The difference between the belt conveying units 8A and the belt conveying units 8H is as follows. The belt conveying units 8A employ the pulley shafts 83*a*, 84*a* having long lengths continuously extending in their axial directions, which act as shafts common to all of the belt conveying units 8A. Instead, the belt conveying units 8H employ three separate, metal pulley shafts 83*b*, 84*b* with short lengths in the axial direction. The belt supporting members 86 are provided to axially fix/support the pulley shafts 83*b*, 84*b*.

Each of the belt supporting members 86 is a single component made of a resin material such as polyacetal resin that has good lubricity, abrasion resistance, and durability, and is thus light-weight. On the back wall of each of the belt supporting members 86, a spring stage 86*a* is formed integrally with the belt supporting member 86 for latching one end of the spring 92. Near the six portions where the pulley shafts 84*b* protrude out from the belt supporting member 86, not shown retaining rings are provided to stop the pulley shafts 84*b* from slipping out.

The shaft supporting member 90 is fixed to a wall at the back of the conveying guiding member 72, and is a single component made of an appropriate resin or metal material having a predetermined strength. The shaft supporting member 90 has a total of six elongated supporting holes 90*a* for slidably supporting both ends of each of the pulley shafts 83*b* of the belt conveying units 8H. The heightwise inside diameter of each of the supporting holes 90*a* is slightly larger than the outside diameter of each of the pulleys 83*b*. Therefore, the pulleys 83*b* are loosely fitted in the supporting holes 90*a*. Furthermore, the supporting holes 90*a* are provided in parallel with the sheet width direction Y and extend substantially along the sheet conveying direction of the first conveying unit 6 (not shown). Because the pulleys 83*b* are loosely fit in the supporting holes 90*a*, the conveying surfaces 82*a* of the three conveyor belts 82 are substantially parallel with the sheet width direction Y and are arranged slidably substantially in the sheet conveying direction. The pulley shafts 83*b* protrude outside from the supporting holes 90*a* of the shaft supporting member 90, and not shown retaining rings can be provided near the six portions of the protruding pulley shaft 83*b* to stop the pulley shafts 83*b* from slipping out.

The springs 92 are attached between an inner wall of the shaft supporting member 90 supporting the belt conveying units 8H and the spring stages 86*a* of the belt supporting members 86. The springs 92 press the conveyor belts 82 via the belt supporting members 86 in such a direction that the conveyor belts 82 constantly contact the grip rollers 81. In the fifth embodiment, all of the springs 92 have the same spring specifications such as spring load, spring length, shape, etc.

The three belt conveying units 8H are assembled by the same components described above. Shapes of the components are specified so that the three conveying surfaces 82*a* of the conveyor belts 82 are aligned on substantially the same plane when the conveyor belts 82 are pushed by the springs 92 after the belt conveying units 8H are attached to the shaft supporting member 90.

As described above, the conveyor belts 82 of the three belt conveying units 8H are caused to move/rotate separately from each other by the rotation of the grip rollers 81.

According to the fifth embodiment, there are plural (three) belt conveying units 8H arranged in a discontinuous manner along the sheet width direction Y, and the conveyor belt 82 of the plural (three) belt conveying units 8H are configured to move separately from each other. For example, compared to the belt conveying unit 8A shown in FIG. 12 where plural conveyor belts 82 are supported by a single pulley shaft 83*a*, it is possible to eliminate irregularities in linear speed caused by irregularities in the conveyor belts 82 or other components. Furthermore, each of the conveyor belts 82 move/rotate separately from each other, so that the sheet S is prevented from being skewed or creased. Furthermore, high-quality images can be provided.

As described above, according to the fourth embodiment and modification examples thereof, the user can make a selection from a variety of sheet conveying apparatuses according to the user's requirements by comparing performance and cost. For example, when the user desires maximum performance regardless of cost, the user can select the sheet conveying apparatus 5 including the conveyor belt 82 covering the entire widthwise direction. Similarly, according to the fifth embodiment and modification examples thereof described below, in addition to enabling the user to select a sheet conveying apparatus according to the user's requirements by comparing performance and cost, and the above-described advantages/effects can also be achieved.

Eighth Modification Example

Figure 19:
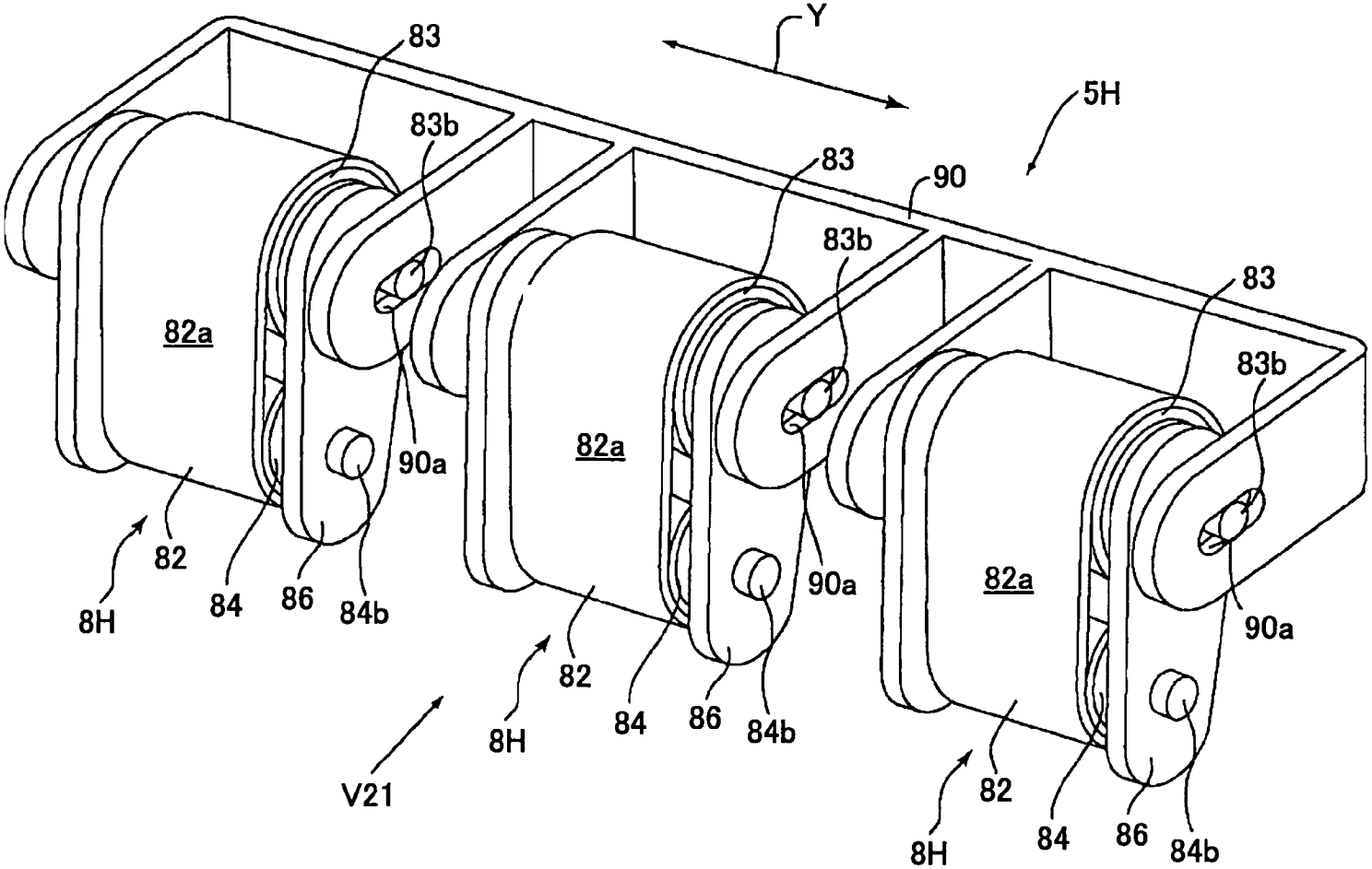
FIG. 19 is a perspective view of relevant parts around belt conveying units of a sheet conveying apparatus according to a fifth embodiment of the present invention viewed from a sheet conveying direction.
Figure 20:
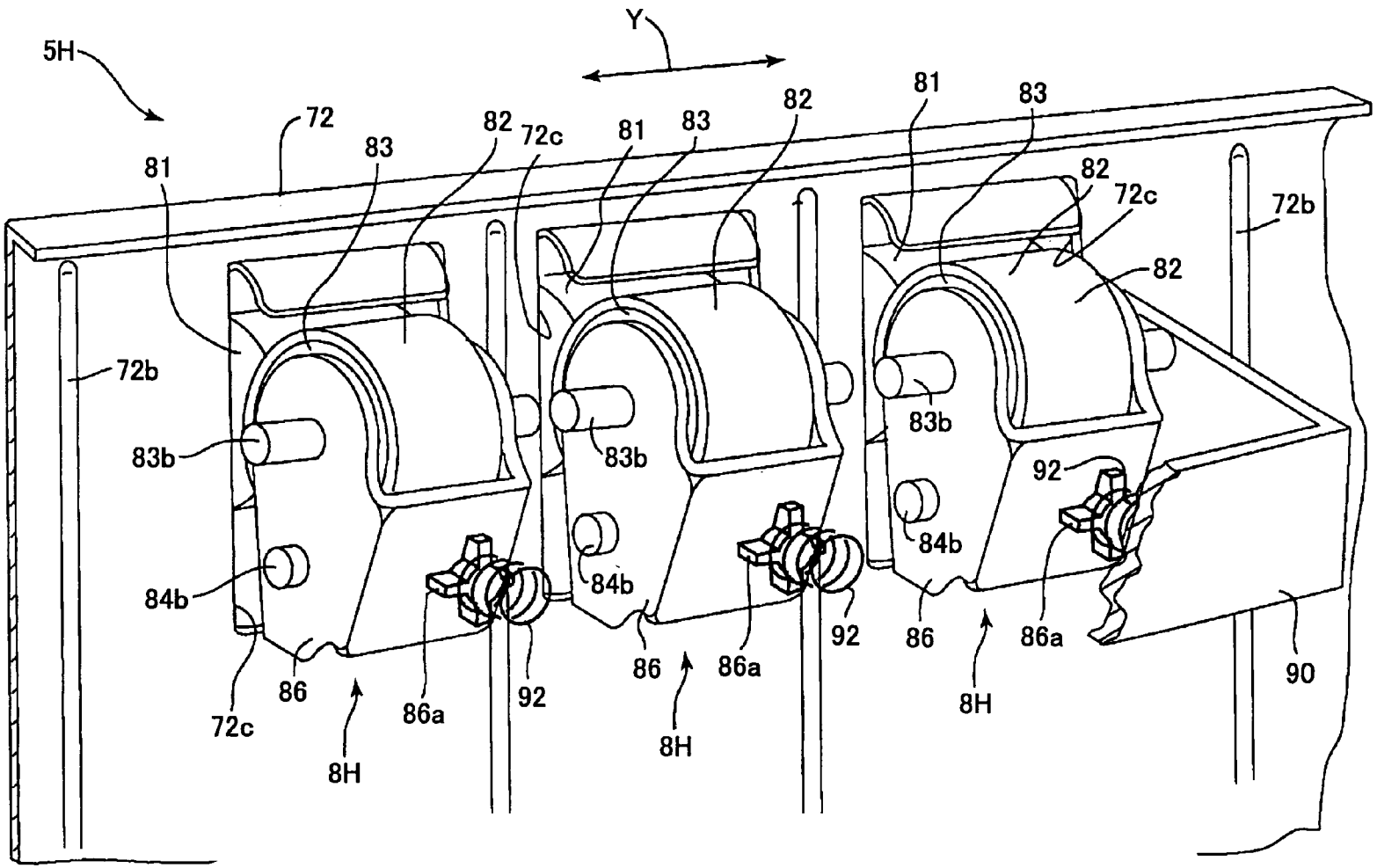
FIG. 20 is a perspective view of relevant parts around the belt conveying units of the sheet conveying apparatus shown in FIG. 19 viewed from behind a conveying guiding member.

In the fifth embodiment shown in FIGS. 19, 20, the conveyor belts 82 of plural (three) belt conveying units 8H move separately from each other, and three springs 92 of the same specifications are used. Under the same conditions, an eighth modification example has the following characteristics. That is, the center conveyor belt 82 among the plural conveyor belts 82 arranged in the sheet width direction Y is configured to be driven/moved at a higher speed than the other belts on the left and right sides.

Specifically, the outside diameter of the grip roller 81 on the driving side arranged in the center in the sheet width direction Y facing/contacting the conveyor belt 82 arranged in the center in the sheet width direction Y as viewed in FIG. 20 is made to be larger than the other grip rollers 81 on the left and right sides. With such a relatively simple configuration, the conveyor belt 82 arranged in the center can be moved/rotated at a higher linear speed than the other conveyor belts 82 on the left and right sides.

According to the eighth modification example, which is a modification example of the fifth embodiment, there are plural (three) belt conveying units 8H arranged in a discontinuous manner along the sheet width direction Y, and plural (three) conveyor belts 82 of the belt conveying units 8H are configured to move separately from each other. Among the plural (three) conveyor belts 82, the conveyor belt 82 arranged in the center in the sheet width direction Y is configured to move/rotate at a higher linear speed than the other conveyor belts 82 on the left and right sides. Therefore, a sheet S being conveyed can be prevented from creasing.

Ninth Modification Example

In the fifth embodiment shown in FIGS. 19, 20, the conveyor belts 82 of plural (three) belt conveying units 8H move separately from each other. Under the same conditions, a ninth modification example has the following characteristics. That is, the holding pressure at the holding section (nip section) of the conveyor belt 82 arranged in the center of the plural conveyor belts 82 in the sheet width direction Y is higher than that the other belts on the left and right sides.

Specifically, the holding pressure of the grip roller 81 (not shown in FIGS. 19, 20) on the driving side arranged in the center in the sheet width direction Y facing/contacting the conveyor belt 82 arranged in the center in the sheet width direction Y is made to be higher than the other grip rollers 81 (not shown in FIGS. 19, 20) on the left and right sides. That is, a stronger force is applied to the conveyor belt 82 of the belt conveying unit 8 arranged in the center than the force applied to the other conveyor belts 82 on the left and right sides. This is realized by employing a spring with a higher spring load as the spring 92 for the conveyor belt 82 arranged in the center, compared to the spring loads of the springs 92 for the other conveyor belts 82 on the left and right sides. With such a relatively simple configuration, the holding pressure of the conveyor belt 82 arranged in the center can be made higher than that of the other conveyor belts 82 on the left and right sides.

According to the ninth modification example, which is a modification example of the fifth embodiment, there are plural (three) belt conveying units 8H arranged in a discontinuous manner along the sheet width direction Y, and plural (three) conveyor belts 82 of the belt conveying units 8H are configured to move separately from each other. Among the plural (three) conveyor belts 82, the conveyor belt 82 arranged in the center in the sheet width direction Y is configured to have a higher holding pressure than the other conveyor belts 82 on the left and right sides. Therefore, a sheet S being conveyed can be prevented from creasing.

Tenth Modification Example

Figure 21:
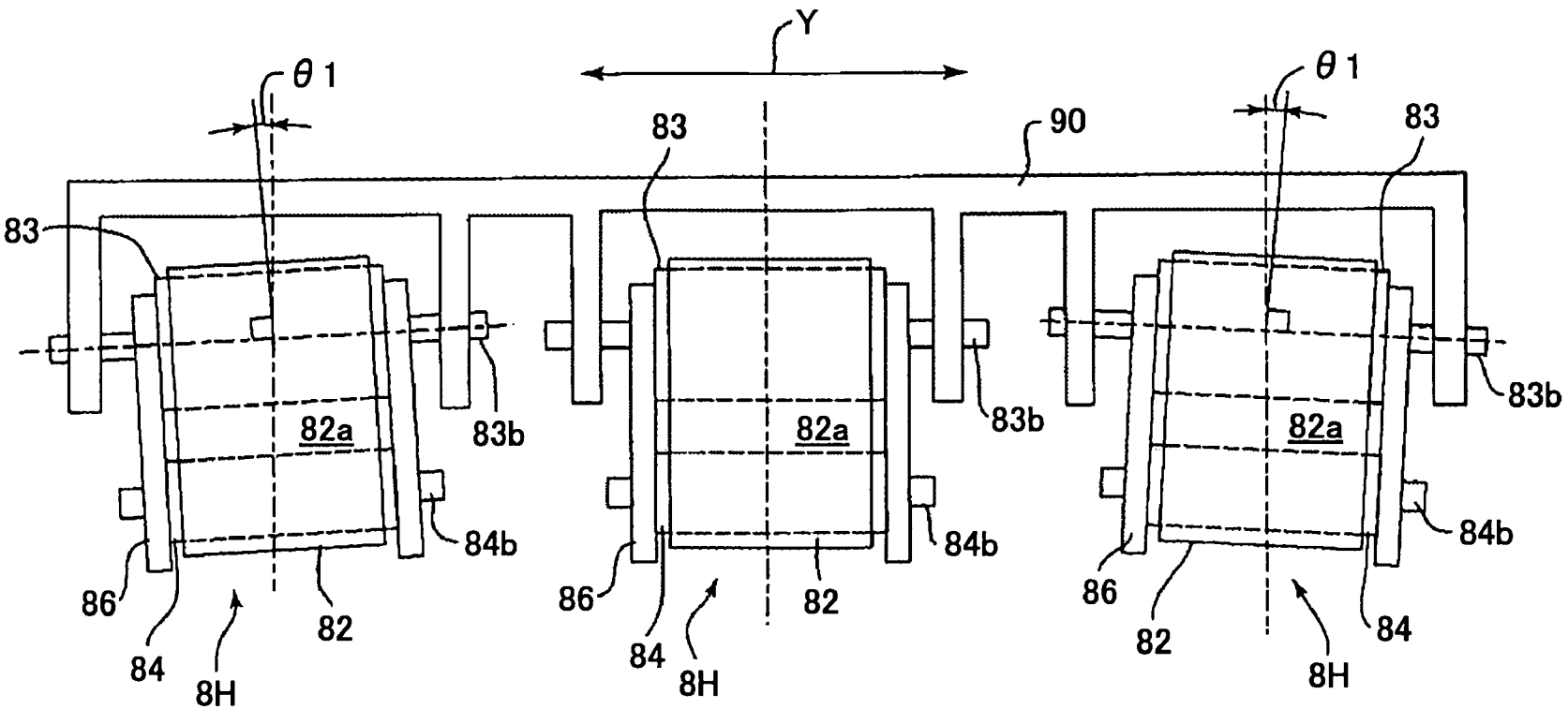
FIG. 21 is a schematic diagram of relevant parts around belt conveying units of a sheet conveying apparatus according to a tenth modification example viewed substantially from a sheet conveying direction of a first conveying unit.

In the fifth embodiment shown in FIGS. 19, 20, the conveyor belts 82 of plural (three) belt conveying units 8H move separately from each other, and three springs 92 of the same specifications are used. Under the same conditions, a tenth modification example has the following characteristics, as illustrated in FIG. 21. That is, viewed from the first conveying unit 6 in the sheet conveying direction, the conveyor belts 82 arranged on both edges in the sheet width direction among the plural conveyor belts 82 are made to spread outward from the upstream side toward the downstream side. Specifically, the axis of the downstream belt holding rotating member of each of the conveyor belts 82 arranged on both edges in the sheet width direction is tilted so as to be slanted with respect to the axis of the downstream belt holding rotating member of the center conveyor belt 82. The side view shown in FIG. 21 represents a view from V21 indicated in FIG. 19, which is substantially the sheet conveying direction of the first conveying unit 6.

Specifically, as shown in FIG. 21, the pulley shafts 83*b* of the conveyor belts 82 on the left and right sides in the sheet width direction Y are arranged on the shaft supporting member 90 in a tilted/slanted manner at a tilt angle θ1 with respect to the pulley shaft 83*b* of the conveyor belt 82 in the center in the sheet width direction Y. Accordingly, as viewed from the first conveying unit 6 in the sheet conveying direction, the conveyor belts 82 on the left and right sides of the conveyor belt 82 in the center appear to spread outward from the upstream side toward the downstream side in the sheet conveying direction, in slanted manners.

As described above, the tenth modification example shown in FIG. 21 is different from the fifth embodiment shown in FIGS. 19, 20 in that the pulley shafts 83*b* of the conveyor belts 82 on the left and right sides in the sheet width direction Y are slidably arranged on the shaft supporting member 90 in a tilted/slanted manner at a tilt angle θ1 with respect to the pulley shaft 83*b* of the conveyor belt 82 in the center in the sheet width direction Y. With such a relatively simple configuration, a force is applied so as to spread out a conveyed sheet S.

According to the tenth modification example, which is a modification example of the fifth embodiment, there are plural (three) belt conveying units 8H arranged in a discontinuous manner along the sheet width direction Y, and plural (three) conveyor belts 82 of the belt conveying units 8H are configured to move separately from each other. Furthermore, the downstream pulley shafts 83*b* of the conveyor belts 82 on both edges in the sheet width direction Y are arranged in a tilted/slanted manner at a tilt angle θ1 with respect to the downstream pulley shaft 83*b* of the conveyor belt 82 in the center in the sheet width direction Y. Accordingly, as viewed from the first conveying unit 6 in the sheet conveying direction, the conveyor belts 82 on the left and right sides among the plural (three) conveyor belts 82 appear to spread outward from the upstream side toward the downstream side in the sheet conveying direction. Therefore, a force is applied so as to spread out a sheet, so that a sheet S being conveyed can be prevented from creasing.

Eleventh Modification Example

In the fifth embodiment shown in FIGS. 19, 20, the conveyor belts 82 of plural (three) belt conveying units 8H move separately from each other, and three springs 92 of the same specifications are used. Under the same conditions, an eleventh modification example has the following characteristics. That is, the conveyor belts 82 are made of elastic members of different hardness levels.

Specifically, the elastic member (for example, a rubber material such as ethylene propylene rubber or urethane rubber) used for the conveyor belt 82 in the center in the sheet width direction Y is harder than the elastic members used for the conveyor belts 82 on the left and right sides. Therefore, the elastic deforming amount of the conveyor belts 82 on the left and right sides is larger than that of the conveyor belt 82 in the center. Thus, a force to spread out a sheet S in a slanted manner is applied on the conveyed sheet S.

According to the eleventh modification example, which is a modification example of the fifth embodiment, there are plural (three) belt conveying units 8H arranged in a discontinuous manner along the sheet width direction Y, and plural (three) conveyor belts 82 of the belt conveying units 8H are configured to move separately from each other. Furthermore, the conveyor belts 82 are made of elastic members of different hardness levels, so that a sheet S being conveyed can be prevented from creasing.

Twelfth Modification Example

In the fifth embodiment shown in FIGS. 19, 20, the conveyor belts 82 of plural (three) belt conveying units 8H move separately from each other, and three springs 92 of the same specifications are used. Under the same conditions, a twelfth modification example has the following characteristics. That is, the belts have different thicknesses.

Specifically, the elastic member (for example, a rubber material as described above) used for the conveyor belt 82 in the center in the sheet width direction Y is thinner than the elastic member used for the conveyor belts 82 on the left and right sides. By changing the hardness of the rubber members with their physical appearances, the elastic deforming amount of the conveyor belts 82 on the left and right sides is made larger than that of the conveyor belt 82 in the center. Thus, a force to spread out a sheet S in a slanted manner is applied on the conveyed sheet S.

According to the twelfth modification example, which is a modification example of the fifth embodiment, there are plural (three) belt conveying units 8H arranged in a discontinuous manner along the sheet width direction Y, and plural (three) conveyor belts 82 of the belt conveying units 8H are configured to move separately from each other. Furthermore, the conveyor belts 82 are made of elastic members of different thicknesses. By changing the hardness of the rubber members with their physical appearances, a sheet S being conveyed can be prevented from creasing.

Thirteenth Modification Example

In the fifth embodiment shown in FIGS. 19, 20, the conveyor belts 82 of plural (three) belt conveying units 8H move separately from each other, and three springs 92 of the same specifications are used. Under the same conditions, a thirteenth modification example has the following characteristics. That is, the shapes of the circumferential surfaces of the belts are different.

Specifically, the surface of the elastic member (for example, a rubber material) used for the conveyor belts 82 on the left and right sides in the sheet width direction Y can have a rough shape (with protruding parts and receding parts), such as a caterpillar-like shape, a knurled shape, or a pleated shape. By changing the hardness of the rubber members with their physical appearances, the elastic deforming amount of the conveyor belts 82 on the left and right sides is made larger than that of the conveyor belt 82 in the center. Thus, a force to spread out a sheet S in a slanted manner is applied on the conveyed sheet S.

According to the thirteenth modification example, which is a modification example of the fifth embodiment, there are plural (three) belt conveying units 8H arranged in a discontinuous manner along the sheet width direction Y, and plural (three) conveyor belts 82 of the belt conveying units 8H are configured to move separately from each other. Furthermore, the shapes of the circumferential surfaces of the conveyor belts 82 are different. By changing the hardness of the rubber members with their physical appearances, a sheet S being conveyed can be prevented from creasing.

Fourteenth Modification Example

Figure 26:
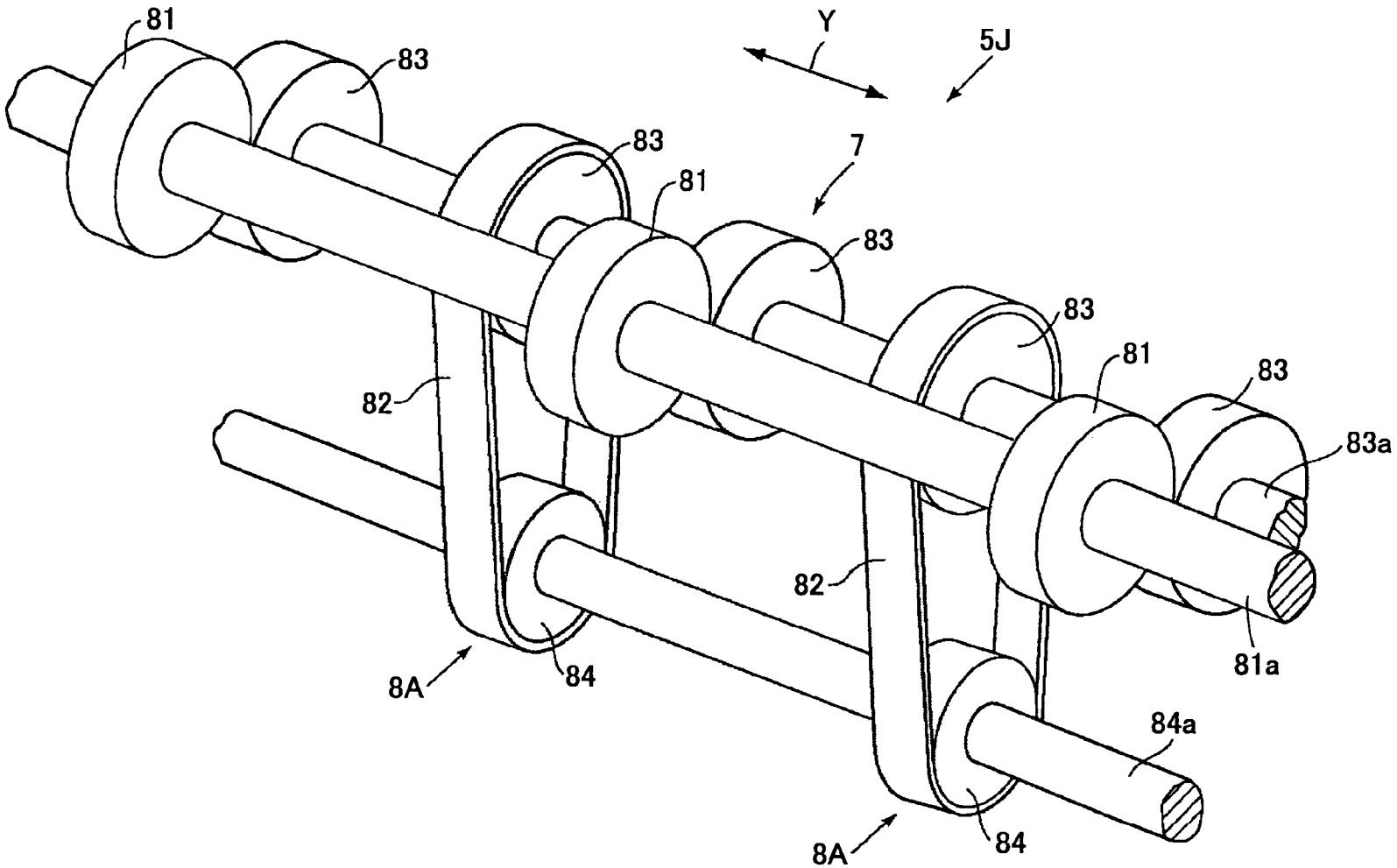
FIG. 26 is a perspective view of relevant parts around grip rollers and belt conveying units of a sheet conveying apparatus according to a fourteenth modification example.

The embodiments and the modification examples of the present invention are not limited to the above. FIG. 26 illustrates a sheet conveying apparatus 5J according to a fourteenth modification example. The sheet conveying apparatus 5J according to the fourteenth modification example is different from the sheet conveying apparatus 5B according to the first modification example shown in FIG. 12. That is, the second conveying unit 7 in the sheet conveying apparatus 5J has the following layout. Subordinate rollers 83 that are substantially the same as the roller-type pulleys 83 are facing/contacting the grip rollers 81 as in conventional examples, and the subordinate rollers 83 and the conveyor belts 82 of the belt conveying units 8A are arranged alternately with each other along the same pulley shaft 83*a*. Apart from these differences, the sheet conveying apparatus 5J shown in FIG. 26 is the same as the sheet conveying apparatus 5B shown in FIG. 12.

The subordinate rollers 83 (substantially the same as the roller-type pulleys 83) around which the conveyor belts 82 are stretched around are fixed to the pulley shaft 83*a*, similarly to the roller-type pulleys 83. Therefore, as the subordinate rollers 83 are caused to rotate following the rotation of the grip rollers 81, the conveyor belts 82 are caused to rotate simultaneously.

As a matter of course, the relevant configurations of the second—thirteenth modification examples and the fifth embodiment shown in FIGS. 13-21 are applicable to the sheet conveying apparatus 5J shown in FIG. 26.

As a matter of course, according to the fourteenth modification example, the above-described basic effects of the belt conveying unit 8A can be achieved.

Fifteenth Modification Example

Figure 27:
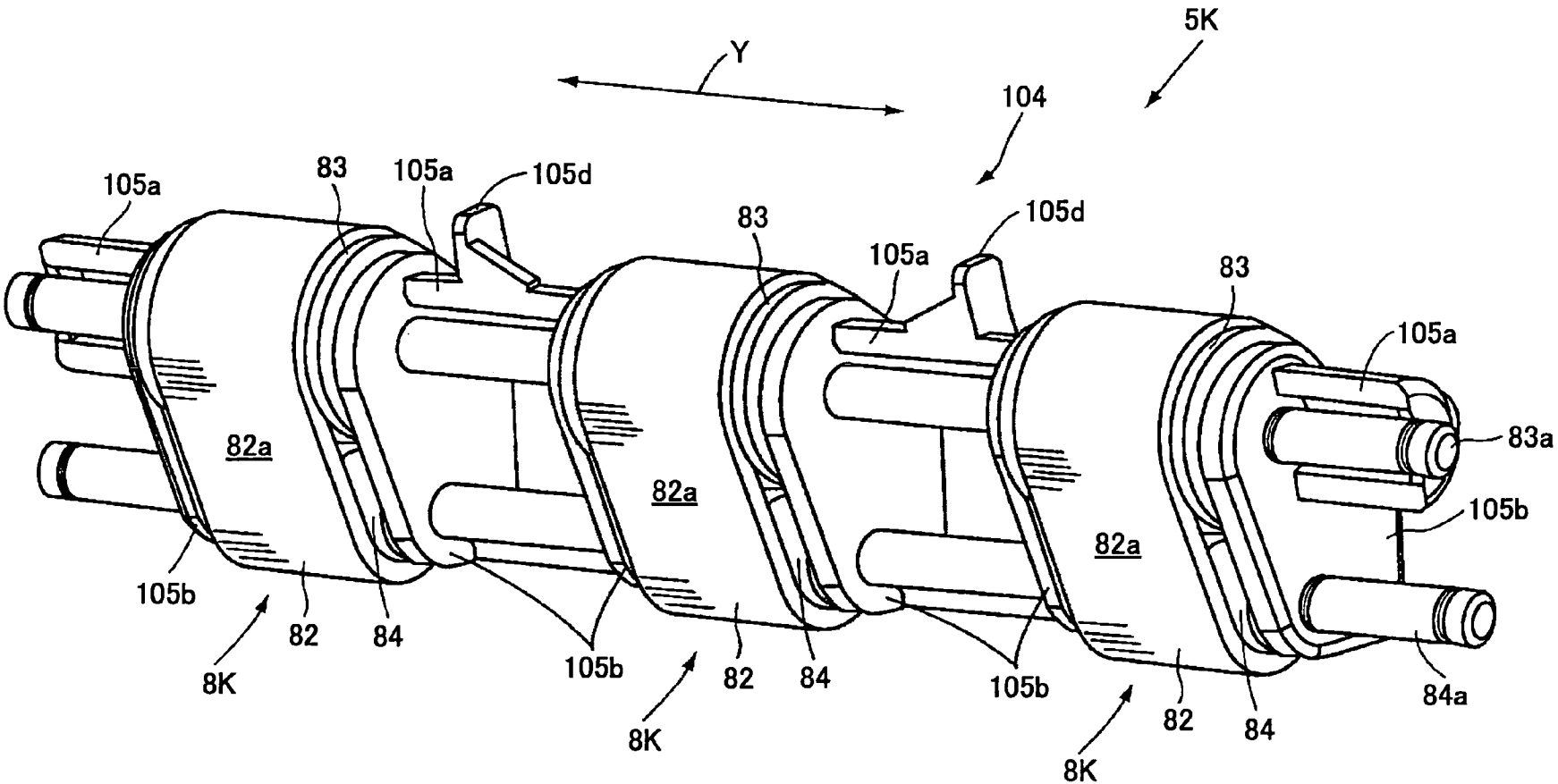
FIG. 27 is a perspective view of relevant parts around a belt unit of a sheet conveying apparatus according to a fifteenth modification example viewed from the grip roller side.
Figure 28:
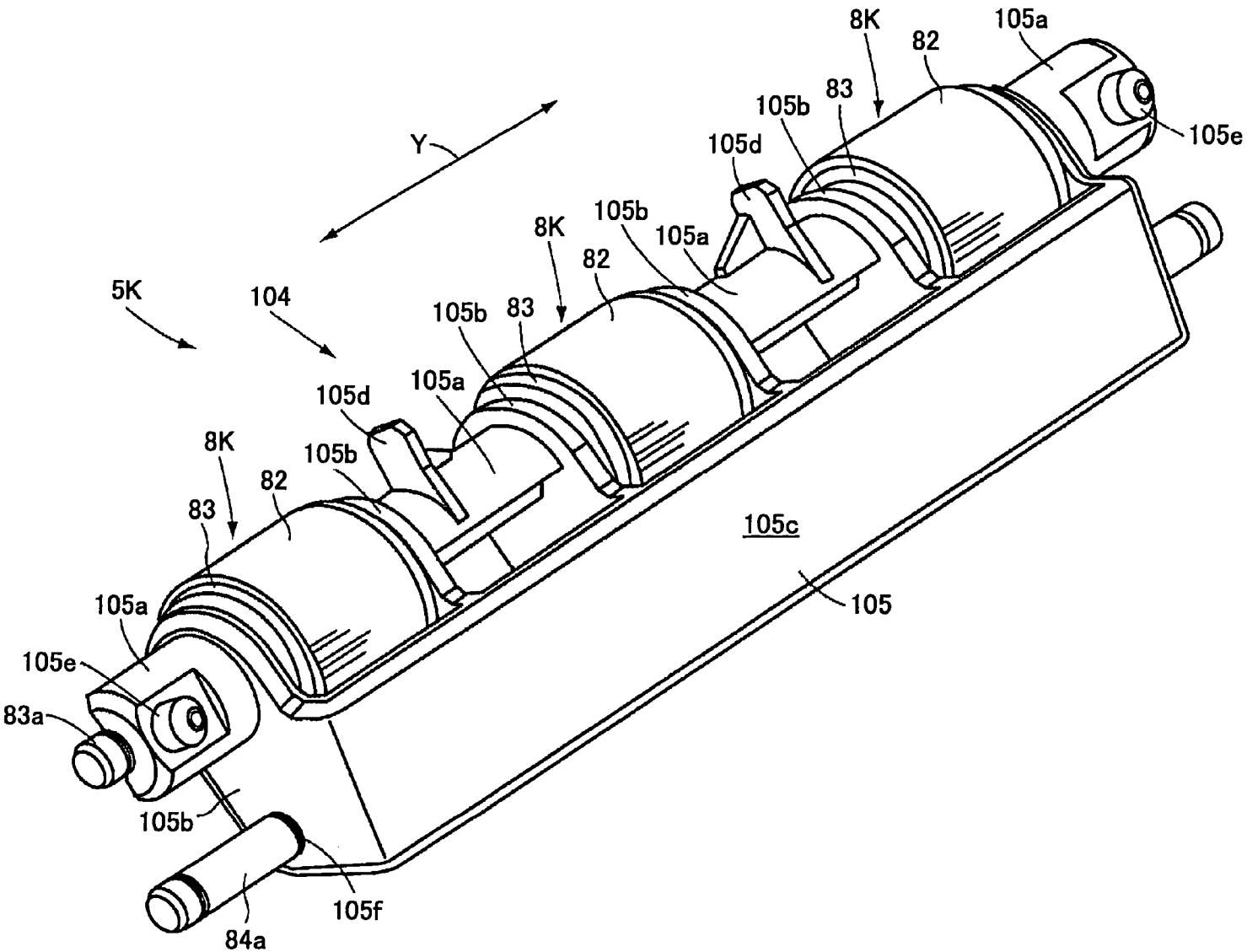
FIG. 28 is a perspective view of relevant parts around the belt unit of the sheet conveying apparatus according to the fifteenth modification example viewed from behind the conveying guiding member.
Figure 29:
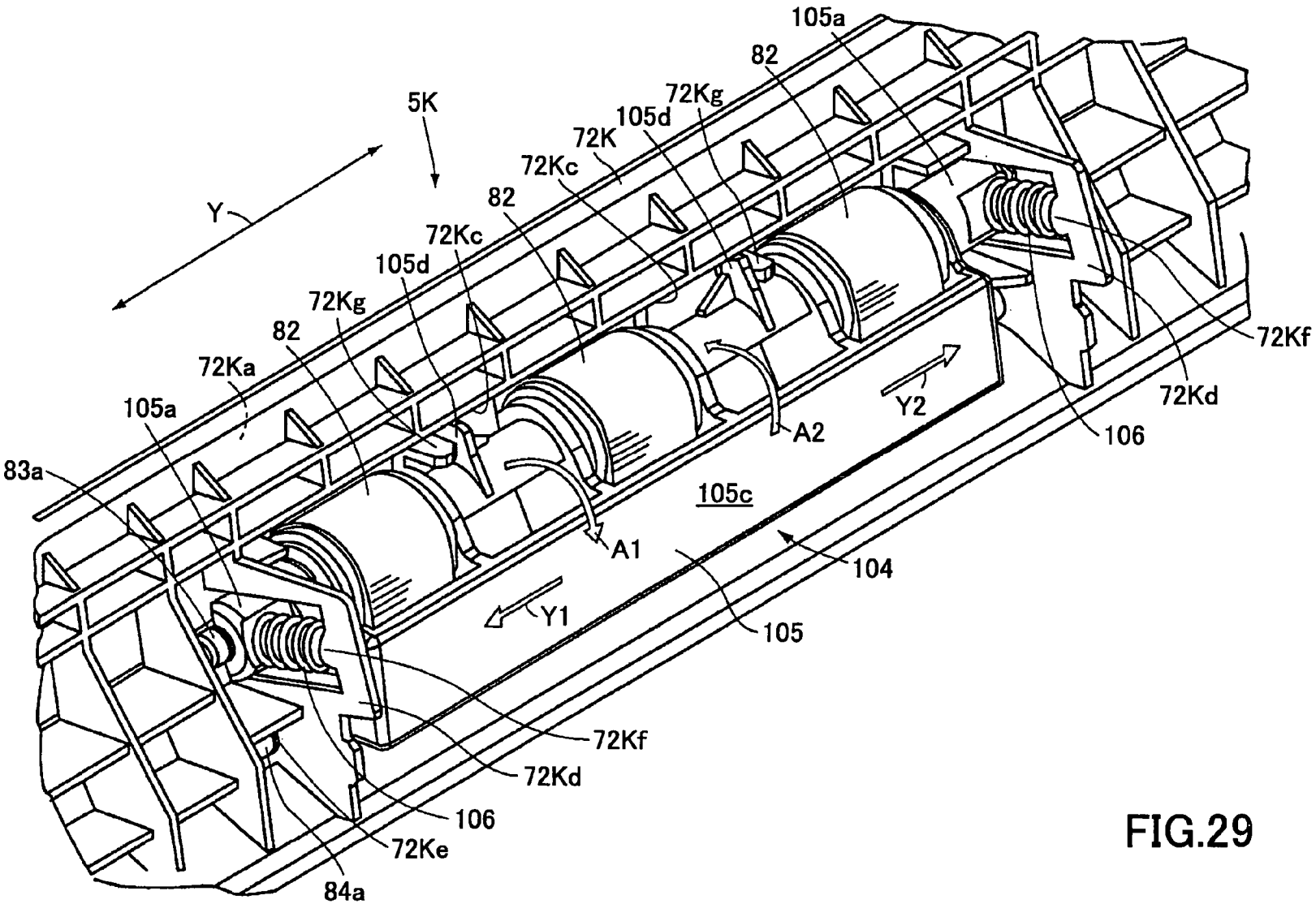
FIG. 29 is a perspective view of relevant parts around the belt unit of the sheet conveying apparatus according to the fifteenth modification example, where the belt unit is attached to a conveying guiding member, viewed from behind the conveying guiding member.

The embodiments and the modification examples of the present invention are not limited to the above. FIGS. 27-29 illustrate a sheet conveying apparatus 5K according to a fifteenth modification example including a belt unit 104. The sheet conveying apparatus 5K according to the fifteenth modification example is different from the sheet conveying apparatus 5B according to the first modification example shown in FIG. 12, as follows. That is, instead of the three separate belt conveying units 8A, the sheet conveying apparatus 5K includes three separate belt conveying units 8K. The three belt conveying units 8K are initially built in a housing case 105 together with the common pulley shafts 83*a*, 84*a*, which configure the belt unit 104 that is detachably attached to the opening/closing guide (79) shown in FIGS. 25A, 25B (or the device body 78 provided with the housing 80). Furthermore, the sheet conveying apparatus 5K includes a conveying guiding member 72K instead of the conveying guiding member 72. Apart from these differences, the sheet conveying apparatus 5K is the same as the sheet conveying apparatus 5B shown in FIG. 12.

The outer edges of the pulleys 83 and the conveyor belts 82 at the outermost sides in the sheet width direction Y are positioned so as to be within the width of the minimum-size sheet S (sheet size in the sheet width direction Y) used in the copier 1 provided with the sheet conveying apparatus 5K. Similarly, the outer edges of the grip rollers 81 (not shown in FIGS. 27-29) at the outermost sides in the sheet width direction Y are positioned so as to be within the width of the minimum-size sheet S (sheet size in the sheet width direction Y) used in the copier 1 provided with the sheet conveying apparatus 5K.

The pulleys 83, 84 of the belt conveying units 8K are made of a resin material such as polyacetal resin that has good lubricity, abrasion resistance, and durability, and are thus light-weight. The pulleys 83, 84 are fabricated in such a manner that the pulley shaft 83*a* can be inserted through the pulley 83 and the pulley shaft 84*a* can be inserted through the pulley 84. The pulleys 83, 84 are rotatably attached to/supported by the pulley shafts 83*a*, 84*a*, respectively. Each of the pulley shafts 83*a*, 84*a* is a single shaft inserted through not shown through-holes of the three upper pulleys 83 and three lower pulleys 84, respectively.

The housing case 105 is also a single component made of a resin material such as polyacetal resin that has good lubricity, abrasion resistance, and durability, and is thus light-weight. The housing case 105 includes the following components combined together: a holder section 105*a* also acting as a bearing; belt supporting sections 105*b* for partitioning and supporting the pulleys 83 and the conveyor belts 82; a main unit 105*c* by which the holder section 105*a* and the belt supporting sections 105*b*, etc., are integrally combined, attached, and operated; protrusions 105*d* used as references in the sheet width direction for attaching the components; and a pair of left and right spring stages 105*e* for latching one end of each spring 106 (pressuring spring) shown in FIG. 29 acting as forcing units/forcing members or elastic members. The belt supporting sections 105*b* on both sides of the belt conveying units 8K in the sheet width direction Y in the housing case 105 have through holes 105*f* through which the pulley shaft 84*a* is inserted.

As shown in FIG. 29, the conveying guiding member 72K includes a vertical conveying guide surface 72Ka, spring latching sections 72Kf provided on the back wall of the conveying guiding member 72K for acting as reinforcing components and for latching the other ends of the springs 106, a pair of left and right ribs 72Kd including slots for attaching components such as the springs 106, and a pair of left and right restricting sections 72Kg that contact the protrusions 105*d* and act as references in the sheet width direction Y when attaching the belt unit 104. These components are integrally formed with an appropriate resin material. Furthermore, the conveying guiding member 72K includes openings 72Kc for making the conveying surfaces 82*a* of the belt unit 104 face the inside of the vertical conveying path or the second conveying path B from the vertical conveying guide surface 72Ka, when the belt unit 104 is attached. Moreover, through holes 72Ke, through which the pulley shaft 84*a* is inserted when attaching the belt unit 104, are provided in each of the ribs 72Kd.

Next, a brief description is given of the procedure of attaching the belt unit 104 to the opening/closing guide (79) shown in FIGS. 25A, 25B.

First, each of the conveyor belts 82 is stretched around upper and lower pulleys 83, 84. Next, the pulley shaft 83*a* is inserted through the pulleys 83. The pulley shaft 84*a* is inserted through the through holes 105*f* of the belt supporting sections 105*b* in the housing case 105 and the pulleys 84. The conveyor belts 82 are stretched around the pulleys 83, 84. The conveyor belts 82 are made to have a predetermined tension as the axes of the pulleys 83, 84 are spaced apart by a predetermined distance. Furthermore, the pulleys 83, 84, the conveyor belts 82, and the pulley shafts 83*a*, 84*a* are detachably attached to the housing case 105, so that the belt unit 104 is configured as shown in FIGS. 27, 28. At this point, not shown retaining rings are attached on the pulley shaft 83*a* protruding outside from the left and right sides of the holder section 105*a*, so that the pulley shaft 83*a* is attached/supported and prevented from moving in the sheet width direction Y in the holder section 105*a* of the housing case 105.

Next, with reference to FIG. 29, the belt unit 104 is attached to the conveying guiding member 72K of the opening/closing guide (79) as follows. The left end of the pulley shaft 84*a* protruding from the left side of the leftmost belt supporting section 105*b* as viewed in FIG. 29 is moved from the right side to the left side in a direction indicated by an arrow Y1 as viewed in FIG. 29 to be inserted in the through hole 72Ke in the left rib 72Kd in the conveying guiding member 72K. At this point, the belt unit 104 is rotated so that the protrusions 105*d* of the belt unit 104 move in a direction indicated by an arrow A1 from the positions illustrated in FIG. 29 to tilted positions, so as not to be obstructed by the restricting sections 72Kg of the conveying guiding member 72K.

While the protrusions 105*d* of the belt unit 104 are kept at the tilted positions, the right end of the pulley shaft 84*a* protruding from the right side of the rightmost belt supporting section 105*b* as viewed in FIG. 29 is moved from the left side to the right side in a direction indicated by an arrow Y2 as viewed in FIG. 29 to be inserted in the through hole 72Ke in the right rib 72Kd in the conveying guiding member 72K. Then, the belt unit 104 is rotated so that the protrusions 105*d* of the belt unit 104 move in a direction indicated by an arrow A2. Accordingly, the left and right protrusions 105*d* contact (fit in) the left and right restricting sections 72Kg, so that the belt unit 104 is prevented from moving in the sheet width direction Y. Next, the springs 106 are attached to the spring stages 105*e* and the spring latching sections 72Kf on the left and right. Then, not shown retaining rings are attached to both ends of the pulley shaft 84*a* protruding outside from the left and right ribs 72Kd of the conveying guiding member 72K, so that the pulley shaft 84*a* is attached/supported by the left and right ribs 72Kd of the conveying guiding member 72K and prevented from moving in the sheet width direction Y of the conveying guiding member 72K.

As described above, the belt unit 104 is arranged at a position in such a manner that the conveying surfaces 82*a* of the conveyor belts 82 protrude from the openings 72Kc of the conveying guiding member 72K by a predetermined amount (step height). Furthermore, the pressing force of the pair of left and right springs 106 presses the belt unit 104 in such a direction that the upper pulleys 83 pivot in an anticlockwise direction about the pulley shaft 84*a*. Accordingly, the conveying surfaces 82*a* are pressed against the grip rollers 81 not shown in FIG. 29 via the pulleys 83 by a predetermined pressure level.

As a matter of course, the relevant configurations of the second-thirteenth modification examples and the fifth embodiment shown in FIGS. 13-21 are applicable to the sheet conveying apparatus 5K shown in FIGS. 27-29.

According to the fifteenth modification example, the basic effects of the belt conveying units 8K can be achieved, and the following additional advantages and effects can also be achieved. The pulleys 83, 84, the conveyor belts 82, and the pulley shafts 83*a*, 84*a* are detachably attached to the housing case 105, thus configuring the belt unit 104 that is easily attachable to/detachable from the opening/closing guide (79). As the sheet conveying apparatus 5K can easily be attached/detached, maintenance and cleaning of the sheet conveying apparatus 5K are facilitated. Moreover, assembling errors between the conveyor belts 82 can be reduced compared to the examples shown in FIGS. 11-14, 26.

Sixth Embodiment

A sheet conveying apparatus 5M according to a sixth embodiment of the present invention is described with reference to FIGS. 13, 23, 24, and 30-33. FIGS. 23 and 24 schematically illustrate the driving mechanism 22 acting as a sheet feeding driving unit (sheet feeding driving system) of the first conveying unit 6 and the second conveying unit 7 in the sheet conveying apparatus 5M according to the sixth embodiment. FIGS. 13, 30-33 illustrate the surroundings of a belt conveying unit 8M of the second conveying unit 7 in the sheet conveying apparatus 5M according to the sixth embodiment.

The primary differences between the sheet conveying apparatus 5 shown in FIGS. 1-4 and 7-10 and the sheet conveying apparatus 5M according to the sixth embodiment shown in FIGS. 13, 23, 24, and 30-33 are as follows. In the sheet conveying apparatus 5M, the relationship between the driving member and the subordinately driven member of the second conveying unit 7 acting as a holding/conveying unit is clearly defined. Moreover, the belt conveying unit 8M is employed instead of the belt conveying unit 8, and elements of the belt conveying unit 8M including the conveyor belt 82 are arranged in a discontinuous manner along the sheet width direction Y so as to contact parts of the sheet S in the sheet width direction Y, and the material of the conveyor belt 82 is specified. Apart from these differences, the sheet conveying apparatus 5M according to the sixth embodiment is the same as the sheet conveying apparatus 5 shown in FIGS. 1-4 and 7-10.

Specifically, in the second conveying unit 7 of the sheet conveying apparatus 5M, a pair of members facing each other configures the holding/conveying unit, namely, the grip roller 81 and the belt conveying unit 8M. The grip roller 81, which is one member of the pair, functions as a rotating conveying driving unit/rotating conveying driving member that transmits a driving force by rotating. The belt conveying unit 8M (moving/guiding unit) including the conveyor belt 82, which is the other member of the pair, is arranged along the outer side of the sheet conveying path (first conveying path A) formed between the first conveying unit 6 and the second conveying unit 7. The conveyor belt 82 directly contacts the grip roller 81, and is caused to rotate following the rotation of the grip roller 81. The conveyor belt 82 conveys (moves/guides) the sheet S toward the holding section (nip section) of the second conveying unit 7 while keeping the leading edge of the sheet S in contact with the conveyor belt 82.

The sheet conveying apparatus 5M according to the sixth embodiment is different from the sheet conveying apparatus 5 shown in FIGS. 1-4 and 7-10 as follows. In the sheet conveying apparatus 5 shown in FIGS. 1-4 and 7-10, the width of the conveyor belt 82 is equal to or greater than the width of a maximum-size sheet to be conveyed, and the pulleys 83, 84 and the grip roller 81 are formed across the entire sheet width direction Y so that their sizes are equal to or greater than the aforementioned belt width of the conveyor belt 82. Instead of this configuration, in the sheet conveying apparatus 5M according to the sixth embodiment, elements of the belt conveying unit 8M including the conveyor belt 82 are arranged in a discontinuous manner along the sheet width direction Y so as to contact parts of a leading edge section of the sheet S in the sheet width direction Y (the leading edge section includes the leading edge, the face at the leading edge, the corners and edges at the leading edge).

Figure 32:
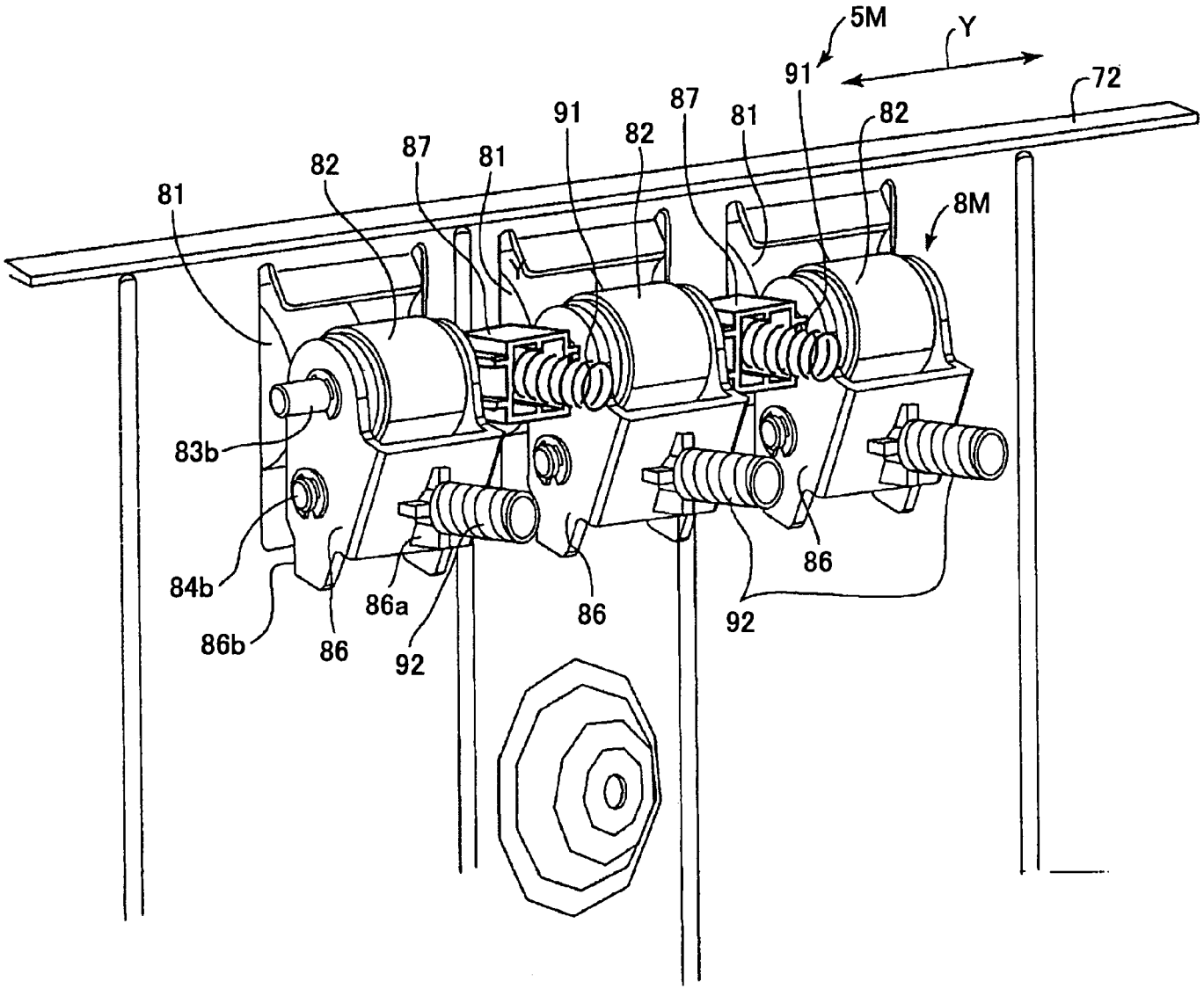
FIG. 32 is a perspective view around the belt conveying units of the sheet conveying apparatus according to the sixth embodiment viewed from behind a conveying guiding member.

The grip roller 81 includes plural rotating/conveying members fixed/arranged in a discontinuous manner along the rotational driving shaft 81*a* in the sheet width direction Y in a shish-kebab-like structure. Meanwhile, the conveyor belt 82 and the pulleys 83, 84 in the belt conveying unit 8A are arranged facing at least one of the plural grip rollers 81 (forming at least one pair of facing members). Specifically, as shown in FIGS. 23 and 32, there are three grip rollers 81 arranged along the rotational driving shaft 81*a*, and three conveyor belts 82 having widths substantially equal to those of the grip rollers 81 are arranged facing the three grip rollers 81. Details are described below.

The sixth embodiment employs the same driving mechanism 22 as that described in the fourth embodiment with reference to FIGS. 23, 24, and therefore, redundant descriptions are omitted.

Next, details of the belt conveying units 8M arranged facing the grip rollers are described with reference to FIGS. 13, 30-33.

The belt conveying unit 8M of the sheet conveying apparatus 5M is primarily different from the belt conveying unit 8 of the sheet conveying apparatus 5 shown in FIGS. 1-4 and 7-10 in the following points and subsequently described characteristics. That is, the material of the conveyor belt 82 is specified as below. Instead of having the three pulleys 83 fixed to the pulley shaft 83*a*, the three pulleys 83 are rotatably supported by the pulley shaft 83*b*. The pulleys 83, 84 are made of a resin material such as polyacetal resin. The belt supporting members 86 are provided to rotatably support the pulleys 83, 84. Instead of the pulley shaft 84*a* with a long length continuously extending in its axial direction, there are three metal pulley shafts 84*b* with short lengths in their axial directions provided for the belt conveying units 8M.

Figure 30:
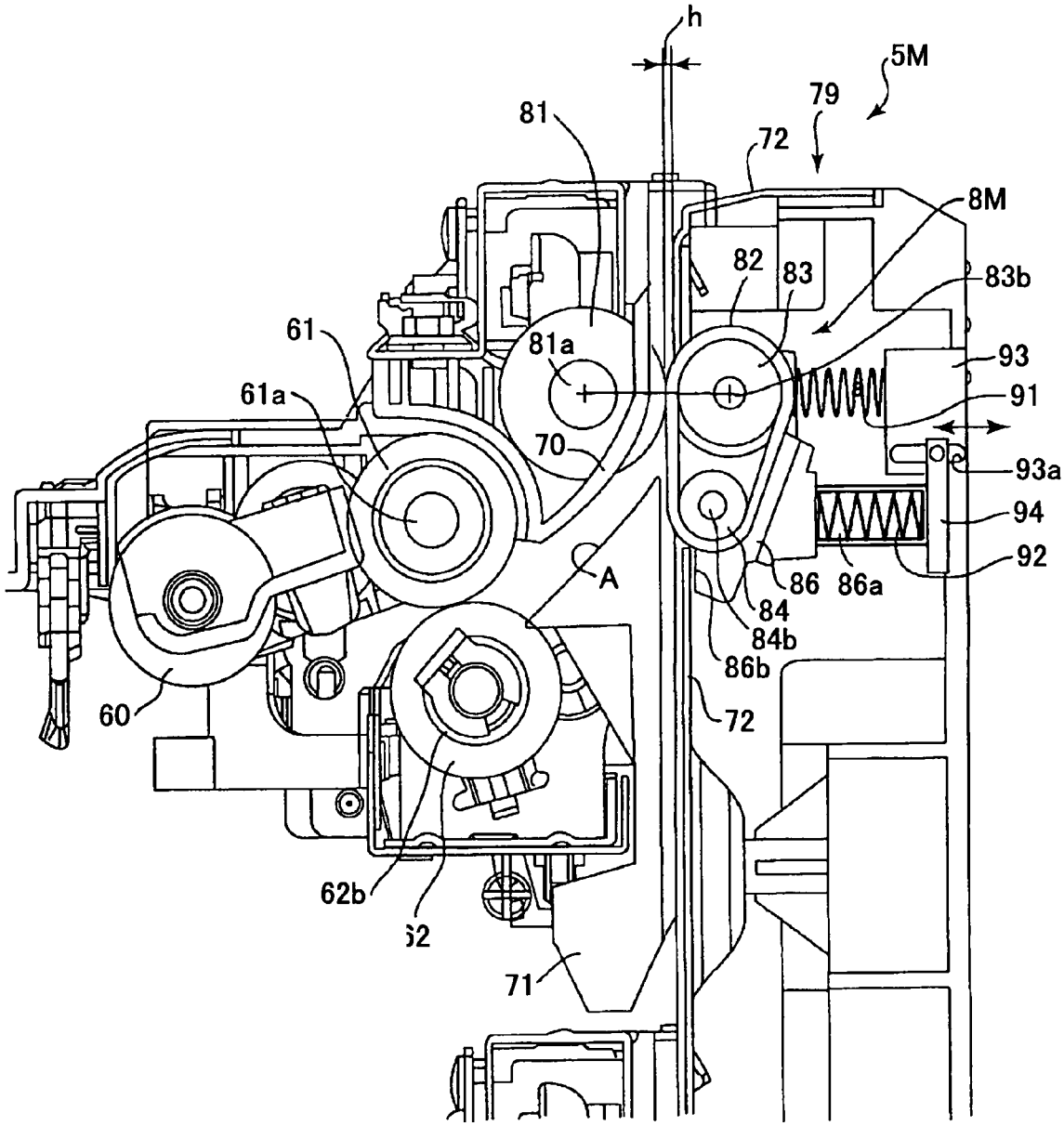
FIG. 30 is a sectional view of relevant parts around first and second conveying units in a sheet conveying apparatus according to the sixth embodiment.

As shown in FIG. 30, the grip roller 81 and the conveyor belt 82 contact each other on a line connecting the center of the rotational driving shaft Bla of the grip roller 81 and the center of the pulley shaft 83*b*, similarly to the example shown in FIG. 4. The holding section (nip section) is formed at the portion including this contact point. The pulleys 83, 84 are made of a resin material such as polyacetal resin that has good lubricity, abrasion resistance, and durability, and are thus light-weight.

The conveyor belts 82 provided at three positions have the same configurations except for their spring loads as described below. Thus, only one of the conveyor belts 82 is described as a representative example. The conveyor belt 82 is an elastic member made of, for example, ethylene propylene rubber (EPDM), without using a base material (a belt is typically formed by attaching rubber onto a base material such as a cloth made by weaving threads). The conveyor belt 82 is made only of rubber. The conveyor belt 82 can also be made of urethane rubber (U).

The conveyor belt 82 is stretched around the pulley 83 rotatably supported by the pulley shaft 83*b* and the pulley 84 rotatably supported by the pulley shaft 84*b* with a predetermined tension determined by the positional relationship between the pulleys 83, 84 attached to the belt supporting member 86 via the pulley shafts 83*b*, 84*b*.

The pulley shafts 83*b*, 84*b* are fixed/supported by the belt supporting member 86 in such a manner that a fixed distance is maintained between their axes. Furthermore, the pulley shafts 83*b*, 84*b* are fixed/supported by the belt supporting member 86 in such a manner that the conveyor belt 82 has a longer circumference when stretched around the pulleys 83, 84 compared to when the conveyor belt 82 is by itself (in a non-stretched state). Accordingly, the conveyor belt 82 is elastically stretched so that the conveyor belt 82 has a longer circumference when the belt conveying unit 8M is assembled in the belt supporting member 86, compared to when the conveyor belt 82 is by itself (in a non-stretched state).

Two bearings 87 are provided on the pulley shaft 83*b* held by the three belt supporting members 86. Springs 91, acting as forcing units, apply forces on the pulley shaft 83*b* via the bearings 87, so that a conveying force for conveying a sheet S is generated. As described above, the pulley shaft 83*b* and the pulley shaft 84*b* are fixed by the belt supporting member 86 in such a manner that a fixed distance is maintained between their axes, and the pulley shaft 84*b* can pivot back and forth about the pulley shaft 83*b*.

Each of the belt supporting members 86 is a single component made of a resin material such as polyacetal resin, and is thus light-weight. On the back wall of each of the belt supporting members 86, the spring stage 86*a* is formed integrally with the belt supporting member 86 for latching one end of the spring 92. Near the portions where the pulley shafts 83*b*, 84*b* protrude out from the belt supporting members 86, retaining rings are provided to stop the pulley shafts 83*b*, 84*b* from slipping out.

As shown in FIG. 30, the springs (pressuring springs) 92 are provided between the spring stages 86*a* of the belt supporting members 86 and spring bearing members 93. The springs 92 act as forcing units for pressing the backsides of the belt supporting members 86 in such a direction that the conveyor belts 82 constantly contact the grip rollers 81 shown in FIG. 30.

Figure 31:
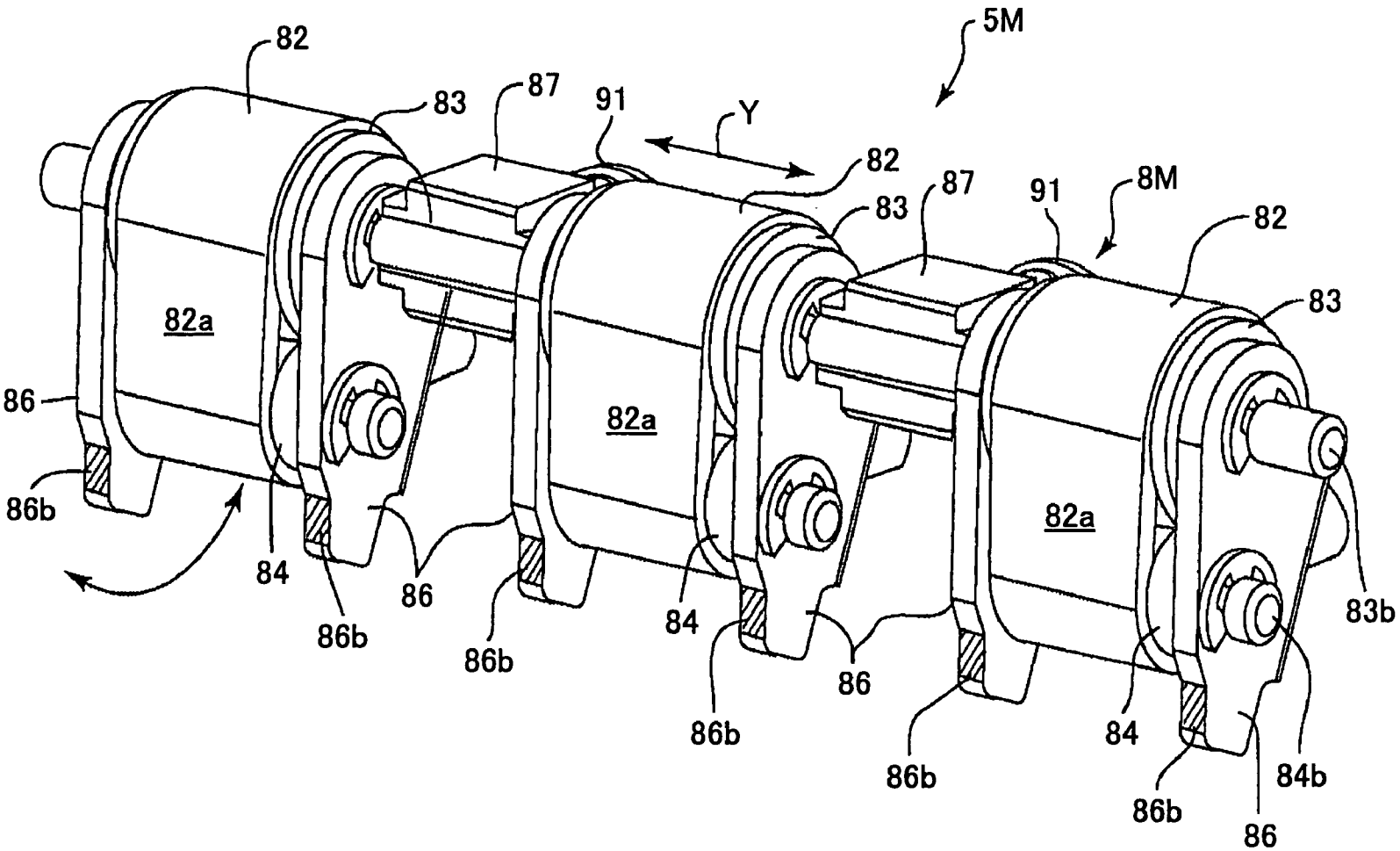
FIG. 31 is a perspective view around belt conveying units of the sheet conveying apparatus according to the sixth embodiment viewed from the grip roller side.
Figure 33:
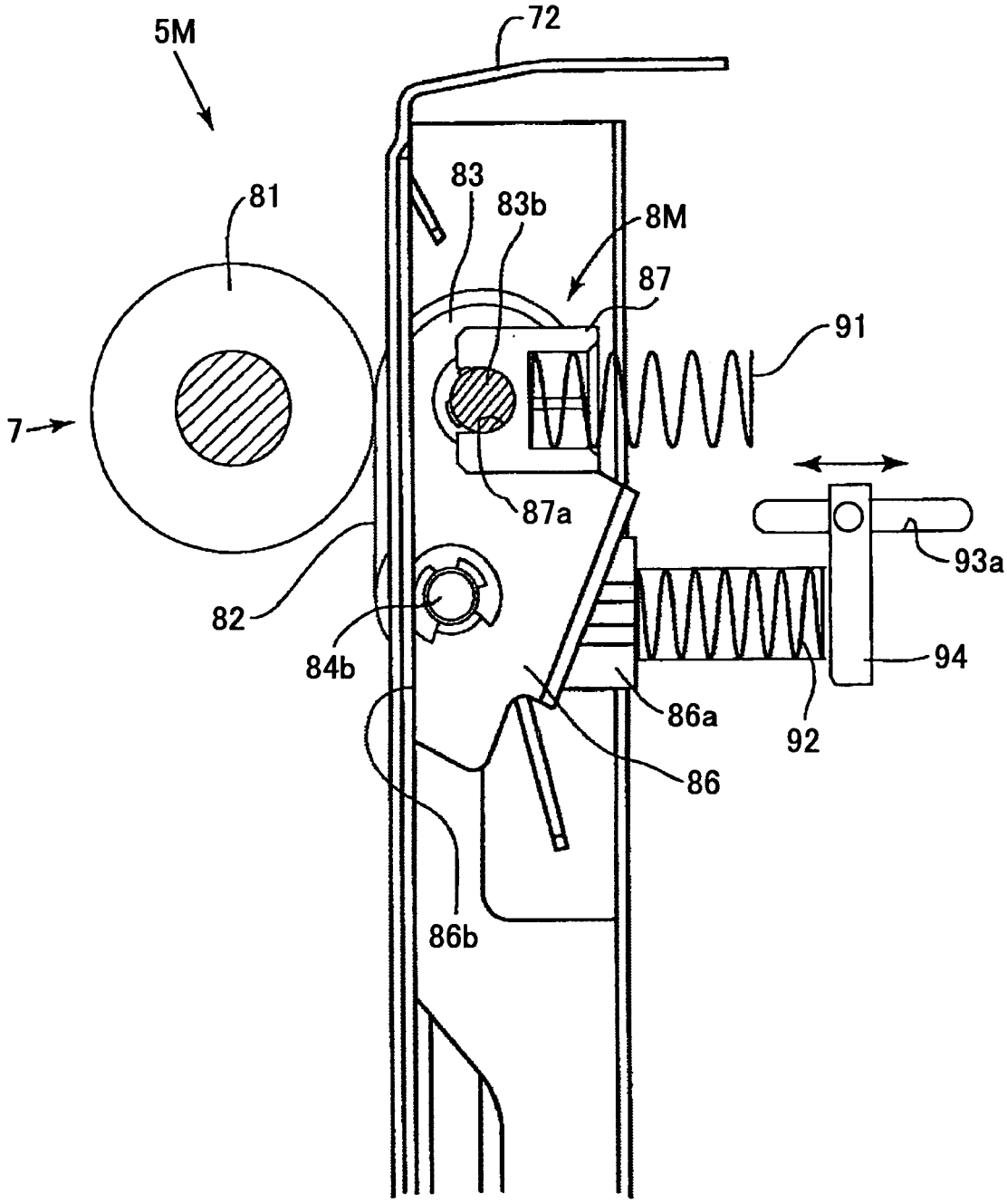
FIG. 33 is a sectional view of relevant parts around a second conveying unit of the sheet conveying apparatus according to the sixth embodiment.

As indicated by the hatched portions shown in FIG. 31, positioning sections 86*b* are integrally formed at the bottom of the belt supporting member 86 for positioning the conveyor belt 82 at a predetermined position. The positions of the conveyor belts 82 are determined as the positioning sections 86*b* contact the conveying guiding member 72. As shown in FIGS. 30 and 33, the positioning sections 86*b* are made to contact the conveying guiding member 72 by the pressing force of the springs 92. Therefore, the conveyor belts 82 are positioned at predetermined positions so as to protrude from the conveying guiding member 72 at a belt protruding height h.

As shown in detail in FIG. 33, each of the bearings 87 has a U-shaped slot 87*a*, and the pulley shaft 83*b* is loosely fit in the U-shaped slot 87*a*. Accordingly, the pressing force of the spring 91 presses the conveyor belt 82 against the grip roller 81 via the pulley shaft 83*b*. The position of the pulley shaft 83*b* is fixed as the conveyor belt 82 is pressed against the grip roller 81. The pulley shaft 84*b* is configured to pivot back and forth about the pulley shaft 83*b* in a direction indicated by an arrow shown in FIG. 31.

As described with reference to FIGS. 30-33, one end of the spring 92 applies a force on the belt supporting member 86. The other end of the spring 92 is supported/latched by a spring pressuring stage 94. The spring pressuring stage 94 can move along a slit 93*a* formed in the spring bearing member 93 in the direction of the pressing force of the spring 92, and can also be fixed at an arbitrary position. In FIGS. 30-33, the spring pressuring stage 94 is fastened/fixed by a screw. With such a configuration, the springs 92 can be arbitrarily pressed to different lengths so that the spring load acting as the pressing force, i.e., the pressuring force of the springs 92 can be arbitrarily changed. In the sixth embodiment, the two springs 91 have the same spring specifications such as spring load, spring length, shape, etc. Similarly, the three springs 92 have the same spring specifications such as spring load, spring length, shape, etc.

As described above, the conveyor belt 82 of the belt conveying unit 8M according to the sixth embodiment is stretched around the pair of roller-type pulleys 83, 84 with a predetermined tension determined by the positional relationship between the pulleys 83, 84 attached to the belt supporting member 86 via the pulley shafts 83*b*, 84*b*. The conveyor belt 82 is pressed by the pressing force of the spring 92 against the grip roller 81 that drives the pulley 83. The pulley 83 is provided in a freely rotatable manner, and is thus caused to rotate following the rotation of the grip roller 81.

When fitting the conveyor belt 82 around the pulleys 83, 84, if the rubber of the conveyor belt 82 is too hard, the straight portions (linear belt traveling surfaces) of the conveyor belt 82 between the pulleys 83, 84 tend to swell outward due to the hardness of the conveyor belt 82. In an effort to prevent this, the stretch rate of the conveyor belt 82 can be increased. However, when the stretch rate is increased, the tension of the conveyor belt 82 increases. As a result, the rotational load of the conveyor belt 82 increases, making it difficult to cause the conveyor belt 82 to rotate following the rotation of the grip roller 81.

Second Practical Example

As a second practical example, a test was conducted under the same test conditions as the test described with reference to FIG. 5 and Table 1. Test results shown in Table 2 indicate combinations of the rubber hardness, the stretch rate, and the belt thickness of the conveyor belt 82 made of ethylene propylene rubber. It was found that the conditions of these combinations do not cause a load obstructing the conveyor belt 82 from rotating following the rotation of the grip roller 81.

TABLE 2

| Rubber hardness JIS A (degrees) | Stretch rate (%) | Belt thickness (mm) |
|---|---|---|
| 30 | 10 | 1.5 |
| 40 | 7 | 1.5 |
| 60 | 6 | 1.5 |
| 80 | 5 | 1 |

Results shown in Table 2 say that even if the stretch rate is high, when the rubber hardness is low, the conveyor belt 82 is not obstructed from being rotated. When the rubber hardness is high (80 degrees), the same effects can be obtained by reducing the thickness of the conveyor belt 82. However, if the thickness of the conveyor belt 82 is reduced, the mechanical strength of the conveyor belt 82 decreases. Therefore, in consideration of abrasion with the passage of time, it is not preferable to reduce the thickness/size of the conveyor belt 82. Accordingly, it was found that the effects described below can be achieved by making the rubber hardness of the conveyor belt 82 to be relatively low at 30-90 degrees on a JIS A scale, without reducing its mechanical strength or causing abrasion with the passage of time.

According to the sixth embodiment, the following advantages/effects can be achieved. First, the conveyor belt 82 of the belt conveying unit 8M directly contacts the grip roller 81 (rotating conveying driving unit/rotating conveying driving member) that is rotated by the driving mechanism 22, so that the conveyor belt 82 is caused to rotate following the rotation of the grip roller 81. Irregularities in the linear speed of the conveyor belt 82 can be reduced more by driving the grip roller 81, compared to the case where the conveyor belt 82 is driven. Therefore, the following advantages can be achieved by arranging the conveyor belt 82 along the outer side of the turning (curving) section of the first conveying path A, which conveyor belt 82 rotates toward the holding section of the second conveying unit 7. That is, it is possible to enhance sheet conveying properties for conveying relatively rigid sheets such as cardboard at the turning section of the first conveying path A. Furthermore, by causing the conveyor belt 82 to rotate following the rotation of the grip roller 81 facing/directly contacting the conveyor belt 82, the sheet S can be conveyed at a steady linear speed beyond the second conveying unit 7.

These advantages/effects are easily understandable by considering the following technology. If the grip roller 81 is driven, the linear speed of the grip roller 81 is determined by the outside diameter of the grip roller 81 and the rotational speed. Conversely, in order to drive the conveyor belt 82, it is usually necessary to drive the roller-type pulley 83 (belt driving roller, main pulley) provided inside the conveyor belt 82.

In this case, the linear speed of the conveyor belt 82 is determined not only by the outside diameter and the rotational speed of the pulley 83 provided inside the conveyor belt 82. The linear speed is also affected by irregularities in the thickness of the conveyor belt 82 caused by irregularities in components, changes in the thickness of the conveyor belt 82 caused by attrition, or slipping actions between the conveyor belt 82 and the pulley 83. Therefore, irregularities in the linear speed of the conveyor belt 82 can be reduced more by driving the grip roller 81 rather than driving the conveyor belt 82.

Second, the pulleys 83, 84 (belt holding rotating members) are axially supported by the belt supporting member 86 (supporting member) in such a manner that a fixed distance is maintained between their axes. The pulley shafts 83*b*, 84*b* of the pulleys 83, 84 are arranged in the belt supporting member 86 in such a manner that the conveyor belt 82 configured with an elastic member has a longer circumference when stretched around the pulleys 83, 84 compared to when the conveyor belt 82 is by itself (in a non-stretched state). The sixth embodiment is not provided with a tightener, which is a typically used mechanism for applying tension to a belt. Instead, the conveyor belt 82 is elastically stretched between the two pulleys 83, 84. Therefore, the sixth embodiment is simple, space-saving, and cost-saving compared to a conventional configuration provided with a tightening mechanism such as a tightener.

Accordingly, the configuration of the sheet conveying apparatus with enhanced sheet conveying properties for conveying relatively rigid sheets such as cardboard at the turning section of the first conveying path A can be simple, space-saving, and cost-saving.

Third, the conveyor belt 82 is made of rubber with a relatively low hardness. Specifically, the rubber hardness of the conveyor belt 82 is relatively low at 30-90 degrees on a JIS A scale. Thus, the tension of the conveyor belt 82 can be reduced to a low level when it is stretched, without reducing its mechanical strength or causing abrasion with the passage of time. If the conveyor belt 82 has high tension, the rotational load of the conveyor belt 82 increases, because the conveyor belt 82 is caused to rotate following the rotation of the grip roller 81. As a result, it becomes difficult to cause the conveyor belt 82 to rotate following the rotation of the driven grip roller 81 at the same linear speed as that of the grip roller 81.

According to the sixth embodiment, the tension of the conveyor belt 82 can be reduced to a low level without reducing its mechanical strength or causing abrasion with the passage of time. Therefore, the rotational load of the conveyor belt 82 can be reduced, ensuring that the conveyor belt 82 is caused to rotate following the rotation of the driven grip roller 81. That is, it is possible to reduce the load obstructing the conveyor belt 82 from rotating following the rotation of the grip roller 81.

By making the conveyor belt 82 have a low rubber hardness, it is possible to reduce the noise made when the leading edge of the sheet S abuts the conveying surface 82*a* of the conveyor belt 82 and the flipping noise made when the trailing edge of the sheet S suddenly abuts the conveying surface 82*a* of the conveyor belt 82 as the trailing edge of the sheet S flips onto the conveyor belt 82.

Modification examples of the sixth embodiment are described by sequentially referring to FIGS. 34-38. As a matter of simplification in FIGS. 34-38, the belt supporting member 86 is illustrated schematically and the retaining rings are omitted. Apart from the conveying belts, the modification examples of the sixth embodiment described below are the same as the belt conveying unit 8M according to the sixth embodiment in terms of the assembly and shapes of components in the belt conveying unit.

Sixteenth Modification Example

Figure 34:
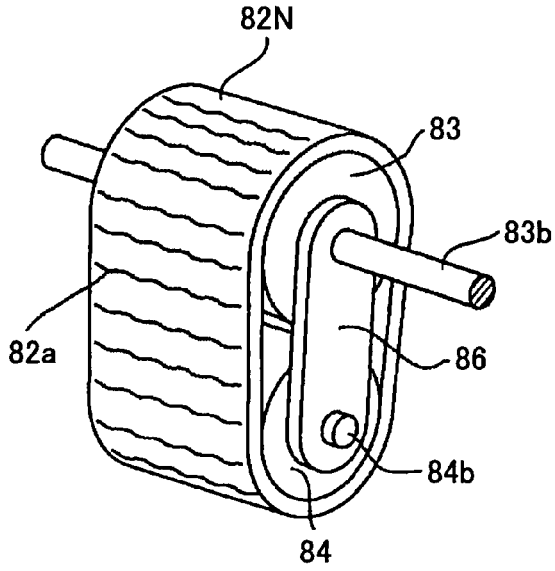
FIG. 34 is a perspective view of relevant parts of a belt conveying unit illustrating the shape of a conveying surface of a conveyor belt of a sheet conveying apparatus according to a sixteenth modification example.

FIG. 34 illustrates a sixteenth modification example, which is a modification example of the sixth embodiment. A conveyor belt 82N according to the sixteenth modification example is different from the conveyor belt 82 of the belt conveying unit 8M in the sheet conveying apparatus 5M according to the sixth embodiment shown in FIGS. 13, 23, 24, and 30-33 (hereinafter simply referred to as "conveyor belt 82 according to the sixth embodiment") as follows. That is, creases are formed on the conveying surface 82*a* of the conveyor belt 82N where the leading edge of the sheet S comes in contact with the conveyor belt 82N.

The grip roller 81 and the sheet S come in contact with the conveyor belt 82N only at the protruding parts of the creased conveying surface 82*a*. Therefore, the linear speed of the conveyor belt 82N is determined by the thickness of the protruding parts of the creases. The conveyor belt 82N is thin where the receding parts of the creases are positioned. Therefore, compared to the conveyor belt 82 that has an entirely uniform thickness, the rubber hardness of the conveyor belt 82N is reduced by changing the physical appearance thereof.

The example shown in FIG. 34 has relatively shallow creases formed by the protruding parts and the receding parts in a direction parallel to a substantial horizon. In respect to mass production, the creases are preferably formed with a metal mold. If mass production is not necessary, the creases can be formed by, for example, a grinding process.

The creases are not limited to protruding parts formed along a direction parallel to a substantial horizon; the creases can be in any direction or any pattern, as long as there are protruding parts and receding parts.

According to the sixteenth modification example, by employing the conveyor belt 82N having the conveying surface 82*a* with creases, the rubber hardness of the conveyor belt is reduced by changing the physical appearance thereof. Therefore, the tension of the conveyor belt 82N can be reduced to a low level when it is stretched.

If the conveyor belt has high tension, as the conveyor belt is caused to rotate following the rotation of the grip roller 81, the rotational load of the conveyor belt increases. As a result, it becomes difficult to cause the conveyor belt to move/rotate following the rotation of the driven grip roller 81 at the same linear speed as that of the grip roller 81.

According to the sixteenth modification example, the tension of the conveyor belt 82N can be reduced, and therefore, the rotational load of the conveyor belt 82N can be reduced, thus ensuring that the conveyor belt 82N is caused to rotate following the rotation of the driven grip roller 81. That is, it is possible to reduce the load obstructing the conveyor belt 82N from rotating following the rotation of the grip roller 81.

By making the conveyor belt 82N have a low rubber hardness, it is possible to reduce the noise made when the leading edge of the sheet S abuts the conveying surface 82*a* of the conveyor belt 82N and the flipping noise made when the trailing edge of the sheet S suddenly abuts the conveying surface 82*a* of the conveyor belt 82N as the trailing edge of the sheet S flips onto the conveyor belt 82N.

Seventeenth Modification Example

Figure 35A:
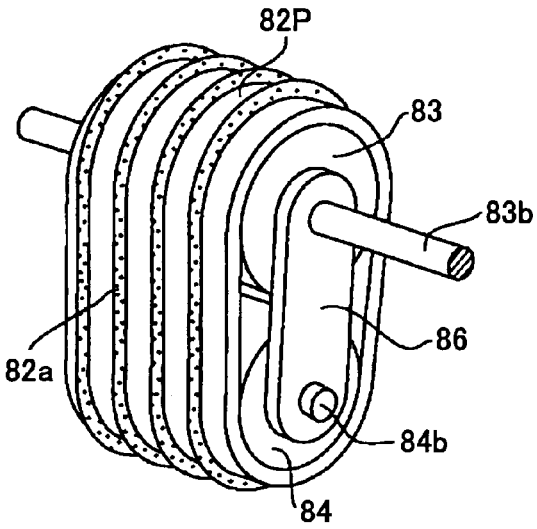
FIG. 35A is a perspective view of relevant parts of a belt conveying unit illustrating the shape of a conveying surface of a conveyor belt of a sheet conveying apparatus according to a seventeenth modification example and FIG. 35B is a plan sectional view of the center shaft of the upper pulley of the belt conveying unit shown in FIG. 35A.
Figure 35B:
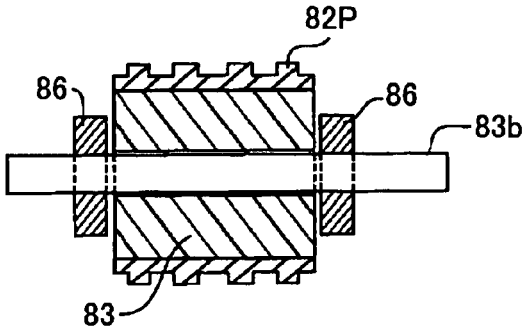

FIGS. 35A, 35B illustrate a seventeenth modification example, which is a modification example of the sixth embodiment. A conveyor belt 82P according to the seventeenth modification example is different from the conveyor belt 82 according to the sixth embodiment as follows. That is, protruding parts and receding parts extend along a direction substantially parallel to the sheet conveying direction on the conveying surface 82*a* of the conveyor belt 82P where the leading edge of the sheet S comes in contact with the conveyor belt 82P.

The grip roller 81 and the sheet S come in contact with the conveyor belt 82P only at the protruding parts of the conveying surface 82*a*. Therefore, the linear speed of the conveyor belt 82P is determined by the thickness of the protruding parts of the conveyor belt 82P. The conveyor belt 82P is thin where the receding parts of the creases are positioned. Therefore, compared to the conveyor belt 82 that has an entirely uniform thickness, the rubber hardness of the conveyor belt 82P is reduced by changing the physical appearance thereof.

In respect of mass production, the protruding/receding parts of the conveyor belt 82P are preferably formed with a metal mold. If mass production is not necessary, the protruding/receding parts can be formed by, for example, a grinding process (the same applies to modification examples below).

According to the seventeenth modification example, the conveying surface 82*a* where the leading edge of the sheet S contacts the conveyor belt 82P has protruding parts and receding parts extending along a direction substantially parallel to the sheet conveying direction. Therefore, the rubber hardness of the conveyor belt 82P is reduced by changing the physical appearance thereof, and the tension of the conveyor belt 82P can be reduced to a low level when it is stretched. Furthermore, the same advantages/effects as those of the sixteenth modification example can also be achieved.

Eighteenth Modification Example

Figure 36:
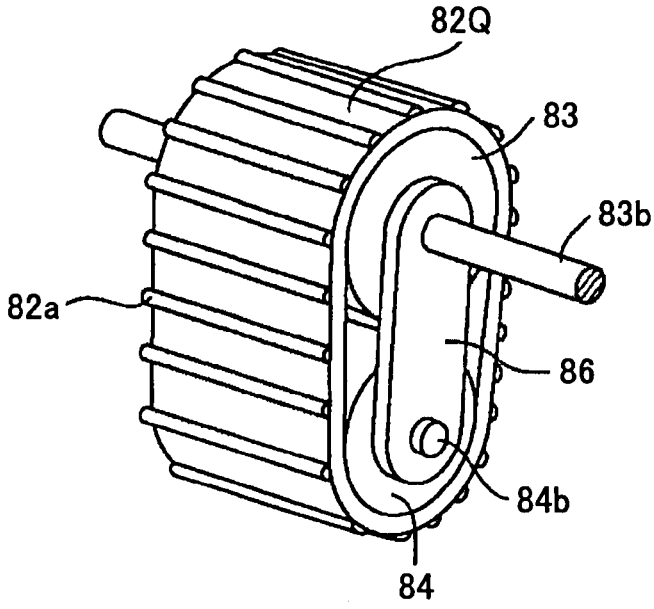
FIG. 36 is a perspective view of relevant parts of a belt conveying unit illustrating the shape of a conveying surface of a conveyor belt of a sheet conveying apparatus according to an eighteenth modification example.

FIG. 36 illustrates an eighteenth modification example, which is a modification example of the sixth embodiment. A conveyor belt 82Q according to the eighteenth modification example is different from the conveyor belt 82 according to the sixth embodiment as follows. That is, protruding parts and receding parts extend along a direction substantially orthogonal to the sheet conveying direction on the conveying surface 82*a* of the conveyor belt 82Q where the leading edge of the sheet S comes in contact with the conveyor belt 82Q.

The grip roller 81 and the sheet S comes in contact with the conveyor belt 82Q only at the protruding parts of the conveying surface 82*a*. Therefore, the linear speed of the conveyor belt 82Q is determined by the thickness of the protruding parts of the conveyor belt 82Q. The conveyor belt 82Q is thin where the receding parts are positioned. Therefore, compared to the conveyor belt 82 that has an entirely uniform thickness, the rubber hardness of the conveyor belt 82Q is reduced by changing the physical appearance thereof.

According to the eighteenth modification example, the conveying surface 82*a* where the leading edge of the sheet S contacts the conveyor belt 82Q has protruding parts and receding parts extending along a direction substantially orthogonal to the sheet conveying direction. Therefore, the rubber hardness of the conveyor belt 82Q is reduced by changing the physical appearance thereof, and the tension of the conveyor belt 82Q can be reduced to a low level when it is stretched. Furthermore, the same advantages/effects as those of the sixteenth modification example can also be achieved.

Nineteenth Modification Example

Figure 37:
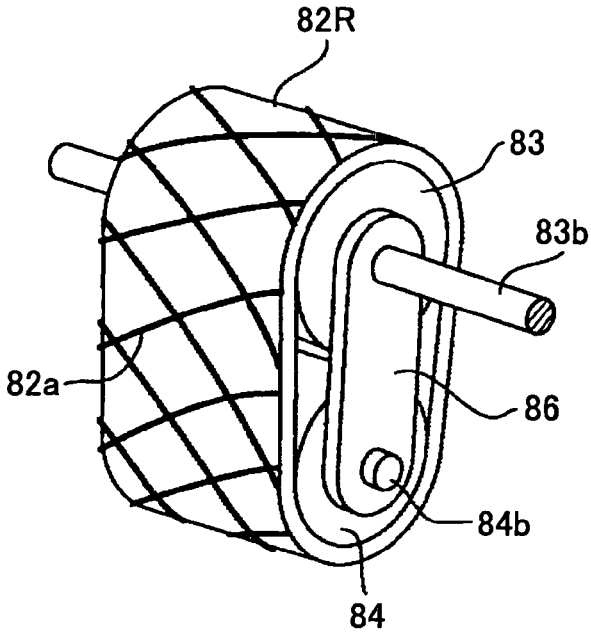
FIG. 37 is a perspective view of relevant parts of a belt conveying unit illustrating the shape of a conveying surface of a conveyor belt of a sheet conveying apparatus according to a nineteenth modification example.

FIG. 37 illustrates a nineteenth modification example, which is a modification example of the sixth embodiment. A conveyor belt 82R according to the nineteenth modification example is different from the conveyor belt 82 according to the sixth embodiment as follows. That is, protruding parts and receding parts are formed in oblique directions to the sheet conveying direction, i.e., knurled protruding parts and receding parts are formed on the conveying surface 82*a* of the conveyor belt 82R where the leading edge of the sheet S comes in contact with. The knurled parts indicated by thick black lines in FIG. 37 represent the protruding parts on the conveying surface 82*a*.

The grip roller 81 and the sheet S come in contact with the conveyor belt 82R only at the protruding parts of the conveying surface 82*a*. Therefore, the linear speed of the conveyor belt 82R is determined by the thickness of the protruding parts of the conveyor belt 82R. The conveyor belt 82R is thin where the receding parts of the creases are positioned. Therefore, compared to the conveyor belt 82 that has an entirely uniform thickness, the rubber hardness of the conveyor belt 82R is reduced by changing the physical appearance thereof.

According to the nineteenth modification example, the conveying surface 82*a* where the leading edge of the sheet S contacts the conveyor belt 82R has protruding parts and receding parts formed in oblique directions to the sheet conveying direction. Therefore, the rubber hardness of the conveyor belt 82R is reduced by changing the physical appearance thereof, and the tension of the conveyor belt 82R can be reduced to a low level when it is stretched. Furthermore, the same advantages/effects as those of the sixteenth modification example can also be achieved.

Twentieth Modification Example

Figure 38:
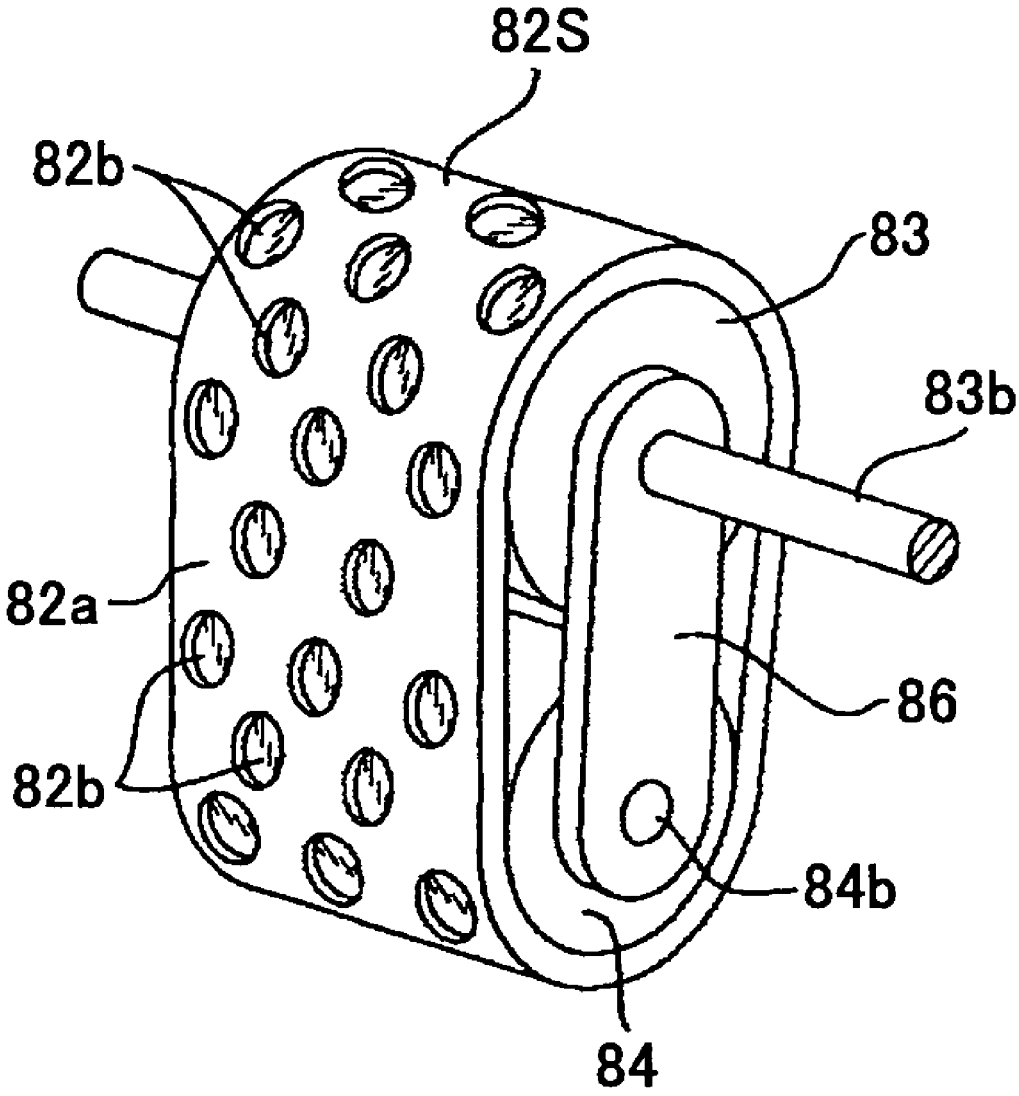
FIG. 38 is a perspective view of relevant parts of a belt conveying unit illustrating the shape of a conveying surface of a conveyor belt of a sheet conveying apparatus according to a twentieth modification example.

FIG. 38 illustrates a twentieth modification example, which is a modification example of the sixth embodiment. A conveyor belt 82S according to the twentieth modification example is different from the conveyor belt 82 according to the sixth embodiment as follows. That is, protruding parts and receding parts are formed in staggered directions to the sheet conveying direction on the conveying surface 82*a* of the conveyor belt 82S where the leading edge of the sheet S comes in contact with the conveyor belt 82S.

The grip roller 81 and the sheet S come in contact with the conveyor belt 82S only at the protruding parts of the conveying surface 82*a*. Therefore, the linear speed of the conveyor belt 82S is determined by the thickness of the protruding parts (corresponding to planar/flat parts in the twentieth modification example) of the conveyor belt 82S. The conveyor belt 82S is thin where the receding parts (corresponding to holes with closed bottoms in the twentieth modification example) are positioned. Therefore, compared to the conveyor belt 82 that has an entirely uniform thickness, the rubber hardness of the conveyor belt 82S is reduced by changing the physical appearance thereof.

According to the twentieth modification example, the conveying surface 82*a* where the leading edge of the sheet S contacts the conveyor belt 82S has protruding parts and receding parts formed in staggered directions with respect to the sheet conveying direction. Therefore, the rubber hardness of the conveyor belt 82S is reduced by changing the physical appearance thereof, and the tension of the conveyor belt 82S can be reduced to a low level when it is stretched. Furthermore, the same advantages/effects as those of the sixteenth modification example can also be achieved.

The protruding parts and receding parts are not limited to those of the conveyor belts 82N-82S according to the sixteenth-twentieth modification examples. The protruding parts and receding parts on the conveying surface 82*a* can be in any shape as long as the rubber hardness of the conveyor belt is reduced by changing the physical appearance thereof and the leading edge of the sheet is not obstructed.

As described above, the belt conveying units 8, 8A, 8H, 8K, and 8M of the sheet conveying apparatuses 5, 5A-5H, 5J, 5K, and 5M shown in FIGS. 1-4, 7-10, 11-21, 23, 24, 26, and 27-33 each acts as a moving/guiding unit for moving/guiding the sheet S toward the nip section (holding section) formed with the grip roller 81 while keeping the leading edge or a leading edge section (leading edge section has a broad meaning including the leading edge, the face at the leading edge, and the corners and edges at the leading edge) of the sheet S in contact with one member of the pair of rollers of the second conveying unit 7 (holding/conveying unit), and gradually increasing the contact surface with the sheet S according to the rigidity of the sheet S. The moving/guiding unit is not limited to the belt conveying units 8, 8A, 8H, 8K, and 8M as long as it has the above-described configurations/functions and the above-described effects can be achieved.

Figure 22B:
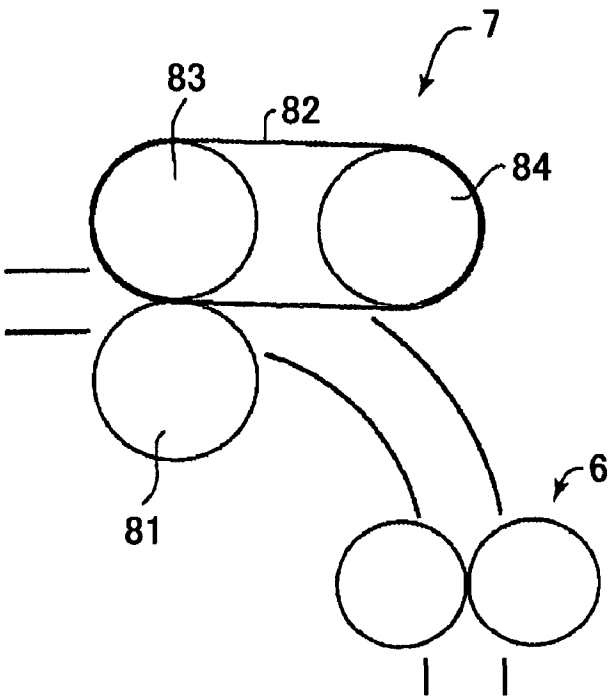
FIGS. 22A, 22B are schematic front views of arrangement examples of the first and second conveying units of a sheet conveying apparatus having different sheet conveying paths.

In the above-described embodiments, practical examples, and modification examples, the present invention is applied to a sheet conveying apparatus for conveying and feeding a sheet from a sheet storing unit (sheet feeding tray 51) in a copier acting as an image forming apparatus of an image forming unit main unit as shown in FIG. 1; however, the present invention is not limited thereto. The present invention is applicable to a sheet conveying apparatus in which the leading edge of a sheet S is ejected substantially upward from the top of the fixing device 11 of the main unit of the image forming apparatus, and then ejected from the main unit to the sheet eject tray 9 in a substantially horizontal direction (see, for example, see FIG. 22B). The present invention is also applicable to a sheet conveying apparatus in which a sheet placed on the substantially horizontal bypass tray 67 provided outside the main unit by a user is guided inside the main unit while maintaining its horizontal direction, and then the sheet changes its direction upward to be conveyed into a vertical conveying path that extends to the image forming section in the main unit.

Figure 22A:
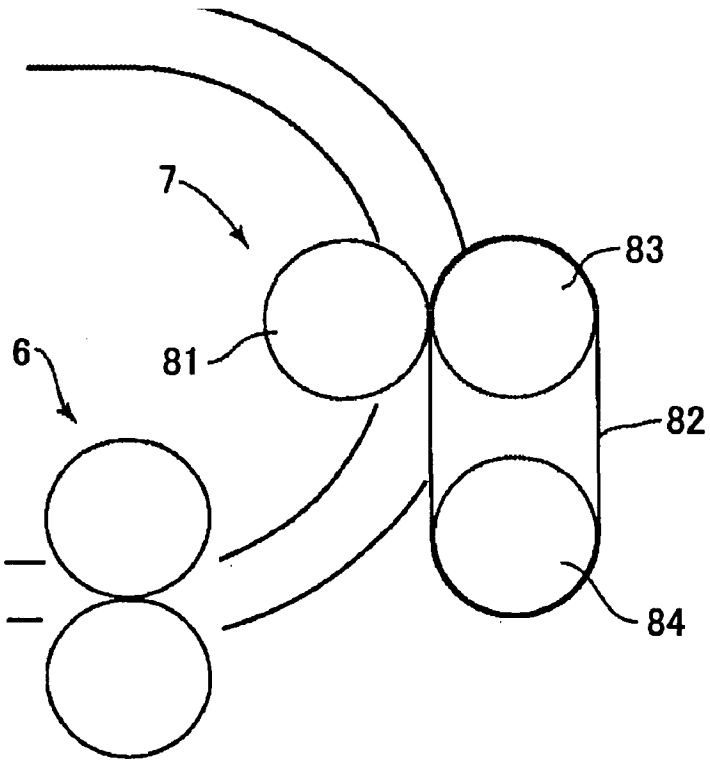

In the above-described embodiments and modification examples, the sheet is caused to change its direction from a substantially horizontal direction to a vertically upward direction (substantially directly upward); however, the present invention is not limited thereto. The sheet can change its direction from a substantially horizontal direction to a vertically downward direction (substantially directly downward), or from a vertically downward or upward direction to a substantially horizontal direction (see, for example, FIG. 22A), or from an oblique direction to another oblique direction.

In the above-described embodiments, practical examples, and modification examples, both the first conveying unit 6 and the second conveying unit 7 are holding/conveying units; however, depending on the conveying direction of each conveying unit, if it is only necessary to support the bottom face of the conveying object while being conveyed, the conveying units do not need to have holding/conveying units including holding sections formed by members facing each other.

The members of the first conveying unit, the second conveying unit, and the pickup rollers are not limited to the above. They can be a substantially extended cylinder with a predetermined length in the axial lengthwise direction of the rotational axis, or a short cylinder. Furthermore, plural rollers can be arranged in a discontinuous manner along a single rotational shaft with predetermined spaces therebetween.

In the conveying paths according to the above embodiments, several guiding members can be provided along the outer side or the inner side in the spaces where rollers are not arranged so as to form guiding surfaces. As long as such guiding surfaces are symmetrically arranged in an orderly manner with respect to a conveying center line, they can be band-like guiding surfaces or substantially linear guiding surfaces or a combination thereof.

In the above-described embodiments, practical examples, and modification examples, the FRR sheet feeding method is employed as the sheet feed separating mechanism; however, the present invention is not limited thereto. As long as a sheet can be separated from plural sheets overlapping each other by friction so that only one sheet is conveyed, any type of friction separating method can be employed. For example, a separating claw can be employed, or a friction pad method can be employed in which a friction pad acting as a fixing member is pressed against a feed roller. In this friction pad method, the friction pad acting as a friction member is pressed against the feed roller at an appropriate separating angle and separating pressure level. A sheet is caused to pass through a nip section formed by the feed roller and the friction pad. Accordingly, with the sheet feed separating mechanism employing the fiction pad method, even if two overlapping sheets are extracted, the bottom sheet receives a resistance from the friction pad that is larger than the resistance caused by the friction in between the overlapping sheets. Therefore, the bottom sheet is prevented from moving any further in the sheet conveying direction. Meanwhile, the top sheet receives a conveying force from the feed roller that is larger than the resistance caused by the friction in between the overlapping sheets and the resistance received from the friction pad. As a result, only the top sheet continues to move into the conveying direction.

The present invention is not limited to the monochrome copier 1; the sheet conveying apparatus according to the present invention is also applicable to a color copier or an image forming apparatus connected to a printer such as a monochrome laser printer, an inkjet printer, or an ink ribbon printer.

The present invention is similarly applicable to a color printer such as a direct transfer type tandem type color image forming apparatus in which images are sequentially transferred and superposed onto a sheet being conveyed by a transfer body, and a tandem type image forming apparatus in which images are transferred onto an endless intermediate transfer belt acting as an intermediate transfer body and then transferred onto a sheet at once. As a matter of course, the present invention is also applicable to an image forming apparatus including a single, endless belt-type photoconductor.

The present invention is not limited to an image forming apparatus that is an in-body paper eject type (sheet eject tray is located within the main unit of the image forming apparatus, between an image forming unit and a scanner); the present invention is also applicable to an image forming apparatus with a paper eject tray provided on the side of the main unit of the image forming apparatus. The present invention is not limited to a conveying path for conveying a sheet extracted from the sheet feeding device 3 substantially vertically upward (substantially directly upward) toward the top of the image forming apparatus main unit 2; the present invention is also applicable to an image forming apparatus in which the conveying path from the sheet feeding device to the sheet eject tray is not substantially vertically upward (substantially directly upward).

The present invention is also applicable to a sheet conveying apparatus in a printing machine including stencil printing machines, for conveying a sheet from a sheet storing unit (sheet feeding tray) or a sheet stacking unit (sheet feeding stage) to a printing machine main unit.

In the above-described copier 1 acting as the image forming apparatus, the original to be scanned is manually set; however, the image forming apparatus can be a copier or a printing machine provided with an ADF (automatic document feeder) for automatically scanning plural originals (sheets), and the sheet conveying apparatus according to the present invention can be provided in the ADF.

The image forming apparatus is not limited to a copier; the image forming apparatus can be a facsimile machine, a printer, an inkjet recording device, or an image scanning device, provided with a scanner for scanning an image from an original, whose main function is to scan images, and a multifunction peripheral combining at least two of the above. In any of these apparatuses, an optimum sheet conveying apparatus can be provided for changing the sheet conveying direction in conveying various types of sheets, while saving space in the sheet conveying path.

The present invention is not limited to providing sheet conveying apparatuses to plural sheet feeding stages. For example, the present invention is applicable in a case where the top sheet feeding tray 51 and the sheet conveying apparatus 5' are removed from the sheet feeding device 3 shown in FIG. 1 so that the sheet feeding device 3 only includes a single sheet feeding tray 51 and a single sheet conveying apparatus 5.

That is, the present invention is applicable to an image scanning apparatus provided with the sheet conveying apparatus according to an embodiment of the present invention, and to an image forming apparatus provided with the sheet conveying apparatus and/or the image scanning apparatus according to an embodiment of the present invention. The image forming apparatus according to an embodiment of the present invention can be any one of a copier, a facsimile machine, a printer, a printing machine, and an inkjet recording device, or a multifunction peripheral combining at least two of the above.

Seventh Embodiment

Figure 39:
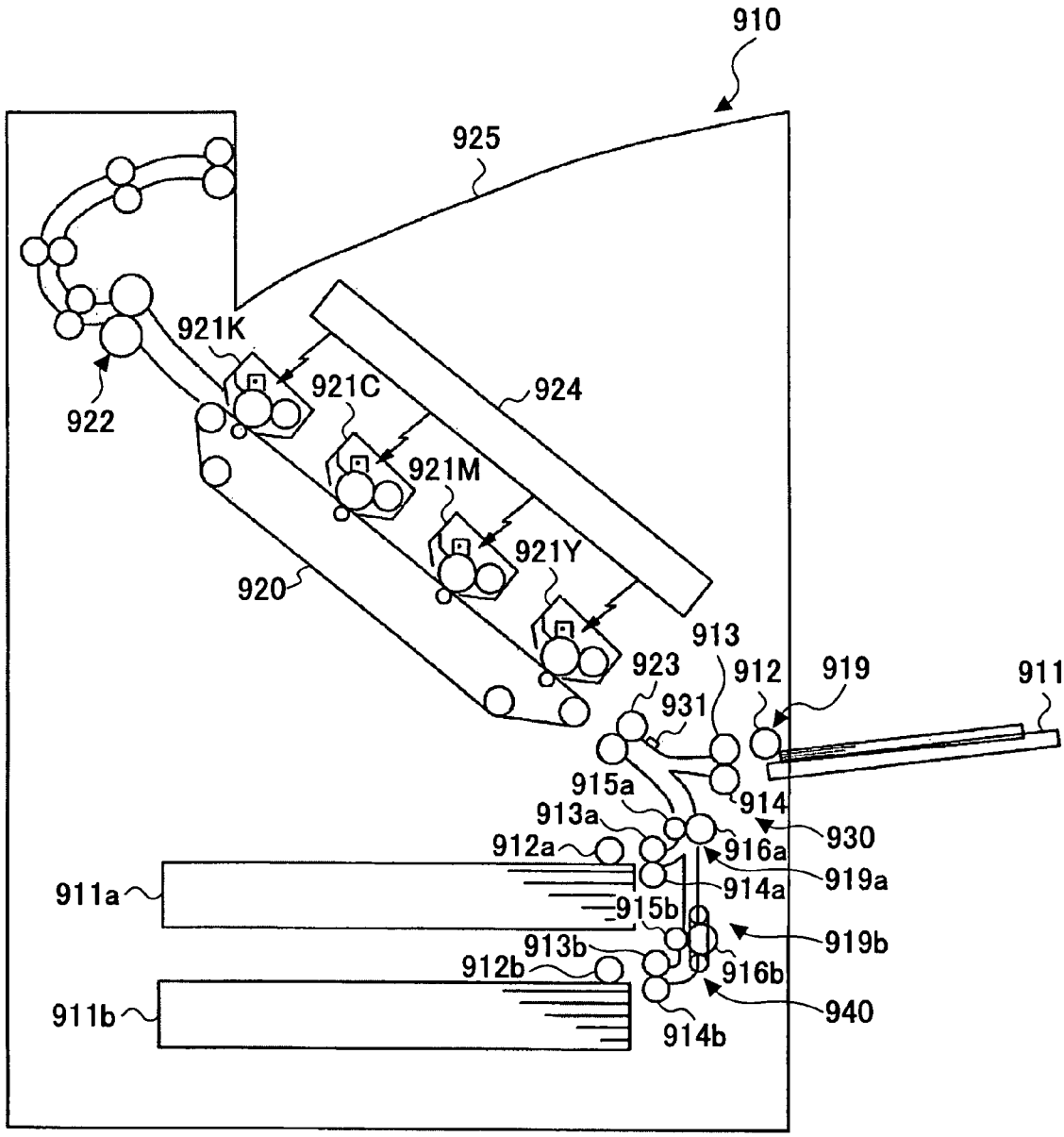
FIG. 39 is a schematic diagram of an image forming apparatus according to a seventh embodiment of the present invention.

An image forming apparatus according to a seventh embodiment of the present invention is described with reference to FIGS. 39-41. FIG. 39 is a schematic diagram of an image forming apparatus provided with a sheet feeding device.

The image forming apparatus according to the seventh embodiment is a full-color printer 910. The printer 910 includes four image forming sections 921Y, 921M, 921C, and 921K corresponding to yellow (Y), magenta (M), cyan (C), and black (K), respectively, and a writing unit 924 for writing images with laser beams in the image forming sections 921Y, 921M, 921C, and 921K. Each of the image forming sections 921Y, 921M, 921C, and 921K includes a photoconductive drum, a discharging device, a developing device, a transfer device and a cleaning unit. On the corresponding photoconductive drums, a yellow toner image, a magenta toner image, a cyan toner image, and a black toner image are formed.

The printer 910 is provided with a sheet conveying apparatus 930. The sheet conveying apparatus 930 includes three sheet feeding devices 919, 919*a*, and 919*b*. A recording sheet S fed out from any one of the sheet feeding devices 919, 919*a*, and 919*b* is conveyed by a transfer belt 920 arranged facing the image forming sections 921Y-921K. Toner images of the respective colors are superposed and transferred onto the conveyed recording sheet S from the image forming sections 921Y-921K. The recording sheet S onto which the toner images are transferred passes through a fixing device 922. Heat and pressure are applied so that the toner images are fixed on the recording sheet S. After passing through the fixing device 922, the recording sheet S is ejected onto a sheet eject tray 925.

As described above, the image forming apparatus according to the seventh embodiment includes an imaging creating unit for creating an image on a recording sheet S and the sheet feeding devices 919, 919*a*, and 919*b* for feeding the recording sheet S to the imaging creating unit. The first sheet feeding device 919 is a bypass sheet feeding device that feeds a recording sheet P manually set by a user on a sheet feeding tray 911. The second and third sheet feeding devices 919*a*, 919*b* feed the recording sheet P stacked in sheet feeding trays 911*a*, 911*b*, respectively.

The sheet feeding devices 919, 919*a*, and 919*b* respectively include pickup rollers 912, 912*a*, and 912*b* acting as recording sheet separating units for picking up the stacked sheets P, feed rollers 913, 913*a*, and 913*b* arranged on the downstream side in the recording sheet conveying direction of the pickup rollers 912, 912*a*, and 912*b*, and reverse rollers 914, 914*a*, and 914*b* forming pairs with/in contact with the feed rollers 913, 913*a*, and 913*b*. As common elements, there are provided grip rollers 915*a*, 915*b*, a pair of resist rollers 923, and a recording sheet detecting unit 931 acting as a resist sensor, arranged on the downstream side in the recording sheet conveying direction.

The recording sheet S sent out of the sheet feeding trays 911, 911*a*, and 911*b* abuts the pair of resist rollers 923 and stops temporarily. Subsequently, at a predetermined timing, the pair of resist rollers 923 resumes rotation to feed the recording sheet S in between the photoconductors and the transfer belt 920 at such a timing that the toner images on the photoconductors of the image forming sections 921Y-921K are properly transferred onto the recording sheet S.

The sheet conveying apparatus 930 according to the seventh embodiment is employed for sheet feeding devices such as the sheet feeding device 919*b* arranged on the lower stage. In the sheet feeding device 919*b*, the recording sheet P is caused to abruptly change its conveying direction after being fed out from the feed roller 913*b* and before reaching the grip roller 915*b* arranged on the downstream side, so as to reduce the overall size of the apparatus.

Figure 40:
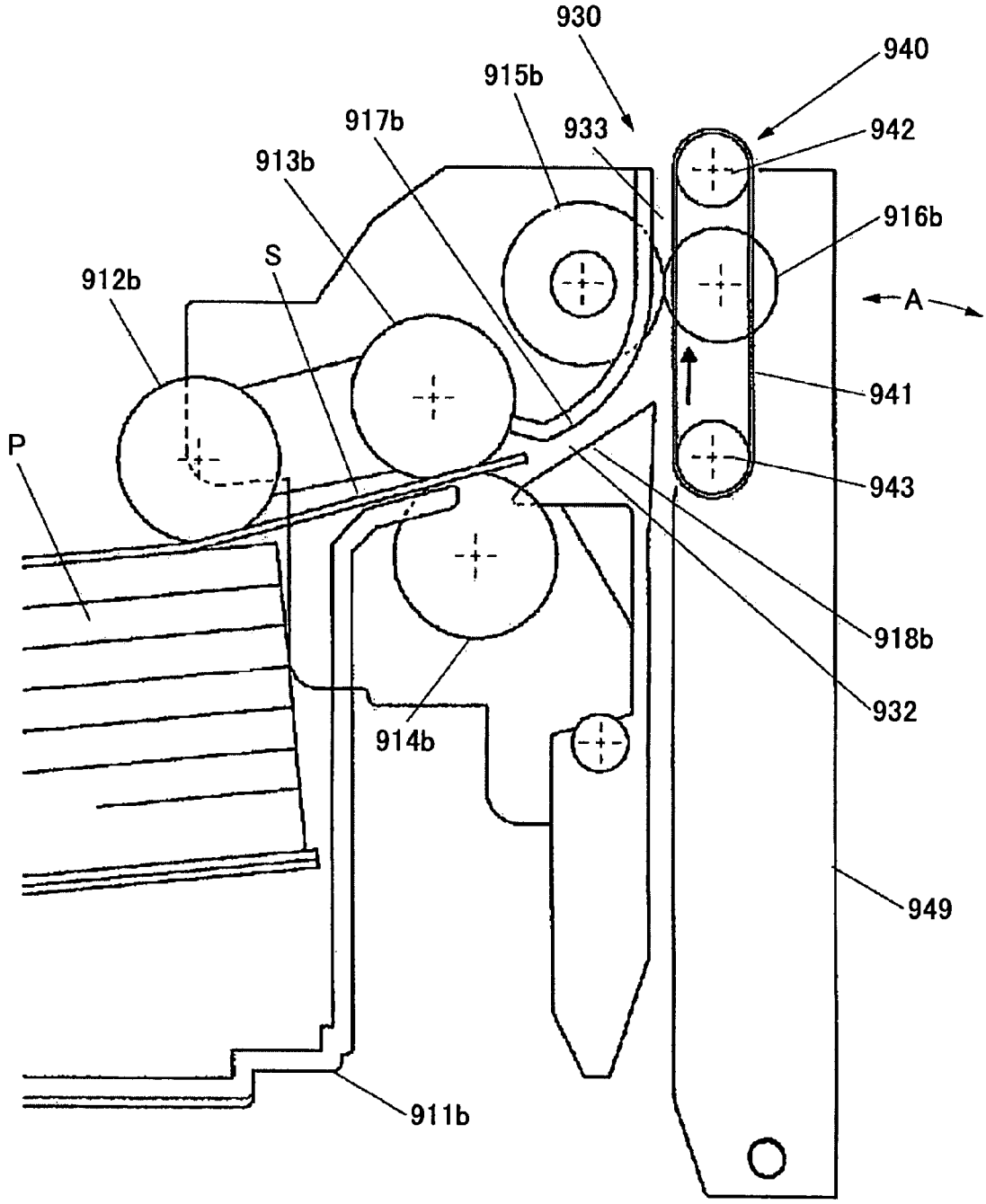
FIG. 40 is a schematic sectional view of a sheet conveying apparatus provided in the image forming apparatus according to the seventh embodiment.

FIG. 40 is a sectional side view of the sheet feeding device 919*b* arranged on the lower stage, which is one of the sheet feeding devices of the above-described printer 910. The sheet feeding device 919*b* according to the seventh embodiment includes the pickup roller 912*b* for separating a single recording sheet S from a stack of sheets P stacked on the sheet feeding tray 911*b*, the feed roller 913*b* for conveying the recording sheet S from the pickup roller 912*b* along a substantially horizontal direction toward the downstream side, and the reverse roller 914*b*. The pickup roller 912*b*, the feed roller 913*b*, and the reverse roller 914*b* operate as the recording sheet separating unit.

The sheet conveying apparatus 930 includes an upper conveying guide section 917*b* and a lower conveying guide section 918*b* acting as guide sections. The guide sections change the conveying direction of the recording sheet S sent from the feed roller 913*b* and the reverse roller 914*b* in a substantially orthogonal direction with respect to the conveying direction of the recording sheet separating unit. A curved recording sheet conveying path 932 is provided in between the upper conveying guide section 917*b* and the lower conveying guide section 918*b*. At the outlet (downstream side) of the upper conveying guide section 917*b* and the lower conveying guide section 918*b*, a recording sheet conveying path 933 is provided to further guide the recording sheet S in the direction (upward) changed by the guide sections. In the seventh embodiment, the two grip rollers 915*a*, 915*b* are arranged in the recording sheet conveying path 933 for holding and conveying the recording sheet S. In the seventh embodiment, the recording sheet conveying path 933 also includes a belt conveying unit 940 acting as an auxiliary conveying unit.

Figure 41:
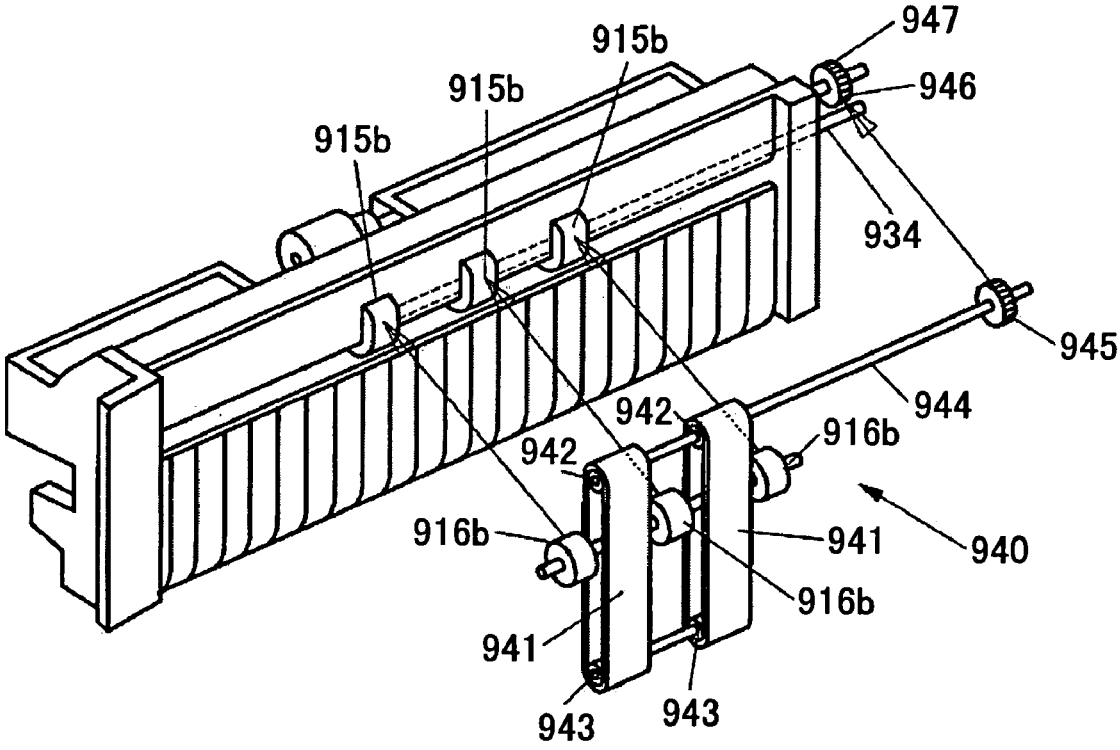
FIG. 41 is a perspective view of the sheet conveying apparatus according to the seventh embodiment.

FIG. 41 is a perspective view of the sheet conveying apparatus 930 according to the seventh embodiment. The belt conveying unit 940 according to the seventh embodiment includes an endless belt member 941 made of a conductive material such as conductive synthetic resin stretched around a driving roller 942 and a subordinate roller 943. The endless belt member 941 is arranged in the recording sheet conveying path 933. The leading edge of the recording sheet S that has passed through the recording sheet conveying path 932 contacts the endless belt member 941 so as to be guided by the endless belt member 941.

In the seventh embodiment, there are two sets of the belt member 941, the driving roller 942, and the subordinate roller 943 juxtaposed to one another. The juxtaposed driving rollers 942 are driven by a rotational shaft 944. The rotational shaft 944 is driven via spur gears 945, 946 by a driving shaft 947, which driving shaft 947 is driven by a not shown motor. The rotational speed of the conveyor belt (belt member 941) is preferably higher than the conveying speed of the recording sheet.

In the seventh embodiment, the belt conveying unit 940 is arranged in a vertical conveying cover 949 that can open/close (in directions indicated by an arrow A) to resolve a paper jam. Meanwhile, the above-mentioned motor is arranged in the main unit of the image forming apparatus so that the spur gears 945, 946 mesh together when the vertical conveying cover 949 is closed.

In the seventh embodiment, the grip roller 915*b* is driven via a shaft 934 by a motor other than the motor of the belt conveying unit 940.

In the seventh embodiment, when the recording sheet S reaches the recording sheet conveying path 933 via the recording sheet conveying path 932, the leading edge of the recording sheet S is guided by the rotated conveyor belt (belt member 941). Furthermore, a conveying force is applied from the conveyor belt (belt member 941) to the recording sheet S. Thus, even in a conveying path with a small curvature radius, the recording sheet S can be steadily conveyed.

In the seventh embodiment, the belt member 941 is made of a conductive member, and therefore, it is possible to prevent friction charging from occurring between the recording sheet S and the belt member 941. Thus, the image quality can be stably maintained.

As described above, in the seventh embodiment, it is possible to make the rotational speed of the conveyor belt higher than the conveying speed of the recording sheet, reduce the collision load when the recording sheet conveyed by the feed roller abuts the conveyor belt, and reduce failures in which the leading edge of the recording sheet becomes folded, etc. Furthermore, the vertical conveying cover can be space-saving and light-weight.

In the seventh embodiment, the belt conveying unit 940 is only provided on the lower sheet feeding device 919*b*; however, the belt conveying unit 940 can be provided on the upper sheet feeding device 919*a*.

Eighth Embodiment

Figure 42:
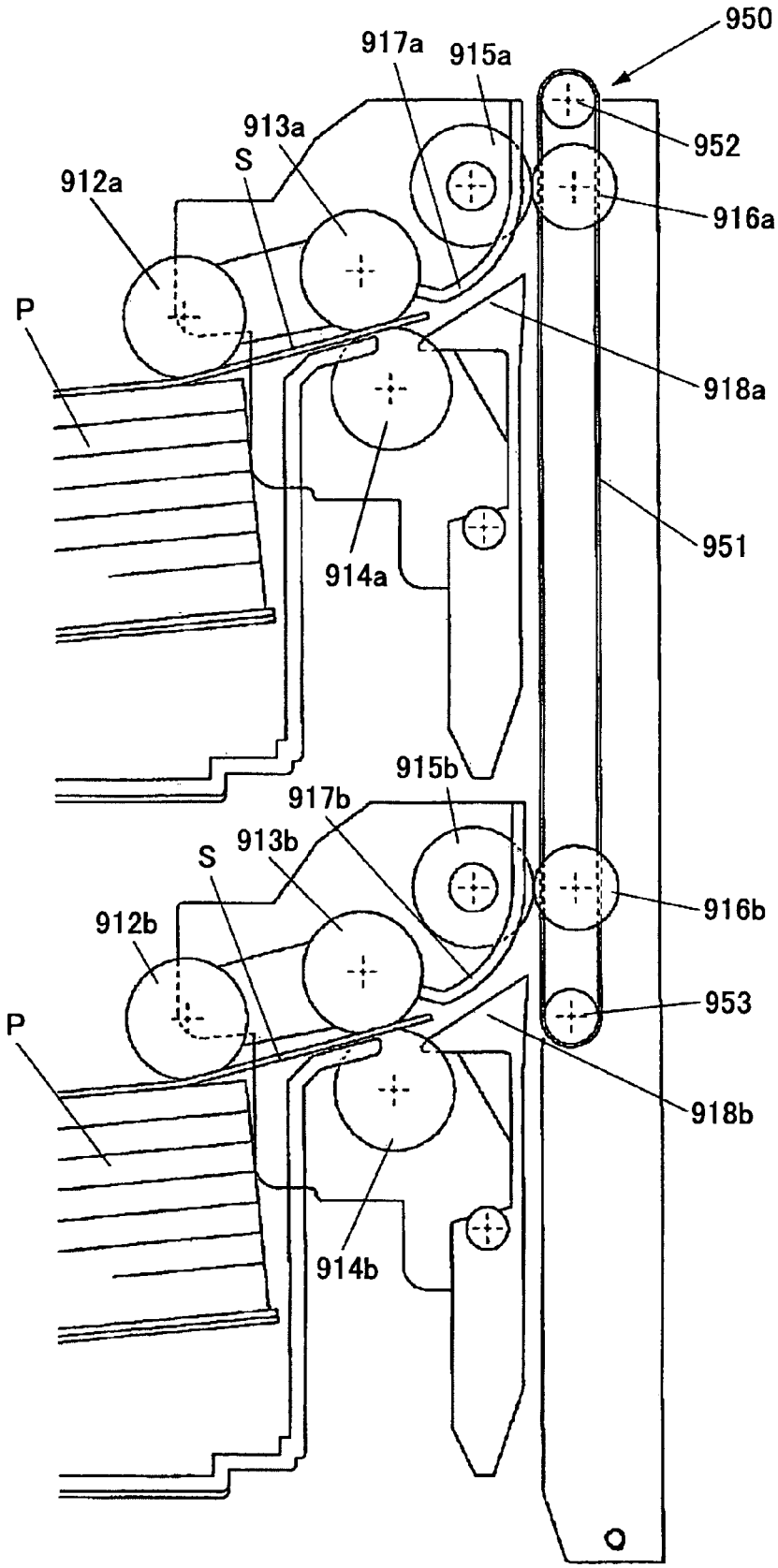
FIG. 42 is a schematic diagram of a sheet conveying apparatus according to an eighth embodiment of the present invention.

Next, an image forming apparatus according to an eighth embodiment of the present invention is described. FIG. 42 is a schematic sectional side view of a sheet conveying apparatus according to the eighth embodiment. The sheet conveying apparatus according to the eighth embodiment includes a belt conveying unit 950. In the belt conveying unit 950 according to the eighth embodiment, in the image forming apparatus provided with upper and lower stages of the sheet feeding devices 919*a* and 919*b*, one belt conveying unit 950 is provided for the sheet feeding devices 919*a* and 919*b*.

The sheet feeding device 919*a* includes the pickup roller 912*a*, the feed roller 913*a*, the reverse roller 914*a*, grip rollers 915*a*, 916*a*, an upper conveying guide section 917*a*, and a lower conveying guide section 918*a*. The sheet feeding device 919*b* has the same structure as that of the seventh embodiment, including the pickup roller 912*b*, the feed roller 913*b*, the reverse roller 914*b*, the grip rollers 915*b*, 916*b*, the upper conveying guide section 917*b*, and the lower conveying guide section 918*b*.

The belt conveying unit 950 includes an endless belt member 951 provided across the sheet feeding devices 919*a* and 919*b*. The endless belt member 951 is stretched around a driving roller 952 and a subordinate roller 953.

With the sheet conveying apparatus according to the eighth embodiment, in addition to achieving the effects of the seventh embodiment, it is possible to reduce the number of components, reduce cost, and reduce failures in which the leading edge of the recording sheet becomes folded, etc.

The image forming apparatus according to the seventh and eighth embodiments of the present invention is a printer; however, the image forming apparatus can be any one of a copier, a facsimile machine, or a multifunction peripheral provided with a scanning function.

Twenty-First Modification Example

Figure 43:
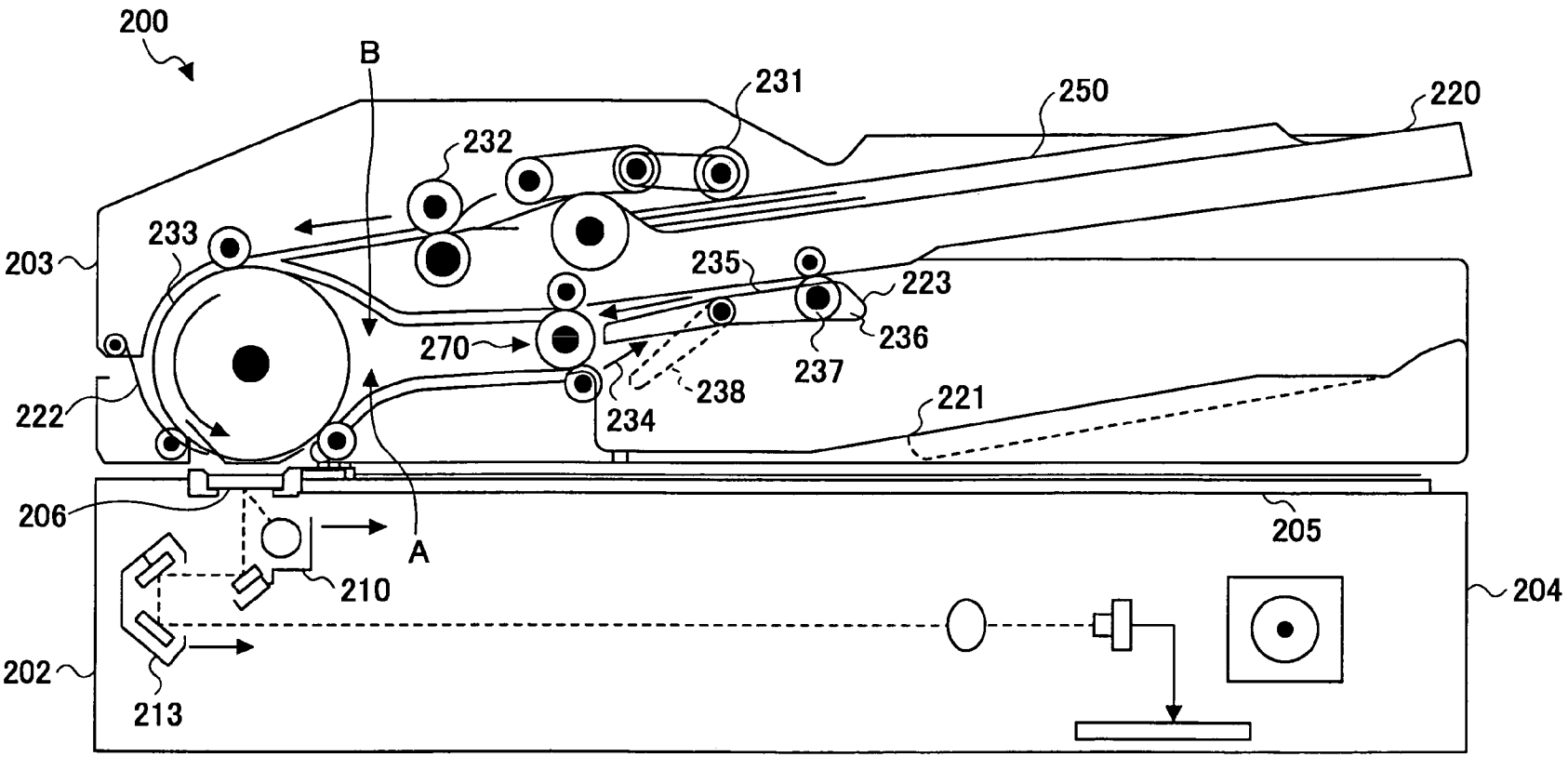
FIG. 43 is a sectional side view schematically depicting the internal configuration of a scanner device according to a twenty-first modification example.

A twenty-first modification example is explained in which the sheet conveying apparatus according to an embodiment of the present embodiment is applied to a scanner device having an automatic document feeding device. FIG. 43 is a sectional side view schematically depicting the internal configuration of a scanner device 200 according to the present modification example. As shown in FIG. 43, the scanner device 200 includes a scanner body 202, and a reversing automatic document feeder (RADF) 203, which is one type of an automatic document feeder (ADF) acting as an automatic document feeding unit, provided on the upper portion of the scanner body 202.

On the upper surface of a box 204 of the scanner body 202 are a document placement glass 205 on which a document is placed at the time of reading a document image in a book document reading mode, and an ADF document glass 206, which is a conveyed document reading glass for use at the time of reading a document image in a sheet document reading mode.

Here, the book document reading mode is an operation mode of reading an image on a document placed on the document placement glass 205. The sheet document reading mode is an operation mode of reading an image on a document when the document is automatically fed by the RADF 203 and the automatically-fed document passes through the ADF document glass 206. Here, such operation modes can be set through a main operation panel (not shown) provided outside the box 204.

Next, the RADF 203 for use under the setting of the sheet document reading mode is explained. Here, under such setting of the sheet document reading mode, a first carriage 210 and a second carriage 213 stop under the ADF document glass 206 as a home position. Then, the document automatically fed by the RADF 203 is read and scanned.

The RADF 203 is provided with a document table 220 on which a document 250 is placed at the time of reading the document in the sheet document reading mode, a paper delivering unit 221 for delivering the document 250 after reading is completed, a document conveying path 222 communicating from the document table 220 to the paper delivering unit 221, and a reversing unit 223 that reverses the document 250 in a reverse reading mode. Here, the reverse reading mode is one type of sheet document reading mode in which, after the document 205 is automatically fed by the RADF 203 and an image on the front side is read and scanned, the document 250 is reversed for reading and scanning an image on the back side.

On the document table 220 side of the document conveying path 222, a pickup roller 231 and a conveyor roller 232 are provided for separating document sheets placed on the document table 220 one by one for feeding. These pickup roller 231 and conveyor roller 232 are driven by a paper feeding motor (not shown). That is, with the pickup roller 231 and the conveyor roller 232 being driven by the paper feeding motor, the document 250 placed on the document table 220 is fed one by one to the document conveying path 222.

In addition, the document conveying path 222 is provided with a conveyor drum 233 for conveying the document 250 and conveying the document 250 to the paper delivering unit 221. Under this conveyor drum 233 is the ADF document glass 206. This conveyor drum 233 is driven by a stepping motor (not shown). Therefore, with the conveyor drum 233 being driven by the stepping motor, the document 250 fed from the document table 220 to the document conveying path 222 is guided onto the ADF document glass 206.

With this, the document 250 placed on the document table 220 is fed one by one by the pickup roller 231, and then conveyed by the conveyor roller 232 and the conveyor drum 233 to the ADF document glass 206, which is a document reading position.

Also, the reversing unit 223 is provided with a reversing table 236 that forms a reverse path 235 with one end communicating with a branching point 234 at which the document conveying path 222 is branched midway. This reversing table 236 is provided with a reverse roller 237 rotatably driven by a paper-feeding and reverse motor (not shown) in forward and reverse directions. Also, the reverse path 235 has mounted thereon a branch nail 238 that can freely rotate about a spindle. This branch nail 238 distributes the document 250 conveyed from the conveyor drum 233 to a paper delivery unit 270 to either one of the reversing unit 223 or the paper delivering unit 221 by opening and closing the reverse path 235 with respect to the document conveying path 222 through rotation of the spindle. That is, under the setting of the reverse reading mode, which is one type of sheet document reading mode, the branch nail 238 opens the reverse path 235 with respect to the document conveying path 222 through rotation of the spindle, thereby guiding the document 250 conveyed by the conveyor drum 233 to the reverse path 235. Then, the branch nail 238 causes the reversed document 250 to be again conveyed by the reverse roller 237 to the document conveying path 222.

In the scanner device 200 according to the present modification example, the sheet conveying apparatus explained above can be applied to a curved portion A in the paper delivery unit 270 to a paper delivery outlet from which the paper is delivered after passing through the reading position, and also can be applied to the reversing unit.

That is, the curved portion A where the sheet conveying direction is abruptly changed in a conveying path between the conveyor drum 233 and the paper delivery unit 270 and a curved portion B in a conveying path between the reversing unit 223 that reverses the sheet side to the conveyor drum 233 can be configured to be provided with the first conveying unit 6 (the feed roller 61 and the reverse roller 62), the second conveying unit 7 (the grip roller 81, the pulley 83, the pulley 84, the conveyor belt 82, and the belt conveying unit 8 including the conveyor belt 82), the tension roller 85, and the conveying guiding members 70, 71. Other than these portions, any curved portion in which the sheet conveying direction is abruptly changed in the sheet conveying path can be configured to be provided with the first conveying unit 6 (the feed roller 61 and the reverse roller 62), the second conveying unit 7 (the grip roller 81, the pulley 83, the pulley 84, the conveyor belt 82, and the belt conveying unit 8 including the conveyor belt 82), the tension roller 85, the conveying guiding members 70, 71.

The present invention is not limited to the specifically disclosed embodiments, modification examples, or examples, and variations and modification examples may be made without departing from the scope of the present invention.

The present application is based on Japanese Priority Patent Application No. 2006-115702, filed on Apr. 19, 2006, Japanese Priority Patent Application No. 2006-134882, filed on May 15, 2006, Japanese Priority Patent Application No. 2006-194782, filed on Jul. 14, 2006, Japanese Priority Patent Application No. 2006-202170, filed on Jul. 25, 2006, and Japanese Priority Patent Application No. 2007-018467, filed on Jan. 29, 2007, the entire contents of which are hereby incorporated by reference.

What is claimed is:

1. A sheet conveying apparatus, comprising:

a first conveying unit which conveys a sheet in a first sheet conveying direction; and a second conveying unit arranged on a downstream side of the first conveying unit in the first sheet conveying direction and which conveys the sheet conveyed by the first conveying unit in a second sheet conveying direction different from the first sheet conveying direction, wherein:

among the first conveying unit and the second conveying unit, at least the second conveying unit acts as a holding and conveying unit with a holding section to hold and convey the sheet and includes a moving and guiding unit which is positioned along an outer side of a sheet conveying path extending between the first conveying unit and the second conveying unit, the moving and guiding unit moves and guides the sheet toward the holding section of the second conveying unit, the moving and guiding unit is arranged so that a leading edge of the sheet approaches a conveying surface of the moving and guiding unit at an acute collision angle θ, the moving and guiding unit includes at least one belt conveying unit having a plurality of belts so as to convey the sheet toward the holding section of the second conveying unit, the holding section of the second conveying unit is provided on a downstream side of the conveying surface of the moving and guiding unit, and the plurality of belts are arranged along the sheet width direction so as to contact at least one part of the sheet in the sheet width direction.

2. The sheet conveying apparatus according to claim 1, wherein a first guiding member comprising a guide surface for guiding the conveyed sheet is arranged where the belt conveying unit is located and near the sheet conveying path, and a conveying surface of the belt with which the sheet comes in contact is substantially level with the guide surface or protrudes inward into the sheet conveying path.

3. The sheet conveying apparatus according to claim 1, wherein the holding and conveying unit comprises a pair of members facing each other, wherein one of the members includes plural rotating conveying members arranged on the same axis so as to rotate and drive thereabout, and at least one said belt conveying unit is provided facing the rotating conveying members.

4. The sheet conveying apparatus according to claim 1, wherein plural said belts arranged along the sheet width direction move separately from each other.

5. The sheet conveying apparatus according to claim 4, wherein a linear speed of one of the belts arranged in the center in the sheet width direction is higher than linear speeds of the other belts.

6. The sheet conveying apparatus according to claim 1, wherein the holding and conveying unit comprises a pair of members facing each other, wherein one of the members is configured with plural rotating conveying members arranged on the same axis so as to rotate and drive, each of the belts is movably held by at least two belt holding rotating members, and at least one of the belt holding rotating members facing the rotating conveying members has flanges provided along both circumferential rims thereof and protruding from its circumferential surface in a radial direction.

7. The sheet conveying apparatus according to claim 1, wherein the holding and conveying unit comprises a pair of members facing each other, wherein one of the members is configured with plural rotating conveying members arranged on the same axis so as to rotate and drive thereabout, each of the belts is movably held by at least two belt holding rotating members, a width of the belt in the sheet width direction and a width of at least one of the belt holding rotating members facing the rotating conveying members are less than a width of each of the rotating conveying members, and at least one of the belt holding rotating members facing the rotating conveying members has flanges provided along both circumferential rims thereof and protruding from its circumferential surface in a radial direction.

8. An image scanning apparatus provided with the sheet conveying apparatus according to claim 1.

9. An image forming apparatus provided with the sheet conveying apparatus according to claim 1.

10. The sheet conveying apparatus according to claim 1, wherein the second conveying unit acting as the holding and conveying unit comprises a pair of members facing each other, wherein one of the members is a rotating conveying driving unit that transmits a driving force to the other member by rotating, and the other member is the moving and guiding unit arranged along the outer side of the sheet conveying path extending between the first conveying unit and the second conveying unit, the moving and guiding unit being caused to rotate following rotation of the rotating conveying driving unit to move and guide the sheet toward the holding section.

11. A sheet conveying apparatus, comprising:

a first conveying unit which conveys a sheet in a first sheet conveying direction; and a second conveying unit arranged on a downstream side of the first conveying unit in the first sheet conveying direction and which conveys the sheet conveyed by the first conveying unit in a second sheet conveying direction different from the first sheet conveying direction, wherein:

among the first conveying unit and the second conveying unit, at least the second conveying unit acts as a holding and conveying unit with a holding section to hold and convey the sheet, the holding and conveying unit includes a rotating conveying driving unit and a moving and guiding unit facing each other such that the rotating conveying driving unit transmits a driving force to the moving and guiding unit via rotation, the moving and guiding unit is positioned along an outer side of a sheet conveying path extending between the first conveying unit and the second conveying unit, the moving and guiding unit is caused to rotate following rotation of the rotating conveying driving unit to move and guide the sheet toward the holding section of the second conveying unit, the holding section of the second conveying unit is provided on a downstream side of a conveying surface of the moving and guiding unit, the rotating conveying driving unit is a roller-type rotating conveying driving member, and the moving and guiding unit includes a belt conveying unit provided with a belt that directly contacts the rotating conveying driving member and is caused to rotate following rotation of the rotating conveying driving member.

12. The sheet conveying apparatus according to claim 11, wherein the belt conveying unit includes the belt made of an elastic member, at least one pair of belt holding rotating members is movably to hold the belt, and a supporting member is rotatably and axially support the belt holding rotating members, the belt holding rotating members are axially supported by the supporting member in such a manner that a predetermined distance is maintained between the belt holding rotating members, and axes of the belt holding rotating members are arranged in the supporting member in such a manner that the belt has a longer circumference when stretched around the belt holding rotating members compared to when the belt is by itself in a non-stretched state.

13. The sheet conveying apparatus according to claim 12, wherein the belt is made of a rubber material of a relatively low hardness.

14. The sheet conveying apparatus according to claim 13, wherein the belt of the belt conveying unit is configured to move and guide the sheet while keeping a leading edge of the sheet in contact with the belt, and a conveying surface of the belt with which surface the sheet makes contact comprises protruding parts and receding parts.

15. An image scanning apparatus provided with the sheet conveying apparatus according to claim 11.

16. An image forming apparatus provided with the sheet conveying apparatus according to claim 11.

17. A sheet conveying apparatus, comprising:

a first conveying means for conveying a sheet in a first sheet conveying direction; and a second conveying means arranged on a downstream side of the first conveying means in the first sheet conveying direction, for conveying the sheet conveyed by the first conveying means in a second sheet conveying direction different from the first sheet conveying direction, wherein:

among the first conveying means and the second conveying means, at least the second conveying means acts as a holding and conveying means with a holding section to hold and convey the sheet and includes a moving and guiding unit which is positioned along an outer side of a sheet conveying path extending between the first conveying means and the second conveying means, the moving and guiding unit moves and guides the sheet toward the holding section of the second conveying unit, the moving and guiding unit is arranged in such a manner that a leading edge of the sheet approaches a conveying surface of the moving and guiding unit at an acute collision angle θ, the moving and guiding unit includes at least one belt conveying unit having a plurality of belts so as to convey the sheet toward the holding section of the second conveying unit, the holding section of the second conveying unit is provided on a downstream side of the conveying surface of the moving and guiding unit, and the plurality of belts are arranged along the sheet width direction so as to contact at least one part of the sheet in the sheet width direction.

* * * * *